US007371490B2

(12) United States Patent
Tamoto et al.

(10) Patent No.: US 7,371,490 B2
(45) Date of Patent: May 13, 2008

(54) PHOTOCONDUCTOR, IMAGE FORMING APPARATUS, IMAGE FORMING PROCESS, AND PROCESS CARTRIDGE

(75) Inventors: Nozomu Tamoto, Tokyo (JP); Tatsuya Niimi, Tokyo (JP); Tetsuro Suzuki, Tokyo (JP); Katsuichi Ohta, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 514 days.

(21) Appl. No.: 10/974,814

(22) Filed: Oct. 28, 2004

(65) Prior Publication Data

US 2005/0175911 A1 Aug. 11, 2005

(30) Foreign Application Priority Data

Oct. 30, 2003 (JP) ..... 2003-369854
Sep. 2, 2004 (JP) ..... 2004-256032

(51) Int. Cl.
*G03G 5/047* (2006.01)

(52) U.S. Cl. ..... 430/58.7; 430/59.5; 430/124; 399/159; 399/111

(58) Field of Classification Search ..... 430/59.5, 430/58.7, 58.05, 124; 399/159, 111
See application file for complete search history.

(56) References Cited

U.S. PATENT DOCUMENTS 5,576,131 A * 11/1996 Takai et al. ..... 430/59.3
2004/0033428 A1* 2/2004 Niimi ..... 430/59.5
2004/0248024 A1* 12/2004 Suzuki et al. ..... 430/58.7
2004/0253527 A1* 12/2004 Suzuki et al. ..... 430/58.7

FOREIGN PATENT DOCUMENTS

EP 0 740 216 A2 10/1996
EP 0 928 989 A1 7/1999
JP 2001-19871 1/2001

OTHER PUBLICATIONS

U.S. Appl. No. 11/616,180, filed Dec. 26, 2006, Suzuki et al.

(Continued)

*Primary Examiner*—Christopher RoDee
(74) *Attorney, Agent, or Firm*—Oblon, Spivak, McClelland, Maier & Neustadt, P.C.

(57) ABSTRACT

The object of the present invention is to provide a photoconductor that is highly sensitive, stable in image quality under repeated usages, and affords prolonged life.

In order attain the object, a photoconductor is provided that comprises a charge generating layer, a charge transporting layer, and a crosslinked charge transporting layer, on an substrate in order, the charge generating layer contains titanyl phthalocyanine crystal particles that exhibit a highest peak at 27.2°, main peaks at 9.4°, 9.6° and 24.0°, a peak at 7.3° as the lowest angle, and with no peaks in a range between 7.3° and 9.4°, and with no peak at 26.3° as Bragg 2θangles (±0.2°) in terms of CuK-α characteristic X-ray wavelength at 1.542 Å, and the averaged primary particle size of the titanyl phthalocyanine crystal particles is 0.25 μm or less, and the crosslinked charge transporting layer contains a reaction product of a radical polymerizable monomer having three or more functionalities and no charge transporting structure and a radical polymerizable compound having one functionality and a charge transporting structure, and the thickness of the crosslinked charge transporting layer is 1 to 10 μm.

21 Claims, 15 Drawing Sheets

OTHER PUBLICATIONS

U.S. Appl. No. 11/611,179, filed Dec. 15, 2006, Niimi et al.
U.S. Appl. No. 11/563,710, filed Nov. 28, 2006, Inaba et al.
U.S. Appl. No. 11/616,523, filed Dec. 27, 2006, Fujiwara et al.
U.S. Appl. No. 11/500,352, filed Aug. 8, 2006, Toshine et al.
U.S. Appl. No. 11/480,517, filed Jul. 5, 2006, Yanagawa et al.
U.S. Appl. No. 11/474,258, filed Jun. 26, 2006, Niimi.
U.S. Appl. No. 11/367,786, filed Mar. 6, 2006, Ohta et al.
U.S. Appl. No. 11/364,325, filed Mar. 1, 2006, Niimi.
U.S. Appl. No. 11/332,545, filed Jan. 17, 2006, Tamoto et al.
U.S. Appl. No. 11/272,826, filed Nov. 15, 2005, Kawasaki et al.
U.S. Appl. No. 11/245,135, filed Oct. 7, 2005, Nagai et al.
U.S. Appl. No. 11/229,749, filed Sep. 20, 2005, Ohshima et al.
U.S. Appl. No. 11/261,751, filed Oct. 31, 2005, Ohshima et al.
U.S. Appl. No. 11/219,886, filed Sep. 7, 2005, Niimi et al.
U.S. Appl. No. 11/172,989, filed Jul. 5, 2005, Li et al.
U.S. Appl. No. 11/218,657, filed Sep. 6, 2005, Suzuki et al.
U.S. Appl. No. 11/217,407, filed Sep. 2, 2005, Toda et al.
U.S. Appl. No. 11/136,488, filed May 25, 2005, Yanagawa et al.
U.S. Appl. No. 11/157,998, filed Jun. 22, 2005, Tamura et al.
U.S. Appl. No. 11/157,060, filed Jun. 21, 2005, Ikuno et al.
U.S. Appl. No. 11/110,937, filed Apr. 21, 2005, Ohshima et al.
U.S. Appl. No. 11/165,279, filed Jun. 24, 2005, Ohshima et al.
U.S. Appl. No. 11/166,853, Jun. 27, 2005, Ohshima et al.
U.S. Appl. No. 11/082,833, filed Mar. 18, 2005, Suzuki et al.
U.S. Appl. No. 11/317,048, filed Dec. 27, 2005, Nagai et al.
U.S. Appl. No. 11/304,711, filed Dec. 16, 2005, Kondo et al.
U.S. Appl. No. 11/033,802, filed Jan. 13, 2005, Yanagawa et al.
U.S. Appl. No. 11/068,180, filed Mar. 1, 2005, Tamoto et al.
U.S. Appl. No. 11/684,520, filed Mar. 9, 2007, Toshine et al.
U.S. Appl. No. 11/685,441, filed Mar. 13, 2007, Yanagawa et al.
U.S. Appl. No. 11/692,682, filed Mar. 28, 2007, Mori et al.
U.S. Appl. No. 11/621,805, filed Jan. 10, 2007, Suzuki et al.
U.S. Appl. No. 11/621,257, filed Jan. 9, 2007, Suzuki et al.
U.S. Appl. No. 11/625,873, filed Jan. 23, 2007, Niimi.

* cited by examiner

PHOTOCONDUCTOR, IMAGE FORMING APPARATUS, IMAGE FORMING PROCESS, AND PROCESS CARTRIDGE

BACKGROUND OF THE INVENTION

1. Field of the Invention

The present invention relates to a photoconductor that comprises a photoconductive layer, wherein the photoconductive layer comprises a charge generating layer, a charge transporting layer, and a crosslinked charge transporting layer, and wherein these layers are laminated in order on a substrate; and a image forming process, a image forming apparatus, and a process cartridge that utilize the photoconductor respectively.

2. Description of the Related Art

Information processing systems based on electrophotographic process have been dramatically developing. In particular, laser printers and digital copiers, which convert information into digital signals and record the information through optical technologies, have been remarkably improved in their printing quality and reliability. These laser printers and digital copiers are still demanded higher image quality, higher speed, and more compacted size.

In addition, recently, the market of laser printers and digital copiers capable of full-color printing has been increasing rapidly. Such full-color printing requires duplicating toner images of at least four colors, therefore, the technologies as to higher speed and more compacted size are needed still more. In order to achieve the higher speed and more compacted size, the photoconductors employed to the laser printers and digital copiers (hereinafter, sometimes referring to "electrophotographic photoconductor" or "electrostatic latent image carrier") should be improved the sensitivity and also should be miniaturized.

Provided that the conventional photoconductors are employed as they are, the exchanging periods will remarkably shorter since the conditions in use are more sever. Accordingly, improvements in resistance and stability of photoconductors employed in such apparatuses are absolutely required in order to achieve higher speed and more compacted size of apparatuses.

The resistance of photoconductors is evaluated based on the image qualities; specifically, laser printers and digital copiers that make use of reversible developing are mainly evaluated the life based on the background smear, which is numerous number of black points printed on white media. Accordingly, in order to achieve the higher speed and more compacted size of the apparatuses, the life of photoconductors should be prolonged along with higher sensitivity of photoconductors and controlling of the background smear.

In order to achieve the more compacted size of the apparatuses, a charge generating substance with higher quantum efficiency is absolutely necessary.

As for the organic photoconductors with higher sensitivity, titanyl phthalocyanines are widely and effectively utilized that show a maximum diffraction peak at 27.2 degrees as Bragg 2θ angle under CuK-α characteristic X-ray wavelength at 1.542 angstroms.

However, the photoconductors formed from the titanyl phthalocyanines are significantly susceptible to the background smear due to pigment flocculation or decreased charging property. In particular, the background smear is a serious matter as described above. Therefore, apparatuses with photoconductors formed from titanyl phthalocyanines are not establish both of the higher speed and more compacted size due to poor image stability, since the effect of the background smear is significant even if the higher speed is attained (see Japanese Patent Application Laid-Open (JP-A) No. 2001-19871).

On the other hand, protective layers on photoconductors are known to be effective to enhance the abrasion resistance thereby to prolong the life of the photoconductors. The background smear, which determines the life of photoconductors, is enhanced by the fatigue or abrasion of photoconductors under repeated usages. The control of the photoconductor abrasion under repeated usages by means of a protective layer on the photoconductor surface may lead to the decrease of background smear, through the control of the electric field increase derived by the abrasion, thereby may be a very effective way to prolong the life.

The techniques to improve abrasion resistance of the photoconductive layer include (1) using a curable binder in the surface layer (for example, JP-A No. 56-48637), (2) using a polymer charge transport material (for example, JP-A No. 64-1728), (3) dispersing an inorganic filler in the surface layer (for example, JP-A No. 4-281461) and the like. Among these techniques, the use of a curable binder in (1) tends to cause reduction in image density since the curable binder has poor compatibility with the charge transporting material and impurities such as a polymerization initiator and unreacted residue is likely to increase the residual potential. Also, the use of a polymer charge transport material in (2) may somewhat improve the abrasion resistance. However, it is not sufficient for satisfying the durability required in the organic photoconductor. Further, it is difficult to polymerize and purify the polymer charge transporting material. Thus, it is impossible to obtain it at high purity and to attain stable electrical properties between materials upon using it. In addition, it may cause problems such as high viscosity of the coating solution in terms of the preparation. The dispersion of the inorganic filler in (3) shows high abrasion resistance, as compared to that of the conventional photoconductor comprising a low molecular charge transporting material dispersed in inactive high molecules (polymer). However, traps on the surface of the inorganic filler tends to increase the residual potential, thereby causing reduction in the image density. Also, when unevenness of the inorganic filler and the binder resin on the surface of the photoconductor is severe, inferior cleaning may occur, resulting in toner peeling and image deletion. With these techniques (1), (2) and (3), it is impossible to satisfy sufficiently the durability required for organic photoconductors, including electrical durability and mechanical durability.

Furthermore, in order to improve the abrasion resistance and scratch resistance of (1), a photoconductor containing a cured body of a multi-functional acrylate monomer is disclosed (Japanese Patent No. 3262488). In this patent, the purpose of inclusion of cured material of this multi-functional acrylate monomer in a protective layer on the photoconductive layer is described; however, there is no more than a simple description that a charge transporting material may be contained in the protective layer and there is no concrete descriptions. Further, when a low molecular charge transport material is simply added to the surface layer, it may cause problems related with the compatibility to the cured body, thereby crystallization of the low molecular charge transporting material and clouding may occur, resulting in reduction in mechanical properties.

In addition, according to this photoconductor, since the monomer is reacted while it contains a polymer binder, the curing cannot be sufficiently progressed.

As technique for inhibiting abrasion of the photoconductive layer to substitute the above techniques, a process for forming a charge transporting layer using a coating solution comprising a monomer having a carbon-carbon double bond, a charge transport material having a carbon-carbon double bond and a binder resin (for example, Japanese Patent No. 3194392). The binder resin includes a binder reactive with the charge transport material having a carbon-carbon double bond and a binder non-reactive with the charge transport material without having the double bond. This photoconductor has attracted public attention since it shows abrasion resistance along with excellent electrical properties. However, when a non-reactive resin is used as the binder resin, the binder resin is poorly compatible with the cured body produced by the reaction of the monomer and the charge transporting material, thereby surface unevenness during cross-linking forms from the phase separation, resulting in cleaning failure. Also, as described above, in addition to the interference of the binder resin with the curing of the monomer, a bi-functional monomer which can be used in the photoconductor has a few functionality and fails to provide a sufficient cross-linkage density, thereby it is possible to obtain a sufficient abrasion resistance. Also, when a reactive binder is used, since the number of functional groups contained in the monomer and the binder resin is small, the bonding of the charge transporting material and the cross-linkage density cannot be satisfied at the same time and the electrical properties and abrasion resistance are not sufficient.

Also, a photoconductive layer containing a cured hole transporting compound having two or more chain polymerizable functional groups in a molecule (for example, JP-A No. 2000-66425).

However, according to the photoconductive layer, since the bulky transporting compound has two or more chain polymerizable functional groups, distortion may occur in the cured body, causing increase in internal stress, roughness of the surface layer, and formation of crack over the time.

Even in a photoconductor having a crosslinked photoconductive layer with a charge transporting structure attached in a chemical fashion, it cannot be said that general properties are sufficiently attained.

As explained above, even though the higher speed of apparatuses may be established through employing the photoconductors formed from titanyl phthalocyanines, the photoconductors must be often exchanged due to the decreased image quality caused by background smear; even though the abrasion resistance may be enhanced by forming a protective layer, the decrease of image quality may grow due to the increase of residual potential and inferior cleaning; as a result both of the higher sensitivity and prolonged life of the photoconductors desired for high-speed or color apparatuses have not been attained yet.

As such, image forming apparatuses with an improved photoconductor capable of forming images stably for a long period are definitely desired in the field of high-speed and color laser printers and digital copiers.

SUMMARY OF THE INVENTION

The object of the present invention is to provide a photoconductor that exhibits high sensitivity, stable image quality under repeated usages, and prolonged life, as well as a process cartridge, an image forming process, and an image forming apparatus that utilize the photoconductor respectively.

The photoconductor according to the present invention comprises in order a substrate, a charge generating layer, a charge transporting layer, and a crosslinked charge transporting layer, the charge generating layer contains titanyl phthalocyanine crystal particles that exhibit a highest peak at 27.2°, main peaks at 9.4°, 9.6° and 24.0°, a peak at 7.3° as the lowest angle, and with no peaks in a range between 7.3° and 9.4°, and with no peak at 26.3° as Bragg 2θ angles (±0.2°) in terms of CuK-α characteristic X-ray wavelength at 1.542 Å, and the averaged primary particle size of the titanyl phthalocyanine crystal particles is 0.25 μm or less, the crosslinked charge transporting layer contains a reaction product of a radical polymerizable monomer having three or more functionalities and no charge transporting structure and a radical polymerizable compound having one functionality and a charge transporting structure, and the thickness of the crosslinked charge transporting layer is 1 to 10 μm.

In accordance with the present invention, an electrophotographic photoconductor may be provided that shows high abrasion resistance under prolonged and repeated usages, and stably affords high quality images for a long term without causing abnormal images due to cracks, flaws, layer peels and the like derived from inferior cleaning, with controlling background smear as well as enhancing the potential stability.

The process cartridge according to the present invention comprises a photoconductor, and at least one of an electrostatic latent image forming unit configured to form an electrostatic latent image, a developing unit configured to develop the electrostatic latent image by means of a toner to form a visible image, a transferring unit configured to transfer the visible image on a recording medium, and a cleaning unit configured to clean the toner remaining on the photoconductor, mounted in an attachable and detachable fashion to a main body of an image forming apparatus, wherein the photoconductor is one according to the present invention.

The process cartridge according to the present invention may exhibit flaw resistance, abrasion resistance, and durability for a long term and may provide images with high quality owing to the photoconductor according to the present invention.

The image forming process according to the present invention comprises forming an electrostatic latent image, developing the electrostatic latent image by means of a toner to form a visible image, transferring the visible image on a recording medium, and fixing the transferred image on the recording medium, wherein the photoconductor is one according to the present invention.

The image forming process according to the present invention may allow flaw resistance, abrasion resistance, and durability for a long term and may provide images with high quality owing to the photoconductor according to the present invention.

The image forming apparatus according to the present invention comprises a photoconductor, an electrostatic latent image forming unit configured to form an electrostatic latent image, a developing unit configured to develop the electrostatic latent image by means of a toner to form a visible image, a transferring unit configured to transfer the visible image on a recording medium, and a fixing unit configured to fix the transferred image on the recording medium, wherein the photoconductor is one according to the present invention.

The image forming apparatus according to the present invention may afford flaw resistance, abrasion resistance, and durability for a long term and may provide images with high quality owing to the photoconductor according to the present invention.

DESCRIPTION OF THE PREFERRED EMBODIMENTS

[Photoconductor]

Figure 1:
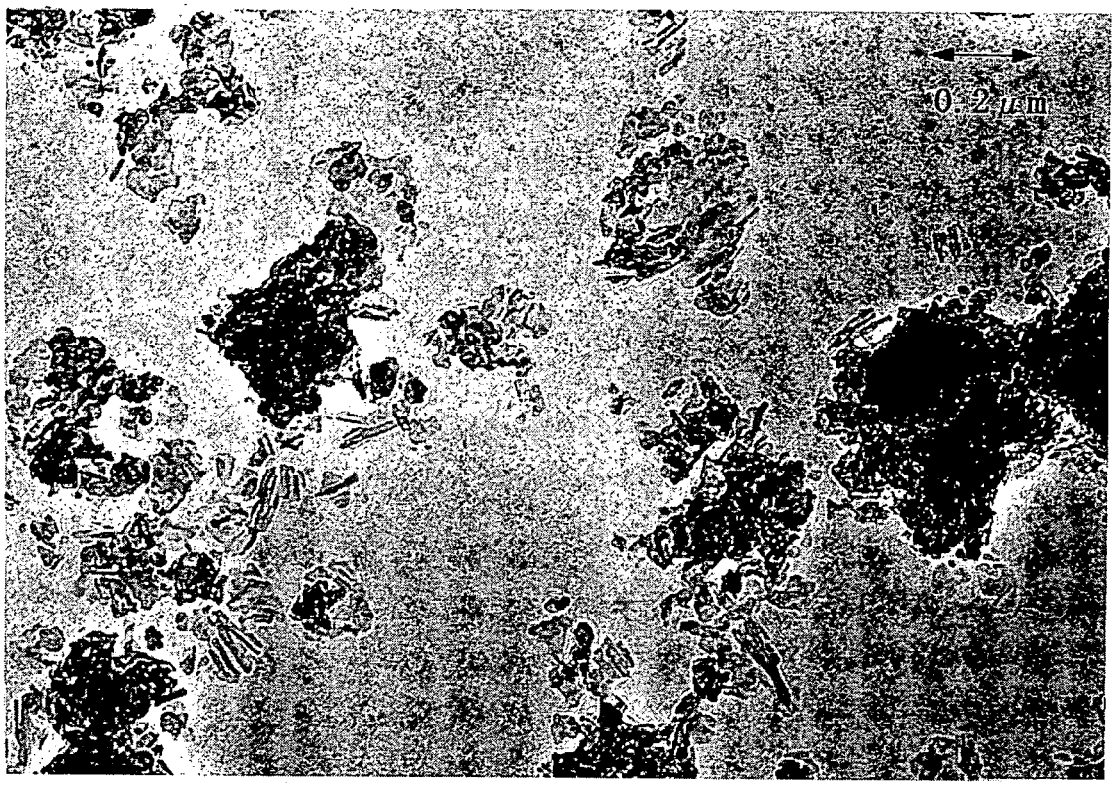
FIG. 1 exemplarily shows an electron microscope photography of amorphous or lower crystallinity titanyl phthalocyanine particles adapted to the present invention.

The photoconductor according to the present invention comprises a support, and a photoconductive layer that is composed of a charge generating layer, a charge transporting layer, and a crosslinked charge transporting layer, wherein these layers are laminated on the support in order.

The photoconductor contains in the charge generating layer titanyl phthalocyanine crystal particles that exhibit a highest peak at 27.2°, main peaks at 9.4°, 9.6° and 24.0°, a peak at 7.3° as the lowest angle, and with no peaks in a range between 7.3° and 9.4°, and with no peak at 26.3°, as Bragg 2θ angles in terms of CuK-α characteristic X-ray wavelength at 1.542 Å, and the averaged primary particle size is 0.25 μm or less. The crosslinked charge transporting layer is formed by curing at least a radical polymerizable monomer having three or more functionalities and no charge transporting structure and a mono-functional radical polymerizable compound having a charge transporting structure, wherein the layer thickness of the crosslinked charge transporting layer is 1 to 10 μm.

JP-A No. 2001-19871 discloses the titanyl phthalocyanine crystal, and also the charge generating substance, and the photoconductor and image forming apparatus that utilize the substance.

By means of the titanyl phthalocyanine crystal, higher sensitivity may be attained, and electrophotographic photoconductors may be obtained that exhibit charging stability even after the repeated usages. However, the background smear may not be perfectly eliminated only by means of the titanyl phthalocyanine crystal, and the controlling effect is not perfectly satisfactory yet.

The present invention has involved improvements concerning fine division of titanyl phthalocyanine crystal and elimination of flocculate, and we have founded that these improvements may remarkably reduce the background smear.

Further, the present invention has involved an improvement against a problem as to the abrasion resistance that the controlling effect on the background smear rapidly decreases when the electric field strength raises due to the abrasion of the photoconductor after the repeated usages, even though the photoconductor may be obtained that is highly sensitive and able to control the background smear through employing the titanyl phthalocyanine crystal in the charge generating layer, as such the prolonged life is not established yet.

In particular, the background smear tends to occur in high-speed and/or color apparatuses, since the usage conditions come to more sever and thereby the effects of the abrasion are remarkably enlarged. The conventional ways to enhance the abrasion resistance of photoconductors may enhance the abrasion resistance also; however, the residual potential may occur rapidly, image defect and/or image blur may be induced due to inferior cleaning, therefore, the photoconductors must be exchanged before the background smear due to such problems other than background smear, as such the prolonged life has not been achieved yet.

In the present invention, incorporation of the titanyl phthalocyanine crystal into the charge generating layer leads to higher sensitivity; the fine division of pigment and/or the reduction of flocculates leads to reduction of the effects of background smear; and also the crosslinked charge transporting layer, having enhanced abrasion resistance, electrical stability, and superior flaw resistance against peeling, clack, and the like, leads to the reduction of background smear even after the prolonged and repeated usages. As a result, the inventive photoconductor may exhibit both of electrostatic stability and image stability, thereby may provide higher speed and/or color apparatuses with affording stable images for prolonged period.

The process for producing titanyl phthalocyanine crystal adapted for the charge generating layer will be explained in detail.

Initially, the process for synthesizing the titanyl phthalocyanine crystal will be explained. Preferably, the raw material in the process is not halogenated titanium as described in JP-A No. 6-293769, and the titanyl phthalocyanine crystal is produced substantially with no halogen elements.

The impurity of halogenated titanyl phthalocyanine crystal in the titanyl phthalocyanine crystal is likely to occur the reduction of photosensitivity and charging properties in the photoconductors (see Japan Hardcopy '89, Manuscripts p. 103 (1989)). The present invention is mainly intended to and effectively uses halogen-free titanyl phthalocyanines as described in JP-A No. 2001-19871. These materials may be effectively utilized.

The process for synthesizing titanyl phthalocyanine crystal having a specific crystal type adapted to the present invention will be explained in the following.

The process for synthesizing phthalocyanines is previously known, for example as described in "Phthalocyanine Compounds, Moser et al., 1963", "The Phthalocyanines, 1983", JP-A No. 6-293769 and the like.

In the first exemplary process, the mixture of phthalic anhydride, metal or metal halide, and urea is heated in the presence or absence of solvent having a high boiling point. A catalyst such as ammonium molybdate is employed in the process if necessary.

In the second exemplary process, the mixture of phthalonitrile and metal halide is heated in the presence or absence of solvent having a high boiling point. In the process, phthalocyanines that are not capable to yield in the first exemplary process may be obtained such as aluminum phthalocyanines, indium phthalocyanines, oxovanadium phthalocyanines, oxotitanium phthalocyanines, zirconium phthalocyanines.

In the third exemplary process, phthalic anhydride or phthalonitrile and ammonia are primarily reacted to produce an intermediate product such as 1,3-diimino isoindoline, then the intermediate product is reacted with a metal halide in the presence of solvent having a high boiling point.

In the fourth exemplary process, phthalonitriles and metal alkoxide are reacted in the presence of urea or the like. The fourth process is appropriate for the present invention in a view point that chlorination or halogenation of aromatic ring, which is improper for electrophotographic materials, does not be induced.

The process for producing amorphous or lower crystallinity titanyl phthalocyanines will be explained in the following.

The process comprises dissolving phthalocyanines into sulfuric acid, diluting the solution, and redepositing phthalocyanines; the process include acid paste method and acid slurry method. Specifically, a synthesized product such as of the first to fourth process is dissolved into 10 to 50 times of concentrated sulfuric acid, insoluble substance is removed by filtration or the like if necessary, and the solution is poured slowly into 10 to 50 times of cooled water or ice water to deposit again the titanyl phthalocyanine.

The deposited titanyl phthalocyanine is filtered and rinsed with de-ionized water till the filtrate turns into neutral. A paste having a content of 5 to 15% by mass is prepared after the final filtration and rinsing.

In the process for producing amorphous titanyl phthalocyanines, it is important to rinse it sufficiently with de-ionized water and to reduce the sulfuric acid as low as possible. Specifically, the rinsed de-ionized water exhibits the following properties: 6.0 to 8.0 of pH or 8.0 or less of specific conductivity. If the pH or specific conductivity is in the range, the residual sulfuric acid does not effect on the photoconductor property in general; when outside the range, the charging property may be reduced or the optical sensitivity may be deteriorated due to the residual sulfuric acid.

The amorphous or lower crystallinity titanyl phthalocyanine adapted to the present invention may be produced as follows. Preferably, the titanyl phthalocyanine exhibit a highest diffraction peak in a range between 7.0 to 7.5° as Bragg 2θ angles in terms of the CuK-α characteristic X-ray wavelength at 1.542 Å, the half-value width of the diffraction peak is 1.0° or more. Preferably, the averaged primary particle size is 0.1 μm or less.

The process for converting crystalline configuration will be explained. In the process, the amorphous or lower crystallinity titanyl phthalocyanine is converted to titanyl phthalocyanine crystal that exhibits a highest peak at 27.2°, main peaks at 9.4°, 9.6° and 24.0°, a peak at 7.3° as the lowest angle, and with no peaks in a range between 7.3° and 9.4°, and with no peak at 26.3° as Bragg 2θ angles (±0.2°) in terms of CuK-α characteristic X-ray wavelength at 1.542 Å.

Specifically, the amorphous or lower crystallinity titanyl phthalocyanine is converted to the titanyl phthalocyanine crystal through mixing and stirring with an organic solvent in the presence of water without drying step. The utilized organic solvent may be any one provided that the desired crystalline type may be obtained. Specifically, tetrahydrofuran, toluene, methylene chloride, carbon disulfide, orthodichlorobenzene, 1,1,2-trichloroethane are preferred. These solvent may be used alone or in combination of two or more, or may be used with other solvents.

The amount of the organic solvent utilized in the crystalline transformation is preferably 10 times or more, more preferably 30 times or more than the mass of the amorphous titanyl phthalocyanine, thereby the crystalline transformation proceeds rapidly and sufficiently, and the effect to remove impurities in the amorphous titanyl phthalocyanine may be attained satisfactorily.

When the amorphous or lower crystallinity titanyl phthalocyanine is produced by way of acid paste method, it is preferred to utilize the amorphous or lower crystallinity titanyl phthalocyanine that is sufficiently removed the residual sulfuric acid as described above. If the crystalline transformation is conducted under the remaining sulfuric acid, sulfuric ion exists within the crystal particles consequently, the ion may not be removed sufficiently even though the resulting crystal is treated with rinsing with de-ionized water. When sulfuric ion remains, desirable results may not be expected due to decrease of sensitivity and/or charging property of photoconductors. For example, JP-A No. 08-110649 describes a method for transforming crystal in which titanyl phthalocyanine dissolved in sulfuric acid is poured into an organic solvent with de-ionized water. In the method, the concentration of sulfuric ion in the titanyl phthalocyanine is too high therefore the optical sensitivity is inferior, although the resulting titanyl phthalocyanine crystal shows the similar X-ray diffraction spectrum with the desirable titanyl phthalocyanine crystal.

The process for converting crystalline configuration is similar with that of JP-A No. 2001-19871.

In the charge generating substance incorporated into the inventive photoconductor, fine division of the particle size of the titanyl phthalocyanine crystal leads to higher effects on the prevention of background smear, image stabilization, and prolonged life.

There exists substantially two ways to control the particle size of titanyl phthalocyanine crystal incorporated into the photoconductive layer. On way is to produce the titanyl phthalocyanine crystal particles without those having particle sizes of more than 0.25 μm; another way is producing the titanyl phthalocyanine crystal particles, dispersing the titanyl phthalocyanine crystal particles, and then removing the lager particles having particle sizes of more than 0.25 μm. Clearly, these ways may be combined.

Initially, the way to produce the fine particles of titanyl phthalocyanine crystal will be explained. In the investigation to lower the titanyl phthalocyanine crystal, we observed that the particles of the amorphous or lower crystallinity titanyl phthalocyanine have the primary particle size of 0.1 μm or less, mostly about 0.01 to 0.05 μm, and the crystalline transformation proceed along with crystalline growth. FIG. 1 exemplarily shows an transmission electron microscope (TEM) photography of amorphous or lower crystallinity titanyl phthalocyanine particles adapted to the present invention. The scale bar in FIG. 1 is 0.2 μm.

Figure 2:
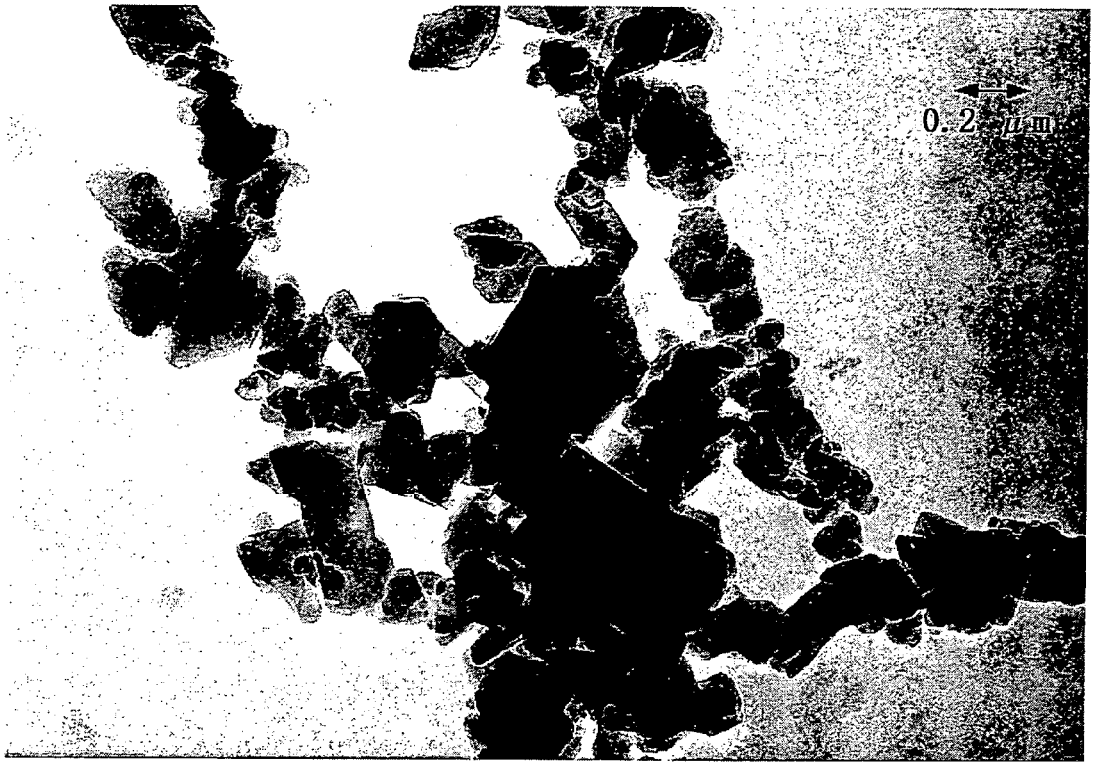
FIG. 2 exemplarily shows an electron microscope photography of titanyl phthalocyanine particles transformed by a conventional way.

Usually, the crystalline transformation is carried out for a long period so as not to remain the raw material in the product, and filtering is carried out after the sufficient crystalline transformation to recover the titanyl phthalocyanine crystal having a desired crystal form. Accordingly, the crystal after the crystalline transformation have larger primary particle size of about 0.3 to 0.5 μm, although the primary particles of the raw material have a sufficiently low size. FIG. 2 exemplarily shows another transmission electron microscope (TEM) photography of titanyl phthalocyanine particles transformed by a conventional way. The scale bar in FIG. 2 is 0.2 μm.

In the dispersion step of the resulting titanyl phthalocyanine crystal, the dispersion is carried out by applying a high shear rate, and also a higher comminuting energy is applied depending on the necessity. As a result, a part of the crystal particles is likely to transform into an undesired crystal form.

On the contrary, according to the present invention, the instantaneous moment of the completed crystalline transformation is determined within a range that crystal growth hardly progresses along with the crystalline transformation, i.e. within a range that the particle size of the amorphous titanyl phthalocyanine crystal, for example shown in FIG. 1, is not so different from before the crystal transformation, thereby titanyl phthalocyanine crystal is produced that has a particle size as low as possible.

The growth of particle size during crystal transformation is substantially proportional to the period for crystal transformation. Accordingly, it is important to raise the efficiency of transformation and to complete it within a shorter period. There exist several key ways to attain the object.

One way is to select a suitable solvent for the crystal transformation, thereby to enhance the efficiency of the crystal transformation.

Another way is to stir intensely the mixture of the solvent and the aqueous paste of titanyl phthalocyanine, e.g. the amorphous titanyl phthalocyanine produced as described above, so as to contact them sufficiently, thereby to complete the crystal transformation in a shorter period. Specifically, by means of stirring with considerably high sharing rate or a device with vivid stirring such as a homomixer, the crystal transformation is performed within a shorter period.

By employing these conditions, titanyl phthalocyanine crystal may be obtained without residual raw material, with sufficient crystal transformation, and substantially without the crystal growth. The optimization of the organic solvent amount for crystal transformation is also effective in these conditions. Specifically, the organic solvent is preferably utilized in a amount of 10 times or more, more preferably 30 times or more of the solid content of the amorphous titanyl phthalocyanine. Thereby, the crystal transformation may be achieved more reliably in a shorter period, and the impurities in the amorphous titanyl phthalocyanine may be removed more reliably.

Further, rapid interruption of the reaction or crystal transformation after the predetermined reaction may be effective since the size of crystal particles is proportional to the period for crystal transformation. For example, a solvent, under which the crystal transformation does not progress substantially, is added to the reactant after the crystal transformation. Examples of the solvent under which the crystal transformation does not progress include solvents of alcohols and esters. These solvents may interrupt the crystal transformation in an amount of about 10 times of the solvent that promotes the crystal transformation.

The resulting titanyl phthalocyanine crystal is advantageous to prevent the background smear due to the lower primary particle size. However, adverse effects may be arisen in the subsequent process for filtering the pigment or stability of the dispersion, if the size is too small.

That is, too small primary particles lead to a problem that the filtrating period is too long, and the particles tend to flocculate again since the surface area of the pigment particles is enlarged in the dispersion, as a result the background smear is possibly induced as the adverse affect. Accordingly, the suitable particle size of the pigment particles is about 0.05 to 0.2 μm.

Figure 3:
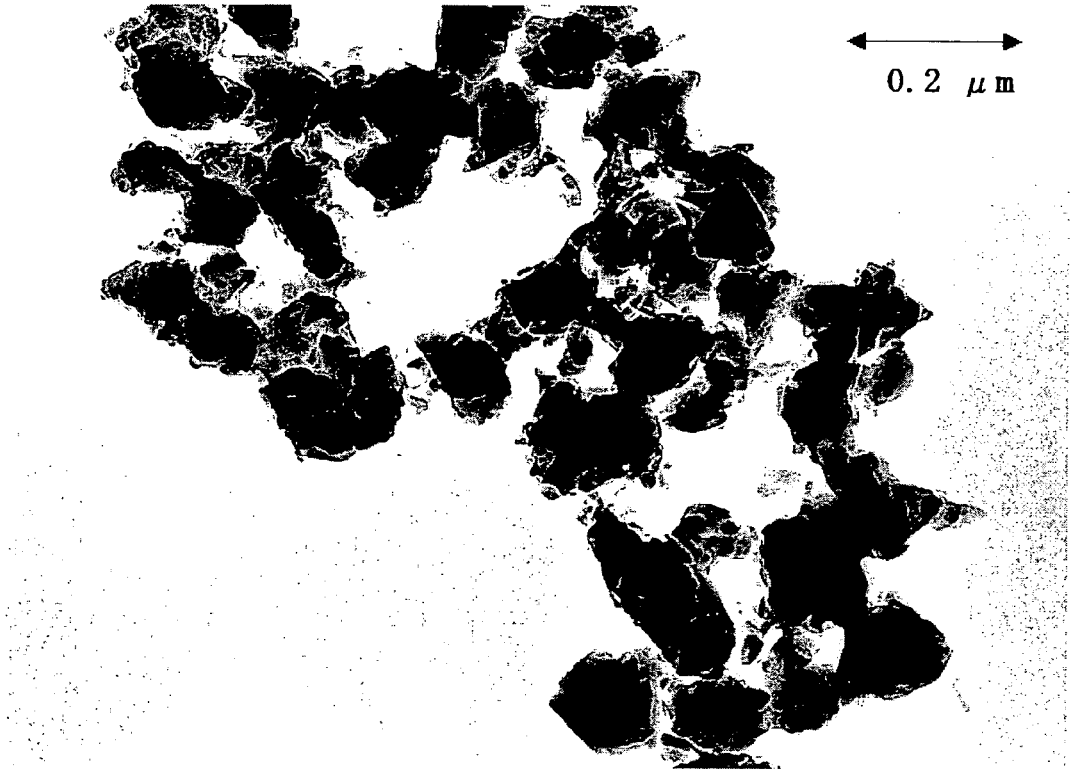
FIG. 3 exemplarily shows an electron microscope photography of transformed titanyl phthalocyanine particles adapted to the present invention.

FIG. 3 shows an image of transmission electron microscope (TEM) of titanyl phthalocyanine crystal that is subjected crystal transformation for a shorter period. The scale bar in FIG. 3 corresponds to 0.2 μm. Contrary to FIG. 2, the particle size is smaller and nearly uniform; larger particles existing in FIG. 2 cannot be recognized at all.

In dispersing such particles of titanyl phthalocyanine crystal, a desirable volume-averaged particle size i.e. 0.25 μm or less, preferably 0.2 μm or less, can be obtained, even though the higher shearing rate is not applied, which is necessary to disperse the titanyl phthalocyanine including larger particles as shown in FIG. 2, since the primary particle size of the titanyl phthalocyanine crystal is sufficiently low. As a result, the problem may be avoided that excess dispersing leads to different undesirable crystal transformation of a part of particles.

In the present invention, the averaged particle size refers to the volume-averaged particle size measured by Gravitational Sedimentation Particle Size Distribution Analyzer CAPA-700 (by HORIBA Ltd.,); specifically, it refers to the median size corresponding to 50% size of the cumulative distribution. In some case, the method may not detect a very small amount of larger particles, therefore, it is important to observe titanyl phthalocyanine or its dispersion by means of electron microscope such as TEM and to determine the particle size based on TEM.

As a result of investigation as to small defects, we explain the defect as follows, through observing the dispersion precisely.

In a measurement of averaged particle size, the considerably large particles or coarse particles may be usually detected when such particles exist in a amount of up to several percents; however, when the amount of such particles is no more than one percent, such particles cannot be detected due to the limit of detection through the measurement of the averaged particle size. As a result, the relation between the considerably large particles or coarse particles and the small defects have not been clearly understood.

Figure 4:
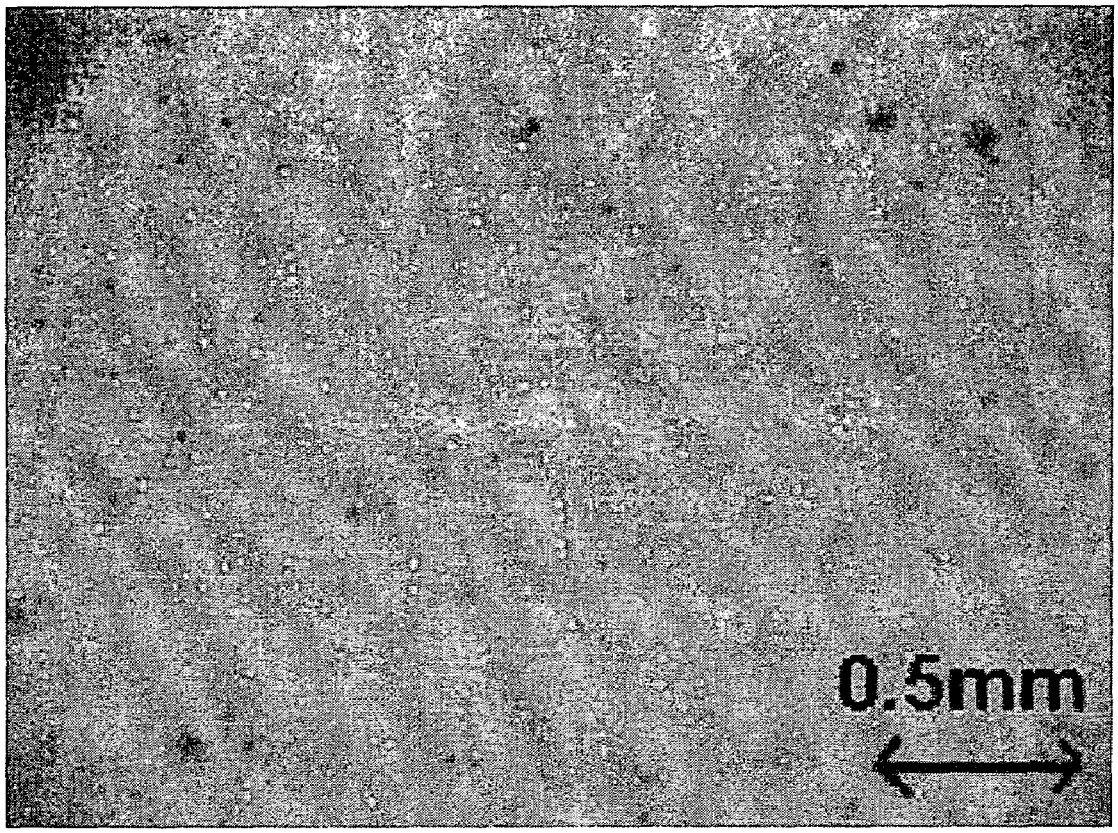
FIG. 4 schematically shows a photography that displays an exemplary dispersion.
Figure 5:
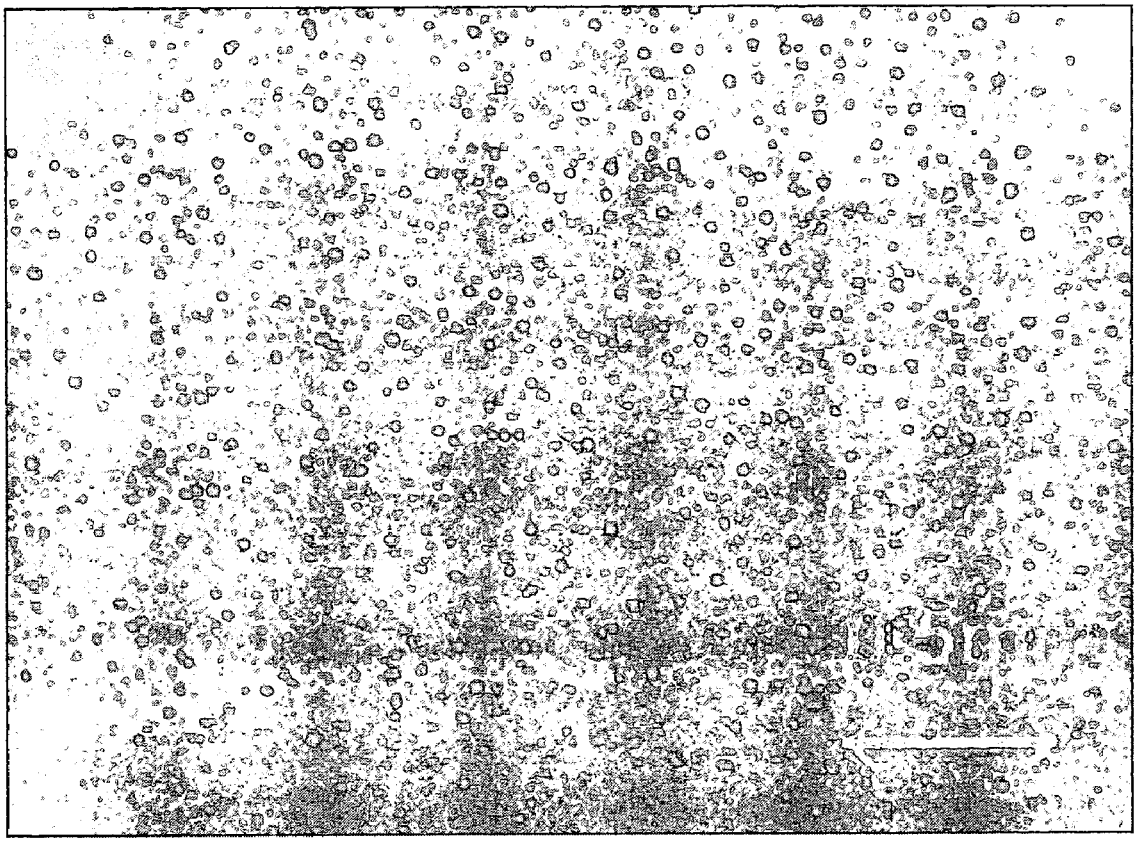
FIG. 5 schematically shows a photography that displays another exemplary dispersion.

FIGS. 4 and 5 show images of dispersion which are same with the dispersing condition and different with the dispersing period. FIG. 4 is an image of the dispersion that was dispersed for shorter period with the same dispersing condition, which shows that relatively large amount of considerably large particles or coarse particles is observed in FIG. 4 compared with the image of FIG. 5 that was dispersed for a shorter period.

Figure 6:
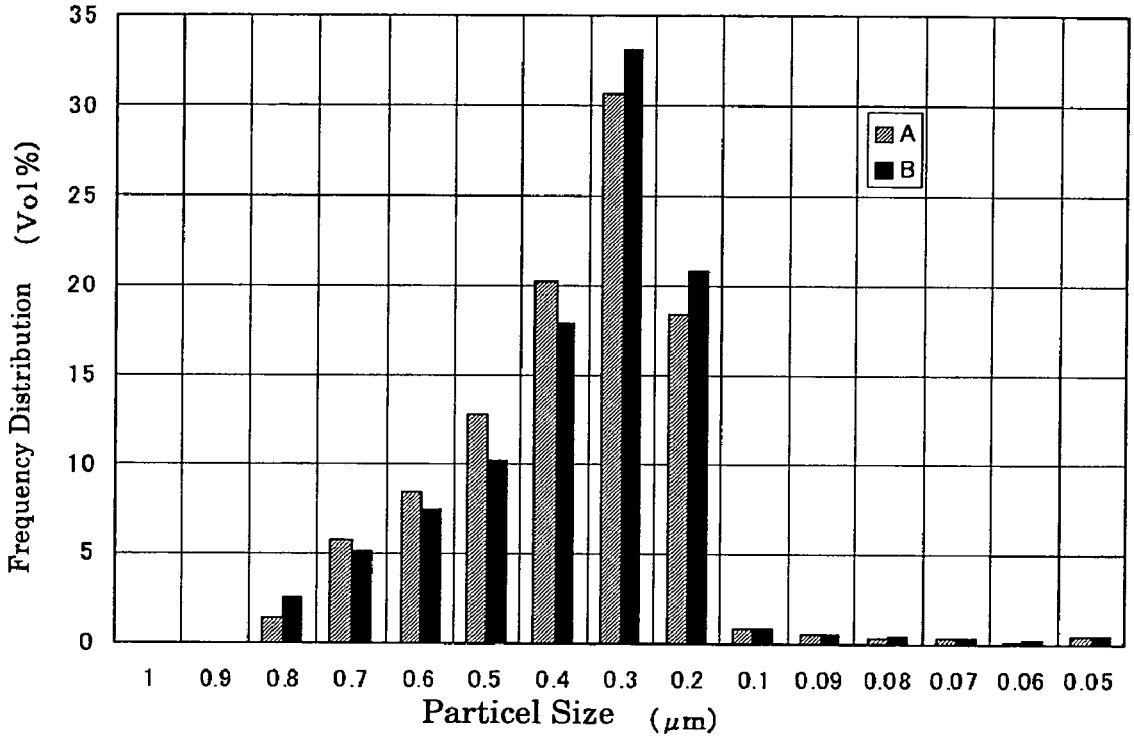
FIG. 6 exemplarily shows a graph that illustrates an averaged particle size and size distribution.

The averaged particle size and particle distribution of the two dispersions were measured by means of CAPA-700 (by HORIBA Ltd.,) in a conventional way. The results are shown in FIG. 6. "A" in FIG. 6 corresponds to the dispersion shown in FIG. 4, "B" in FIG. 6 corresponds to the dispersion shown in FIG. 5. Comparing the results of "A" and "B", there are not significant difference. Further, the volume-averaged particle size of "A" is 0.29 μm and that of "B" is 0.28 μm. Considering the measurement error, there is not significant difference between them.

Accordingly, only the conventional measurement of the averaged particle size cannot detect the small amount of coarse particles, therefore the relation with the background smear cannot be recognized clearly. The small amount of coarse particles can be recognized by observing the suspension by means of an electron microscope and the like, thereby the relation between the background smear comes to be clear.

Based on these characterizations of the volume-averaged particle size, particle distribution, and amount of coarse particles, the proper selection of solvent in order to lower the primary particle size at the crystal transformation, controlling the flocculation, the enhancement of crystal transforming efficiency, the shorter period of crystal transformation, and vigorous stirring of the solvent and the aqueous paste of titanyl phthalocyanine may be effectively evaluated.

The crystal transforming process may produce titanyl phthalocyanine crystal with smaller particle size such as 0.25 μm or less, preferably 0.2 μm or less. In addition to the technologies described in JP-A No. 2001-19871, the optional employment of the above described technologies as to the crystal transformation process for producing fine titanyl phthalocyanine crystal may enhance the effect of the present invention.

Then, the titanyl phthalocyanine crystal subjected to the crystal transformation is immediately filtered thereby separated from the solvent for crystal transformation. The filtering is carried out by means of a filter having appropriate pore size and the like. Preferably, evacuated filtering is employed in the step.

Then, the separated titanyl phthalocyanine crystal is subjected to optional drying step. The drier for the drying step may be any one utilized in the art; preferably a type of forced air drier is utilized when the drying is conducted under atmospheric pressure. The drying under vacuumed pressure is an effective way to raise the drying rate and to enhance the effect of the present invention. In particular, it is effective for the material that decompose or transform at higher temperatures. The vacuum degree at the drying is preferably higher than 10 mm Hg.

The resulting titanyl phthalocyanine crystal having a certain crystal form is significantly available for charge generating substance of electrophotographic photoconductor. However, the titanyl phthalocyanine crystal is unstable in the crystal form, and tends to transform at preparing the dispersion as described above.

By way of synthesizing the crystal with primary particles as small as possible, dispersion with smaller particle size may be prepared without causing excessively high sharing rate at preparing the dispersion, and the crystal form may be stable without transforming from the synthesized form.

The preparation of the dispersion may be conventional in the art, for example, the titanyl phthalocyanine crystal is dispersed into a appropriate solvent with an optional binder resin by means of a ball mill, attriter, sand mill, beads mill, or ultrasonic device. The binder may be selected with reference to the electrostatic property of the photoconductor and the like, the solvent may be selected with reference to the wettability against the pigment and the dispersibility of the pigment.

It is known that the titanyl phthalocyanine crystal that exhibits the highest peak at 27.2° as Bragg 2θ angles (±0.2°) in terms of the CuK-α characteristic X-ray wavelength at 1.542 Å may easily transform to the other crystal form through some stress such as thermal energy and mechanical shear, which is true in the titanyl phthalocyanine crystal employed in the present invention.

In order to prepare a dispersion that contains fine particles, the way to prepare the dispersion should be suitably selected. In general, there exist a trade-off relation between the crystal stability and the fine division. The trade-off relation may be mitigated somewhat by optimizing the dispersing condition, however, the producing condition is likely to be limited, therefore, convenient ways are desired. For the countermeasure, the following way may be helpful.

The particles in the dispersion is divided as finely as possible to prepare a dispersion in a condition that the crystal transformation may be avoided, then the dispersion is subjected to filtering by means of a suitable filter to remove coarse particles. The way is very effective in that a small amount of remaining coarse particles, which cannot be detected easily by particle size distribution analysis, may be removed and the resulting particles are relatively of uniform particle size.

Specifically, the dispersion prepared as described above is subjected to filtering by means of a filer having an effective pore size of 3 μm or less, more preferably 1 μm or less to prepare a desired dispersion. In the process, the dispersion that contains titanyl phthalocyanine crystal having exclusively small particle size of 0.25 μm or less, preferably 0.2 μm or less. The photoconductor formed from the titanyl phthalocyanine crystal may exhibit higher resistance against the background smear and higher durability.

In the process, when the particles in the dispersion have excessively large particle sizes or excessively broad particle distribution, the loss during the filtering may come to significant, or blocking of the filter may make filtering impossible. Accordingly, the dispersion is preferably dispersed before filtering till the volume-averaged particle size lowers to 0.3 μm or less and the standard deviation lowers to 0.2 μm or less. When the volume-averaged particle size is above 0.3 μm, the loss of particles due to the filtering tends to be large, when the standard deviation is above 0.2 μm, the filtering period is likely to be considerably long.

The filter for filtering the dispersion is selected depending on the size of coarse particles to be removed. From our investigations, the photoconductor, of which the resolution is required to be about 600 dpi, is affected by the coarse particles of 3.0 μm or more. Accordingly, the available filter has an effective pore size of 3.0 μm or less. More preferably, the effective pore size is 1.0 μm or less.

Although the effective pore size comes to smaller, the effect to remove the coarse particle turns into higher, excessively fine pore size arises unexpected problems such as the desired pigment particles themselves are filtered, the period for filtering is too long, the filter is plugged, and the load of pump for feeding is too large, therefore a filter having an appropriate effective pore size should be selected.

Needless to say, the material of the filter is selected from the materials resistant for the dispersion to be filtered.

By properly filtering the dispersion, coarse particles may be filtered and removed, the resulting photoconductor may be decreased the background smear.

As above described, although the filter having a smaller pore size may remove the coarse particles significantly or certainly, an offset may arise that the desired pigment particles themselves come to be filtered.

In such a case, the synthesis technology of titanyl phthalocyanine having smaller primary particles should be taken into account, the combination of the filtering and the synthesis technology may solve the offset, thereby a significant effect may be obtained.

That is, (i) synthesizing and utilizing the fine titanyl phthalocyanine particles makes possible to shorten the dispersing period and to decrease the stress in dispersing, thereby the crystal transformation may be reduced in the step of dispersing; (ii) the size of coarse particles remaining after dispersion is smaller than that of without fine division, a filter having smaller pore size may be utilized, thereby coarse particles are removed more surely. Further, the removed amount of titanyl phthalocyanine particles comes to lower, thereby the dispersion hardly changes its composition from before to after filtering, thereby the production comes to more stable. Consequently, (iii) the resulting photoconductor can stably resist to the background smear.

The crosslinked charge transporting layer will be explained in the following, which is one constituent of the inventive photoconductor.

The crosslinked charge transporting layer is provided in order to reduce the effect of abrasion induced by repeated usages of the photoconductor, to improve the stability against background smear that increases with the raise of electric field strength, and to compensate the stability and durability by enhancing the electrostatic stability and image quality stability.

Flaws on the photoconductor surface and foreign matter deposited on the surface, e.g. toner, additive of toner, carrier, paper powder and the like, decrease the cleaning ability of the photoconductor, and deteriorate significantly the image quality. Accordingly, the effects of flaws or filming on the photoconductor surface should be minimized, for the purpose of the present invention, the surface layer with high elasticity and high smoothness is desirable.

The crosslinked charge transporting layer, which constitute the surface of the inventive photoconductor, has an outstanding three-dimensional structure since radical polymerizable monomers having three functionalities or more are crosslinked, is a surface layer having a considerably high hardness and a high elastic coefficient, and is uniform, highly smooth, highly wear resistant, and flaw resistant.

As such, it is important to increase the crosslinked density of photoconductor, i.e. the number of crosslinked bond; on the other hand, an internal stress may be generated since a number of bonds are formed by the instantaneous crosslinking reaction. The internal stress increases as the thickness of the crosslinked charge transporting layer comes to thicker, therefore, cracks and/or peelings tend to occur when the charge transporting layer is entirely hardened.

The cracks and/or peelings may occur with time under the effect of temperature alternations and hazards such as charging, developing, transferring, and cleaning, even if initially the cracks and/or peelings do not appear.

In order to solve the problem, softening ways of the cured resin layer may be effective such as (i) introduction of polymer constituents into the crosslinked layer and the crosslinked structure, (ii) employment of mono- or di-functional radical polymerizable monomer in relatively large amount, and (iii) employment of a polyfunctional monomer having at least a flexible group. However, these ways unexceptionally lead to lower crosslinked density of the crosslinked layer, and remarkable improvement in the wear resistance cannot be attained.

On the contrary, in the photoconductor according to the present invention, the crosslinked charge transporting layer has an outstanding three dimensional network construction, and the crosslinked charge transporting layer of 1 μm or more and 10 μm or less is provided on a charge transporting layer. As a result, the photoconductor in accordance with the present invention may have remarkably high wear resistance without occurrences of cracks and/or peelings.

Then thickness of the crosslinked charge transporting layer is 2 μm or more and 8 μm or less, the aforesaid problems may be solved more easily, and the materials can be selected more widely in order to crosslink in higher density for further improving the wear resistance.

The reason that the cracks and peelings may be prevented in the inventive photoconductor is considered that the internal stress does not grow significantly since the layer of the crosslinked charge transporting layer is thin in the thickness, the internal stress of the crosslinked charge transporting layer as the surface layer may be relaxed due to is the presence of underlying charge transporting layer.

Therefore, the polymer material is not required to incorporate in a large amount into the crosslinked charge transporting layer, and the flaws and toner filming are less likely to occur, which are caused due to the incompatibility with the cured product formed from the reaction between the polymer material and the radical polymerizable composition such as a radical polymerizable monomer and a radical polymerizable compound having a charge transporting structure.

In addition, when the entire layer of the crosslinked charge transporting layer is cured by irradiating optical energy, the curing reaction may be insufficient, since the transmittance is limited due to the absorption of optical energy by the property of the charge transporting layer. In accordance with the present invention, the thickness of the charge transporting layer is as thin as 10 μm or less, the curing reaction progresses inside the layer uniformly, and the higher abrasion resistance may be maintained inside the layer as the surface.

Further, in the formation of the crosslinked charge transporting layer according to the present invention, in addition to the tri-functional radical polymerizable compound, a mono-functional radical polymerizable compound is employed, which is incorporated into the crosslinked structure during the curing of radical polymerizable monomer of tri-function or more.

On the contrary, when a charge transporting substance of lower molecular weight without a functional group is incorporated into the crosslinked surface layer, the deposition and/or whiting of charge transporting substance of lower molecular weight may be induced, and the mechanical strength of the crosslinked surface layer comes to lower.

On the other hand, when the charge transporting material having two or more functionality is employed as the main component, the distortion in the cured resin structure comes to remarkably large since the bulk density of the charge transporting structure is considerably low, although the crosslinked density turns into higher since the component is fixed in the structure at the plural bonds; consequently, the internal stress in the crosslinked charge transporting layer comes to higher.

Further, the photoconductor according to the present invention exhibits proper electric properties, therefore, shows superior repeatability; and higher durability and higher stability may be achieved.

These advantages are derived by that a radical polymerizable compound having mono-functional transporting structure is utilized as the constituent material of the crosslinked charge transporting layer, and the radical polymerizable compound is fixed as pendants between the crosslinked bonds.

When the charge transporting substance without a functional group is incorporated into the crosslinked surface layer, the deposition and/or whiting may be induced as described above, and decrease of sensitivity and deterioration of electric properties under repeated usages such as increase of residual potential are significant. When the charge transporting compound having two or more functionality is employed, the intermediate structure such as cation radical is not stable under charge transporting, therefore, the decrease of sensitivity and the increase of residual potential are likely to occur. The deterioration of the electric properties results in the images such as decrease of image density and the thinned letters.

In addition, the photoconductor according to the present invention may be designed as the underlying charge transporting layer with higher mobility having less charge traps as the prior photoconductor, thereby the electrical adverse effect of the crosslinked charge transporting layer may be minimized.

In the formation of the crosslinked charge transporting layer according to the present invention, the wear resistance may be remarkably enhanced by making insoluble the crosslinked charge transporting layer against organic solvents.

The crosslinked charge transporting layer is formed by curing a radical polymerizable monomer of three or more functionality no charge transporting structure and radical polymerizable compound of mono-functionality having a charge transporting structure, and exhibits an outstanding three dimensional network structure as the entire layer. By the way, the crosslinked charge transporting layer may have lower crosslinked density at local sites, or formed as an aggregate of fine hardened products with high density of crosslinking due to additives of other components such as mono- or di-functional monomer, polymer binder, antioxidant, leveling agent, and plasticizer, incorporation of a dissolved component from underlying layer, and curing conditions.

Such a crosslinked charge transporting layer exhibits lower bonding strength between the fine hardened products, a solubility against organic solvents, and is likely to occur the local abrasion and/or delamination of fine hardened products during the repeated usages in the electrophotographic process.

Through making the crosslinked charge transporting layer insoluble against organic solvents, the crosslinked charge transporting layer bears the inherent outstanding three dimensional network structure, possesses higher crosslinked level, and the hardened product may be polymerized with chain reactions in a wide ranges, thereby the abrasion resistance is remarkably improved.

Next, the component materials of the coating solution of the outermost surface layer according to the present invention are described.

The tri- or more-functional radical polymerizable monomer without having charge transporting ability structure, i.e. having three or more functionalities and no charge transporting structure, which is used in the present invention refers to a monomer which does not contain a hole transporting structure, such as, for example, triarylamine, hydrazone, pyrazoline, carbazole and the like, and an electron transporting structure such as for example fused polycyclic quinone, diphenoquinone and an electron pulling aromatic ring having cyano group or nitro group, but has a three or more of radical polymerizable functional groups. The radical polymerizable functional group may be any one which has a carbon-carbon double bonds and is a radical polymerizable group.

Examples of the radical polymerizable functional group include a 1-substituted ethylene functional group and a 1,1-substituted ethylene functional groups.

(1) Examples of the 1-substituted ethylene functional group include a functional group represented by the following formula:

$$CH_2{=}CH{-}X_1{-}$$

wherein $X_1$ represents arylene group such as phenylene group, naphthylene group and the like, which may be substituted, alkynylene group which may be substituted, —CO— group, —COO— group, —CON($R_{10}$)— group ($R_{10}$ represents an alkyl group such as hydrogen, methyl group and ethyl group, aralkyl group such as benzyl group, naphthylmethyl group and phenethyl group, aryl group such as phenyl group and naphthyl group), or —S— group.

Concrete examples of these substituents include vinyl group, styryl group, 2-methyl-1,3-butadienyl group, vinylcarbonyl group, acryloyloxy group, acryloylamino group, vinylthioether group and the like.

(2) Examples of the 1,1-substituted ethylene functional group include a functional group represented by the following formula:

$$CH_2{=}CH\ (Y){-}X_2{-}$$

wherein Y represents an alkyl group which may be substituted, an aralkyl group which may be substituted, an aryl group such as phenyl group, naphthyl group which may be substituted, a halogen atom, a cyano group, a nitro group, an alkoxy group such as methoxy group or ethoxy group, —$COOR_{11}$ group ($R_{11}$ represents a hydrogen atom, an alkyl group such as methyl group, ethyl group and the like which may be substituted, an aralkyl group such as benzyl and phenethyl group which may be substituted, an aryl group such as phenyl group and naphthyl group which may be substituted), or —$CONR_{12}R_{13}$ ($R_{12}$ and $R_{13}$ represent a hydrogen atom, an alkyl group such as methyl group, ethyl group and the like which may be substituted, an aralkyl group such as benzyl group, naphthylmethyl group or phenethyl group which may be substituted, or an aryl group such as phenyl group and naphthyl group which may be substituted and may be identical or different), $X_2$ represents a substituent as defined for $X_1$ of the formula 10 and a single bond, an alkylene group, provided that at least any one of Y and $X_2$ is an oxycarbonyl group, a cyano group, alkenylene group, and an aromatic ring).

Concrete examples of these substituents include alpha-chloro acryloyloxy group, methacryloyloxy group, alpha-cyanoethylene group, alpha-cyanoacryloyloxy group, alpha-cyanophenylene group, methacryloylamino group and the like.

Examples of the substituent which is additionally substituted to the subsituents of $X_1$, $X_2$ and Y include a halogen atom, a nitro group, a cyano group, an alkyl group such as methyl group, ethyl group and the like, an alkoxy group such as methoxy group, ethoxy group and the like, an aryloxy group such as phenoxy group and the like, an aryl group such as phenyl group, naphthyl group and the like, and an aralkyl group such as benzyl group, phenethyl group and the like.

Among these radical polymerizable functional groups, acryloyloxy group and methacryloyloxy group are particularly useful and compounds having 3 or more of acryloyloxy groups may be prepared, for example, by esterification or transesterification of a compound having 3 or more hydroxy groups in the molecule with acrylic acid (salt), acrylic acid halide, acrylic acid ester. Also, a compound having 3 or more methacryloyloxy groups may be similarly prepared. The radical polymerizable functional groups in a monomer having 3 or more radical polymerizable functional groups may be identical or different.

Concrete examples of the tri- or more-functional radical polymerizable monomer without having a charge transporting structure are illustrated below but are not limited thereto.

That is, the radical polymerizable monomer which can be used in the present invention includes trimethylolpropanetriacrylate (TMPTA), trimethylolpropanetrimethacrylate, HPA-modified trimethylolpropanetriacrylate, EO-modified trimethylolpropane triacrylate, PO-modified trimethylolpropane triacrylate, caprolactone-modified trimethylolpropane triacrylate, HPA-modified trimethylolprop ane trimethacrylate, pentaerythritol triacrylate, pentaerythritol tetraacrylate (PETTA), glycerol triacrylate, ECH-modified glycerol triacrylate, EO-modified glycerol triacrylate, PO-modified glycerol triacrylate, tris(acryloxyethyl)isocyanurate, dipentaerythritol hexacrylate (DPHA), caprolactone-modified dipentaerythritol hexacrylate, dipentaerythritolhydroxy pentaacrylate, alkyl-modified dipentaerythritol pentaacrylate, alkyl-modified dipentaerythritol tetraacrylate, alkyl-modified dipentaerythritol triacrylate, dimethylolpropane tetraacrylate (DTMPTA), pentaerythritolethoxy tetraacrylate, EO-modified phosphonic acid triacrylate, 2,2,5,5,-tetrahydroxymethylcyclopentanone tetraacrylate and the like, which may be used alone or in combination of two or more thereof.

Also, the tri- or more-functional radical polymerizable monomer without having a charge transporting structure which can be used in the present invention a ratio (molecular weight/number of functional group) of molecular weight to the number of functional group in the monomer is preferably 250 or less to form a dense cross-linkage in the crosslinked surface layer. If the ratio is greater than 250, the crosslinked surface layer becomes soft, which may cause somewhat reduction in abrasion resistance. Therefore, in case of using a monomer having a modifying group such as HPA, EO and PO, it is not preferable to use a monomer having an excessively long modifying group alone. The compositional ratio of the tri- or more-functional radical polymerizable monomer without having a charge transporting structure used in the surface layer is 20% to 80% by mass, preferably 30% to 70% by mass relative to the total amount of the crosslinked surface layer and substantially depends on a ratio of the tri- or more-radical polymerizable monomer in the solid content of the coating solution. If the monomer component is less than 20% by mass, 3-dimensional cross-linkage density of the crosslinked surface layer is reduced and thus it cannot accomplish a significant improvement in abrasion resistance as compared to the conventional thermoplastic binder resins. Also, if it exceeds 80% by mass, the content of the charge transport compound is reduced, causing deterioration in electrical properties. Though it is impossible to define a generally preferable range since the required abrasion resistance or electrical properties vary according to a used process, the content is most preferably is in the range of 30% to 70% by mass, considering the balance between both properties.

The mono-functional radical polymerizable compound having a charge transporting structure, i.e. having one functionality and a charge transporting structure, which is available in the present invention refers to a compound which contains a hole transporting structure, such as, for example, triarylamine, hydrazone, pyrazoline, carbazole and the like, and an electron transporting structure such as for example fused polycyclic quinone, diphenoquinone and an electron pulling aromatic ring having cyano group or nitro group, and has one radical polymerizable functional groups. The radical polymerizable functional group includes functional groups represented by the formulas above. More concretely, it can be those as defined for the radical polymerizable monomer, particularly acryloyloxy group, methacyloyloxy group. Also, as the charge transporting structure a triarylamine structure is highly effective, and particularly, a compound represented by the following General Formula (1) or (2) may be used to maintain good electrical properties such as sensitivity and residual potential.

General Formula (1)

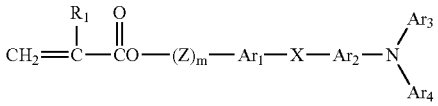

General Formula (2)

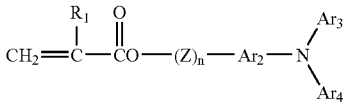

wherein $R_1$ represents a hydrogen atom, a halogen atom, an alkyl group which may be substituted, an aralkyl group which may be substituted, an aryl group which may be substituted, a cyano group, a nitro group, an alkoxy group, —$COOR_7$ ($R_7$ represents a hydrogen atom, an alkyl group which may be substituted, an aralkyl group which may be substituted or an aryl group which may be substituted), a halogenated carbonyl group or $CONR_8R_9$ ($R_8$ and $R_9$ represent a hydrogen atom, a halogen atom, an alkyl group which may be substituted, an aralkyl group which may be substituted or an aryl group which may be substituted, which may be identical or different), $Ar_1$ and $Ar_2$ represent a substituted or usubstituted arylene group, which may be identical or different, $Ar_3$ and $Ar_4$ represent a substituted or usubstituted aryl group, which may be identical or different, X represents a single bond, a substituted or usubstituted alkylene group, a substituted or usubstituted cycloalkylene group, a substituted or usubstituted alkylene ether group, a oxygen atom, a sulfur atom or a vinylene group; Z represents a substituted or usubstituted alkylene group, a substituted or usubstituted alkylene ether group or an alkyleneoxycarbonyl group, and m and n represent an integer of 0 to 3.

Concrete examples of the General Formulas (1) and (2) are as follows. In the General Formulas (1) and (2), the alkyl group as a substituent of $R_1$ includes, for example, methyl group, ethyl group, propyl group, butyl group and the like, the aryl group includes phenyl group, naphthyl group and the like, the aralkyl group includes benzyl group, phenethyl group, naphthylmethyl group and the like, the alkoxy group includes methoxy group, ethoxy group, propoxy group the like, which may be substituted by a halogen atom, a nitro group, a cyano group, an alkyl group such as methyl group, ethyl group and the like, an alkoxy group such as methoxy group, ethoxy group and the like, an aryloxy group such as phenoxy group and the like, an aryl group such as phenyl group, naphthyl group and the like, an aralkyl group such as benzyl group, phenethyl group and the like.

Particularly preferred examples of the substituents of $R_1$ are a hydrogen atom and methyl group.

The substituted or usubstituted $Ar_3$ and $Ar_4$ are an aryl group and the examples of the aryl group include fused polycyclic hydrocarbon groups non-fused cyclic hydrocarbon groups and polycyclic groups.

The fused polycyclic hydrocarbon group is preferably one having 18 or less carbon atoms to form a ring, including, for example, pentanyl group, indenyl group, naphthyl group, azulenyl group, heptaprenyl group, biphenylenyl group, a s-indacenyl group, s-indacenyl group, fluorenyl group, acenaphthylenyl group, pleiadene adenyl group, acenaphthenyl group, phenalenyl group, phenathryl group, antholyl group, fluorandenyl group, acephenanthrylenyl group, aceanthrylenyl group, triphenylenyl group, pyrenyl group, chrysene, and naphthacenyl group.

The non-fused hydrocarbon group includes an univalent group of a monocyclic hydrocarbon compound such as benzene, diphenyl ether, polyethylenediphenyl ether, diphenylthioether and diphenylsulphone, an univalent group of a non-fused polycyclic hydrocarbon compound, such as biphenyl, polyphenyl, diphenylalkane, diphenylalkene, diphenylalkyne, triphenylmethane, distyrylbenzene, 1,1-diphenylcycloalkane, polyphenylalkane and polyphenylalkene, or an univalent group of a cyclic hydrocarbon compound such as 9,9-diphenylfluorene.

The polycylic group includes a univalent group of carbazole, dibenzofuran, dibenzothiphene, oxadiazole, and thiadiazole.

Also, the aryl group represented by $Ar_3$ and $Ar_4$ may be substituted by a substituent, for example, as follows.

(1) a halogen atom, a cyano group, a nitro group and the like.

(2) an alkyl group, preferably a $C_1$ to $C_{12}$, particularly a $C_1$ to $C_8$, more preferably a $C_1$ to $C_4$ straight-chained or branched alkyl group, wherein the alkyl group may be further substituted by a fluorine atom, a hydroxy group, a cyano group, a $C_1$ to $C_4$ alkoxy group, phenyl group, or a phenyl group substituted by a halogen atom, a $C_1$ to $C_4$ alkyl group or a $C_1$ to $C_4$ alkoxy group. Concretely, it includes methyl group, ethyl group, n-butyl group, i-propyl group, t-butyl group, s-butyl group, n-propyl group, tri-fluoromethyl group, 2-hydroxyethyl group, 2-ethoxyethyl group, 2-cyanoethyl group, 2-methoxyethyl group, benzyl group, 4-chlorobenzyl group, 4-methylbenzyl group, 4-phenylbenzyl group and the like.

(3) an alkoxy group (—$OR_2$), wherein $R_2$ represents an alkyl group as defined in (2). Concretely, it includes methoxy group, ethoxy group, n-propoxy group, i-propoxy group, t-butoxy group, n-butoxy group, s-butoxy group, i-butoxy group, 2-hydroxyethoxy group, benzyloxy group, tri-fluoromethoxy group and the like.

(4) an aryloxy group, wherein the aryl group may be phenyl group and naphthyl group, which may be substituted by a $C_1$ to $C_4$ alkoxy group, a $C_1$ to $C_4$ alkyl group or a halogen atom. Concretely, it includes phenoxy group, 1-naphthyloxy group, 2-naphthyloxy group, 4-methoxyphenoxy group, 4-methylphenoxy group and the like.

(5) an alkylmercapto group or arylmercapto group. Concretely, it includes methylthio group, ethylthio group, phenylthio group, p-methylphenylthio group and the like.

(6)

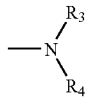

wherein $R_3$ and $R_4$ represent each independently a hydrogen atom, an alkyl group as defined in (2), or aryl group. The aryl group includes, for example, phenyl group, biphenyl group or naphthyl group, which may be substituted by a $C_1$ to $C_4$ alkoxy group, a $C_1$ to $C_4$ alkyl group or a halogen atom, or $R_3$ and $R_4$ may form a ring together.

Concretely, it includes amino group, diethylamino group, N-methyl-N-phenylamino group, N,N-diphenylamino group, N, N-di(tryl)amino group, dibenzylamino group, piperidino group, morpholino group, pyrrolidono group and the like.

(7) an alkylenedioxy group or alkylenedithio group such as methylenedioxy group or methylenedithio group.

(8) a substituted or usubstituted styryl group, a substituted or usubstituted β-phenylstyryl group, a diphenylaminophenyl group, ditolylaminophenyl group and the like.

The arylene group represented by $Ar_1$ and $Ar_2$ includes a divalent group derived from an aryl group represented by $Ar_3$ and $Ar_4$.

X represents a single bond, a substituted or usubstituted alkylene group, a substituted or usubstituted cycloalkylene group, a substituted or usubstituted alkylene ether group, an oxygen atom, a sulfur atom, or vinylene group.

The substituted or usubstituted alkylene group is a $C_1$ to $C_{12}$, preferably $C_1$ to $C_8$, more preferably $C_1$ to $C_4$ straight chained or branched alkylene group, wherein the alkylene group may be further substituted by a fluorine, a hydroxy group, a cyano group, an $C_1$ to $C_4$ alkoxy group, a phenyl group, or a phenyl group substituted by a halogen atom, a $C_1$ to $C_4$ alkyl group or a $C_1$ to $C_4$ alkoxy group. Concretely, it includes methylene group, ethylene group, n-butylene group, i-propylene group, t-butylene group, s-butylene group, n-propylene group, trifluoromethylene group, 2-hydroxyethylene group, 2-ethoxyethylene group, 2-cyanoethylene group, 2-methoxyethylene group, benzylidene group, phenylethylene group, 4-chlorophenylethylene group, 4-methylphenylethylene group, 4-biphenylethylene group and the like.

The substituted or usubstituted cycloalkylene group is a $C_5$ to $C_7$ cyclic alkylene group, wherein the cyclic alkylene group may be substituted by a fluorine atom, a $C_1$ to $C_4$ alkyl group or a $C_1$ to $C_4$ alkoxy group. Concretely, it includes cyclohexylidene group, cyclohexylene group, 3,3-dimethylcyclohexylidene group and the like.

The substituted or usubstituted alkylene ether group represents ethyleneoxy, propyleneoxy, ethylene glycol, propyleneglycol, diethyleneglycol, tetraethylene glycol or tripropyleneglycol, wherein the alkylene group may be substituted by a hydroxyl group, methyl group, ethyl group and the like.

The vinylene group is represented by the following formula.

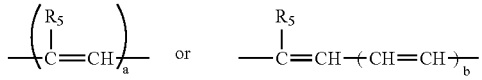

wherein $R_5$ represents hydrogen, an alkyl group (which is the same as defined in (2)) or an aryl group (which is the same with the aryl group represented by $Ar_3$ and $Ar_4$), "a" represents 1 or 2, and "b" represents 1 to 3.

Z represents a substituted or usubstituted alkylene group, a substituted or usubstituted alkylene ether group, or an alkyleneoxycarbonyl group.

The substituted or usubstituted alkylene group includes the alkylene groups as defined for X.

The substituted or usubstituted alkylene ether group includes the alkylene ether groups as defined for X.

The alkyleneoxycarbonyl group includes caprolactone-modified groups.

The mono-functional radical polymerizable compound i.e. having one functionality and a charge transporting structure is more preferably a compound having General Formula (3).

General Formula (3)

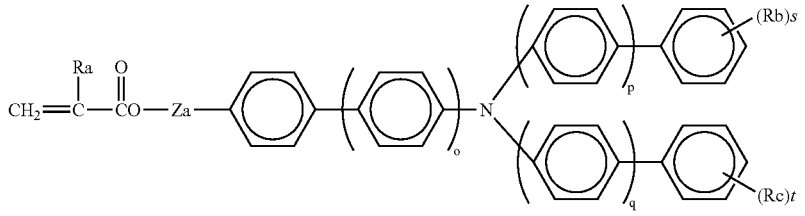

wherein "o," "p" and "q" each represent an integer of 0 or 1, Ra represents a hydrogen atom, a methyl group, Rb and Rc represent a substituent other than a hydrogen atom which is a $C_{1-6}$ alkyl group and may be different when they are two or more, "s" and "t" represent an integer of 0 to 3, and Za represents a single bond, a methylene group, an ethylene group, or a group expressed by the following formulas:

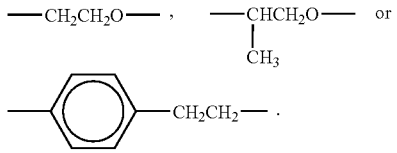

The compound represented by the above formula is preferably a compound wherein Rb and Rc are methyl group or ethyl group.

The radical polymerizable compound having a mono-functional charge transporting structure of the formulae (1) and (2), particularly the formula (3) radical polymerizable compound, which is used in the present invention cannot be a terminal structure, sine the polymerization is accomplished by opening of the carbon-carbon double bond at both sides, but is inserted interposed in a continuous polymer chain. In a polymer crosslinked by polymerization with tri- or more-functional radical polymerizable monomer, it exists in the main chain of the polymer and in the cross-linkage between a main chain and a main chain (the cross-linkage includes a intermolecular cross-linkage between one polymer and the other polymer and an intramolecular cross-linkage between one site where a folded main chain is present in a polymer and the other site which is derived from a monomer polymerized at a position remote from the one site in the main chain). However, even when it is present in the main chain or it is present in the cross-linkage, it has at least three aryl groups radially oriented from a nitrogen atom in the triarylamine structure suspended from the chain and, though being bulky, is not directly bonded to the chain but suspended from the chain, for example, by a carbonyl group, thereby it is versatilely fixed for three dimensional orientation. Therefore, since the triarylamine structures can be properly oriented spatially adjacent to each other in a polymer, they do not lead to large structural distortion in a molecule, and it can be expected that when applied in a surface layer of an electrophotographic photoconductor, it may provide an intramolecular structure relatively avoiding interruption of a charge transport passage.

Concrete examples of the mono-functional radical polymerizable compound having a charge transporting structure according to the present invention are illustrated below, but are not limited to compounds of these structures.

No. 1

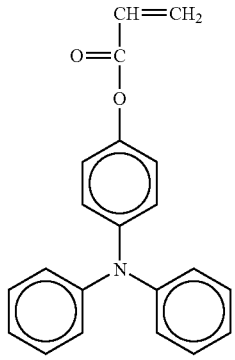

No. 2

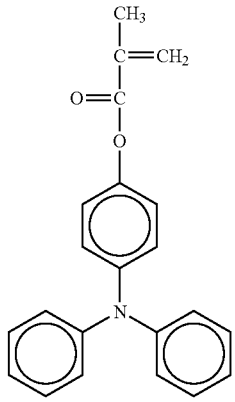

-continued
No. 3
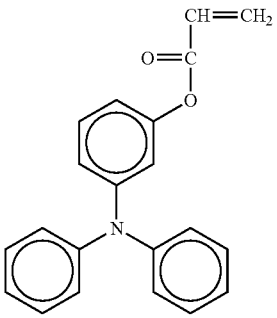
No. 4
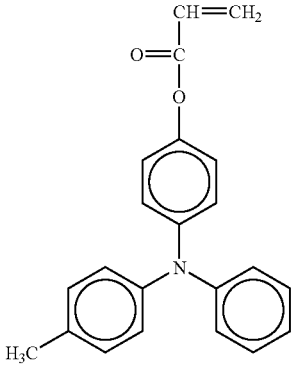
No. 5
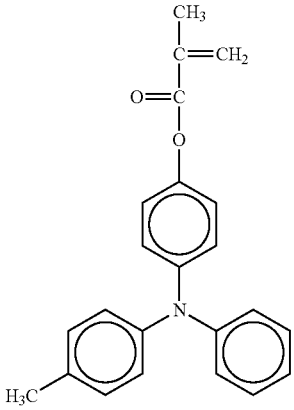
No. 6
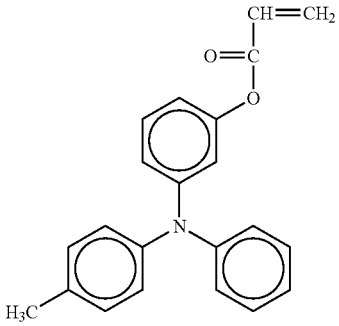
-continued
No. 7
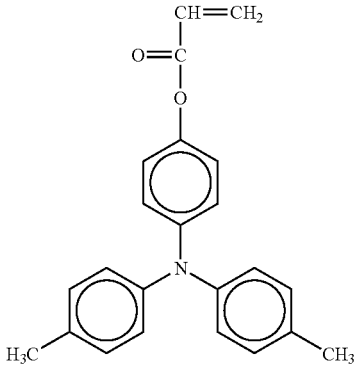
No. 8
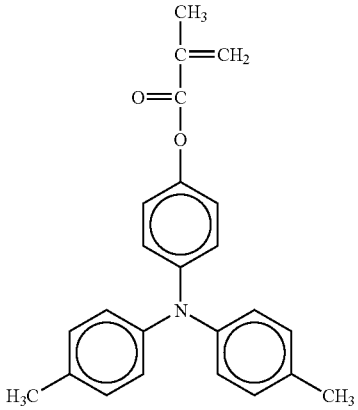
No. 9
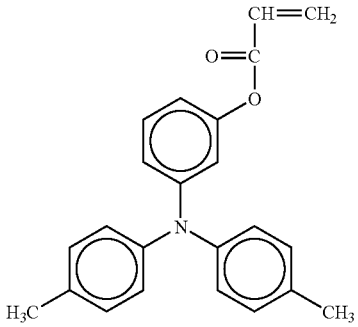
No. 10
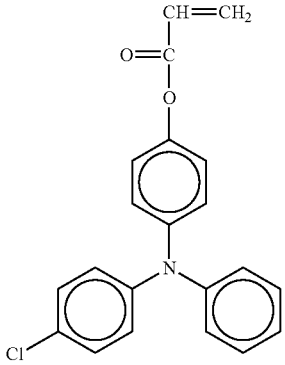

-continued
No. 11
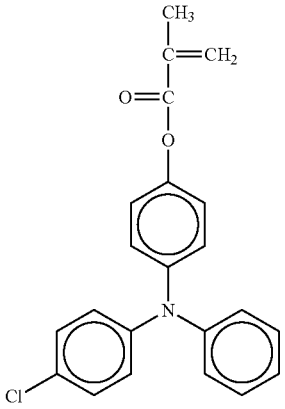
No. 12
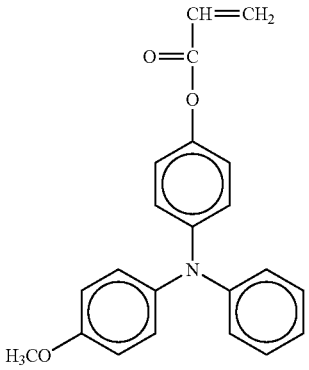
No. 13
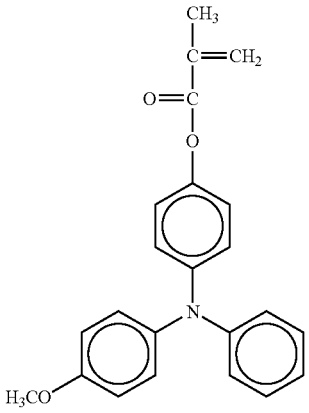
No. 14
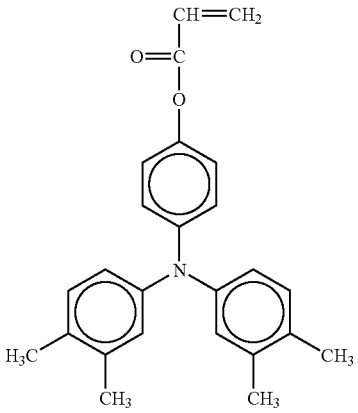
-continued
No. 15
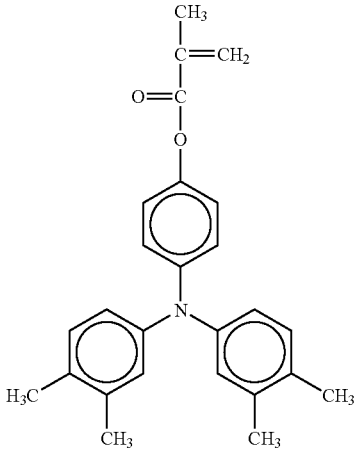
No. 16
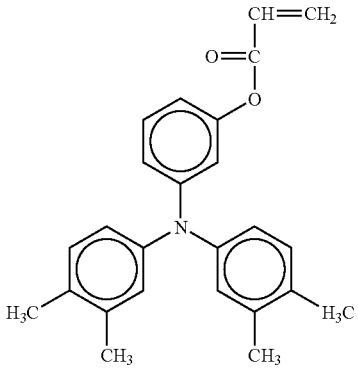
No. 17
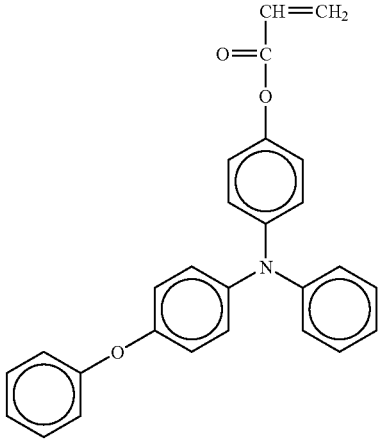

-continued
No. 18
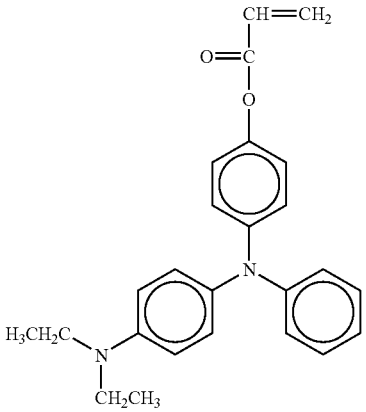
No. 19
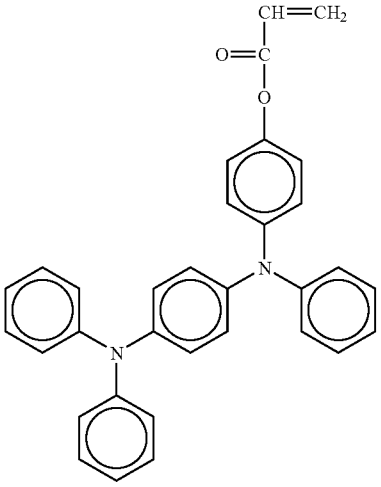
No. 20
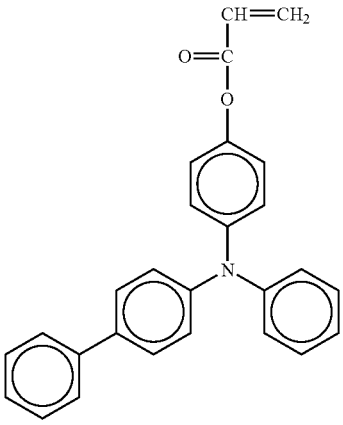
-continued
No. 21
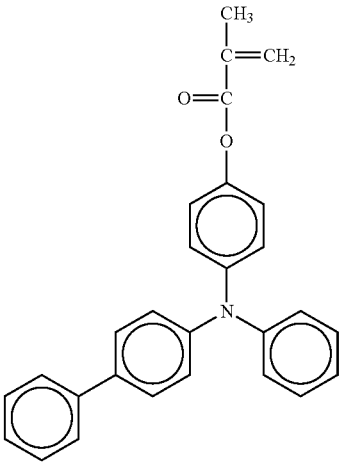
No. 22
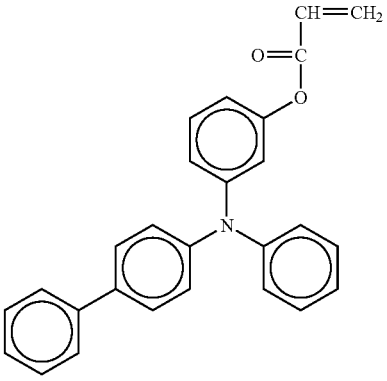
No. 23
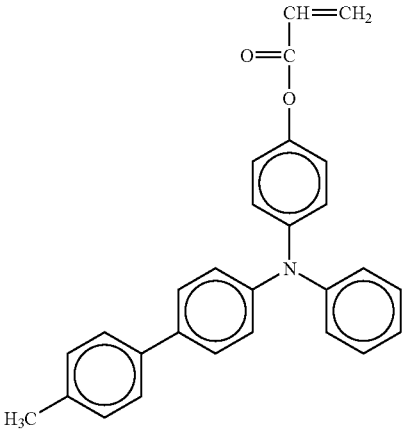

-continued
No. 24
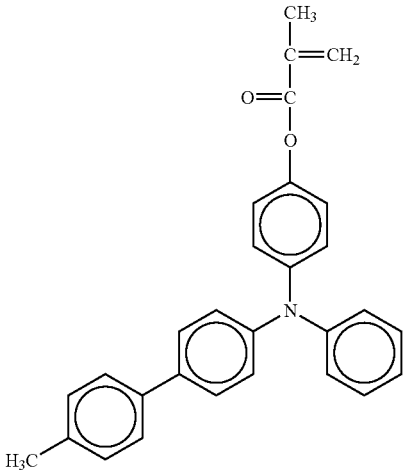
No. 25
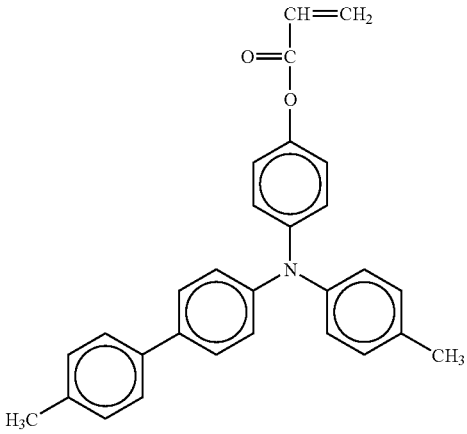
No. 26
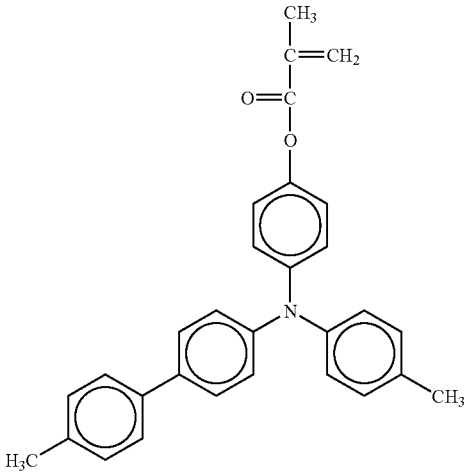
-continued
No. 27
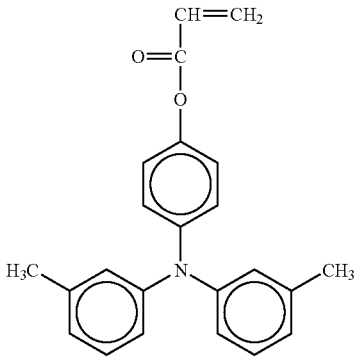
No. 28
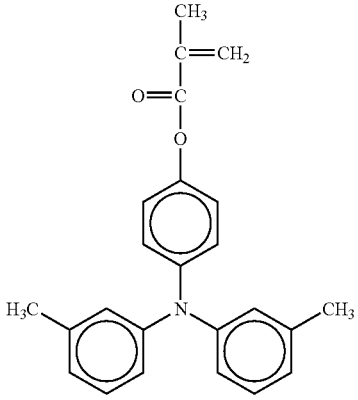
No. 29
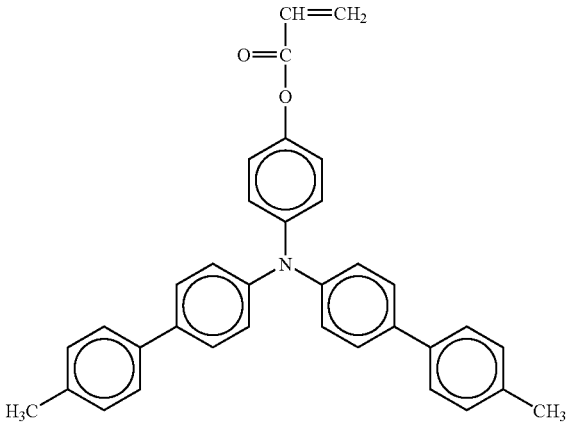
No. 30
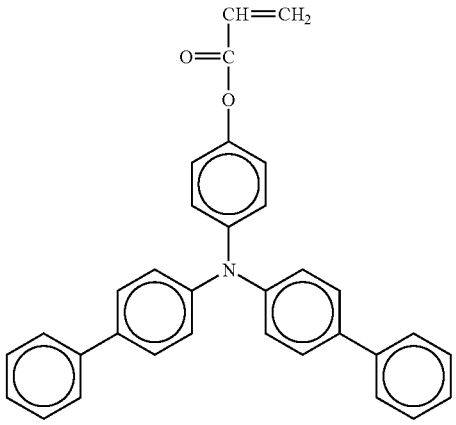

-continued
No. 31
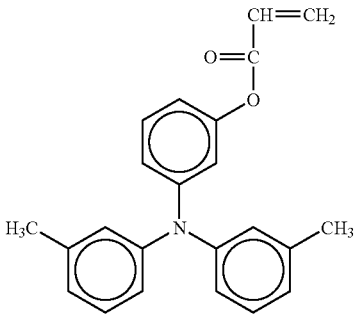
No. 32
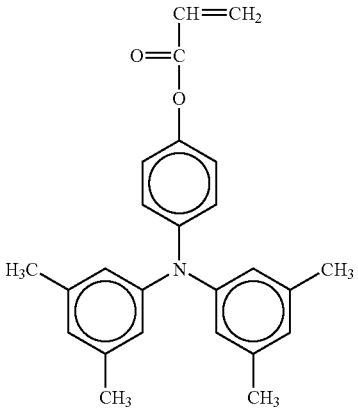
No. 33
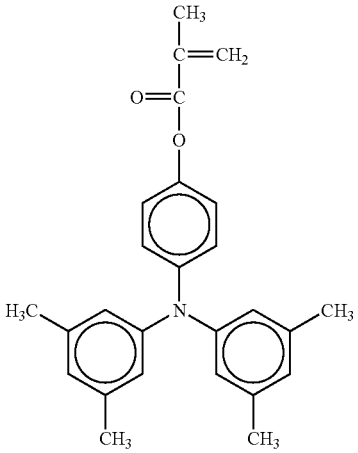
No. 34
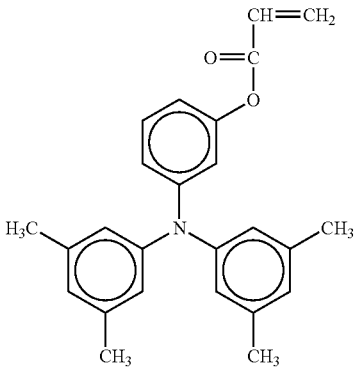
-continued
No. 35
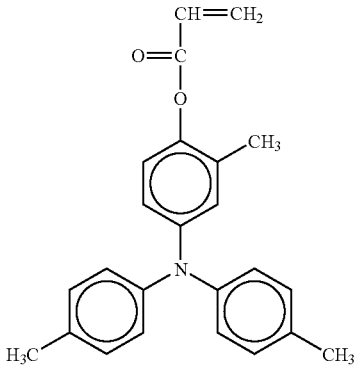
No. 36
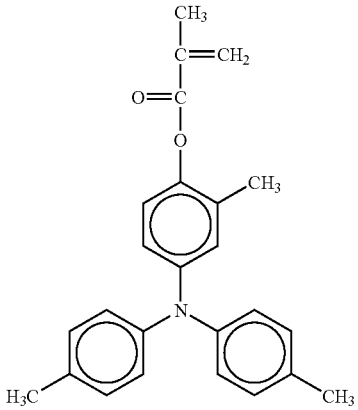
No. 37
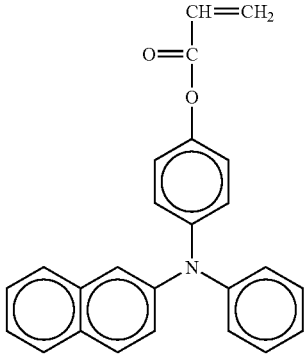
No. 38
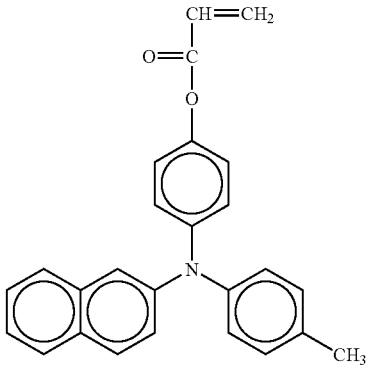

-continued
No. 39
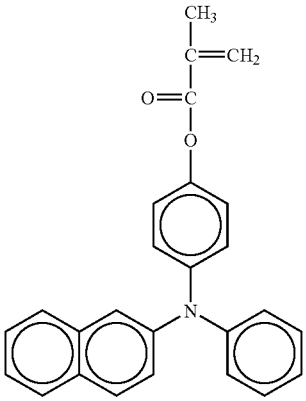
No. 40
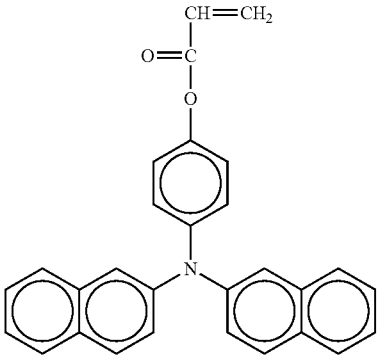
No. 41
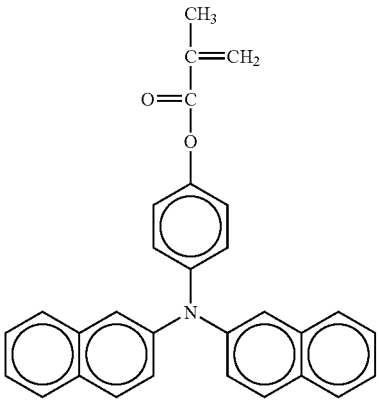
-continued
No. 42
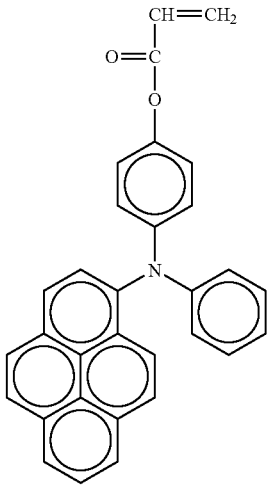
No. 43
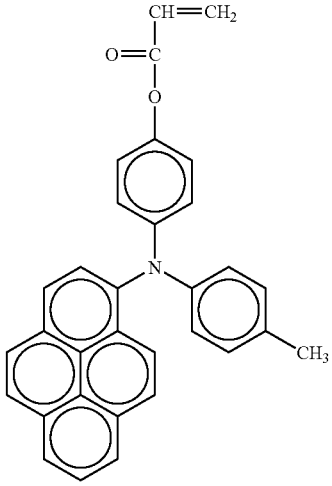
No. 44
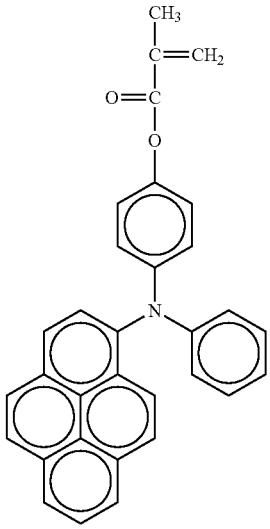

-continued
No. 45
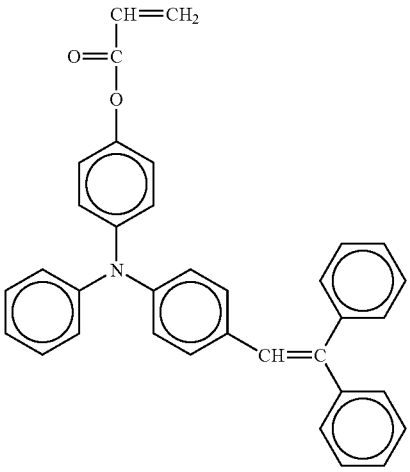
No. 46
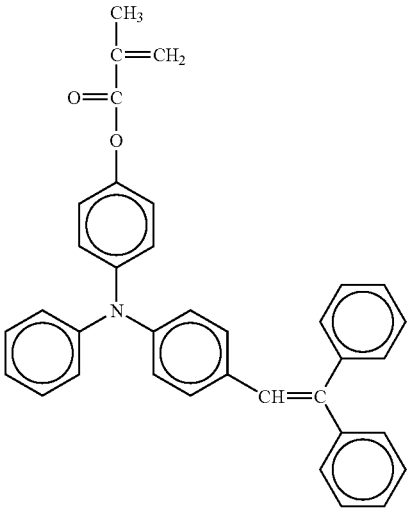
No. 47
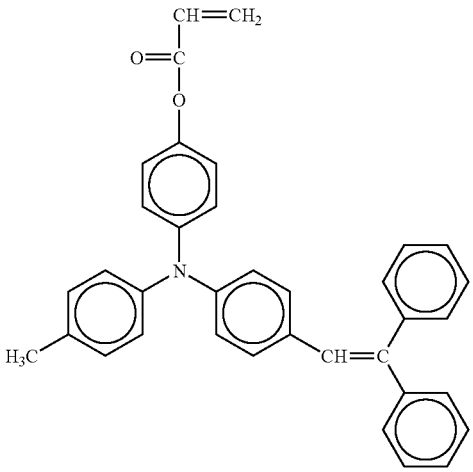
-continued
No. 48
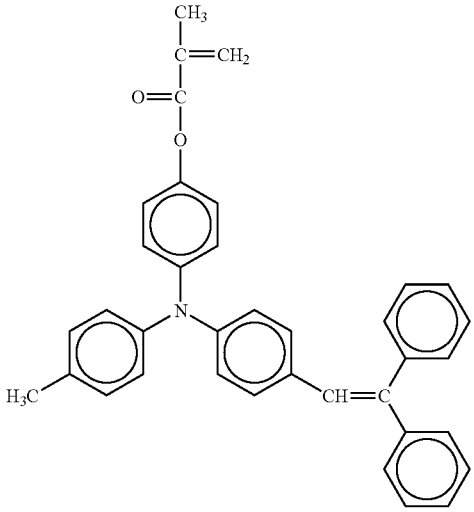
No. 49
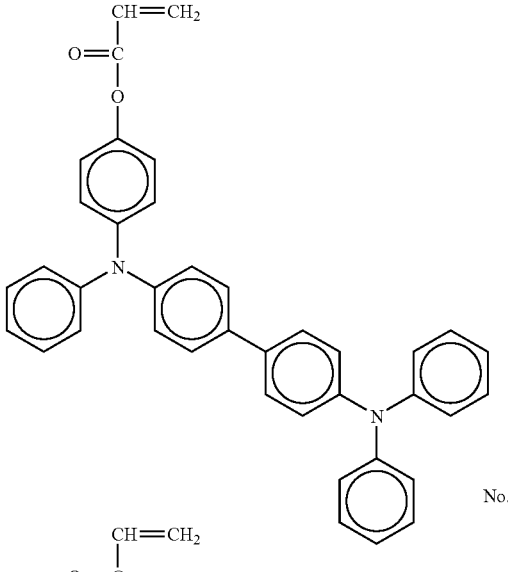
No. 50
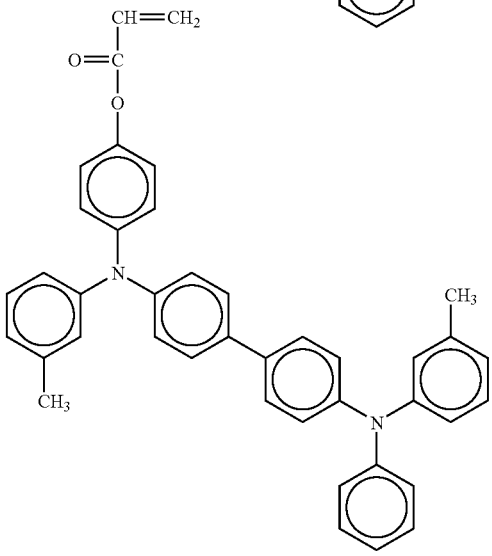

-continued
No. 51
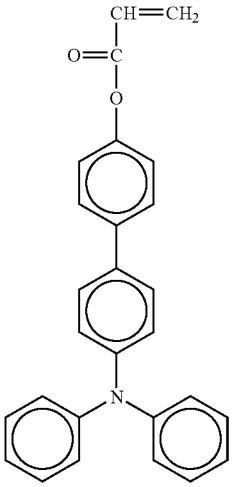
No. 52
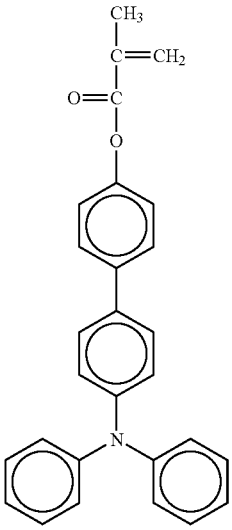
No. 53
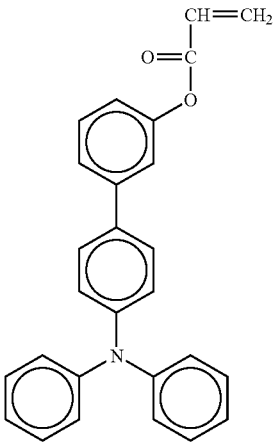
-continued
No. 54
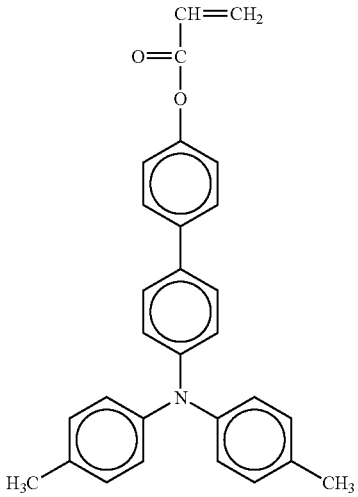
No. 55
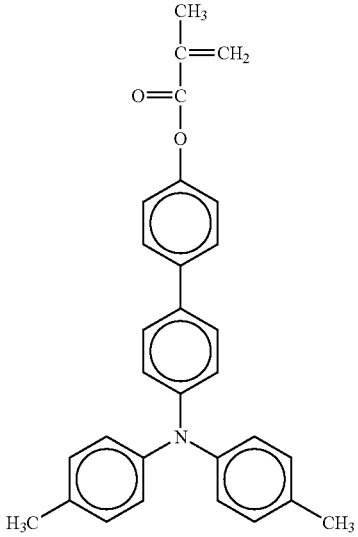
No. 56
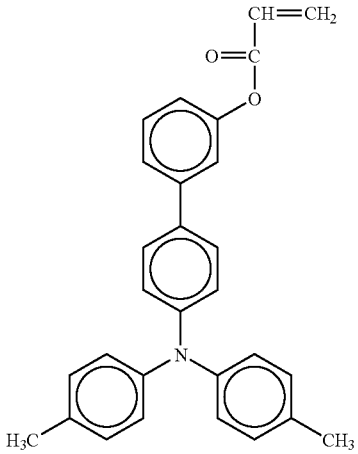

-continued
No. 57
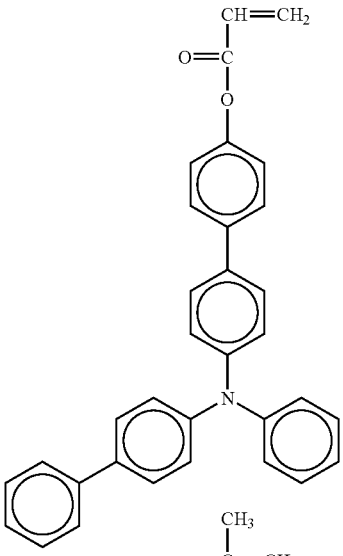
No. 58
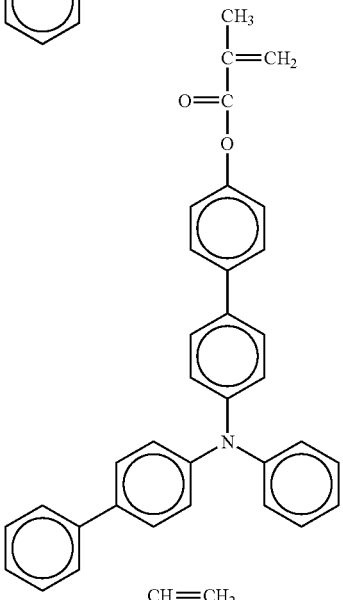
No. 59
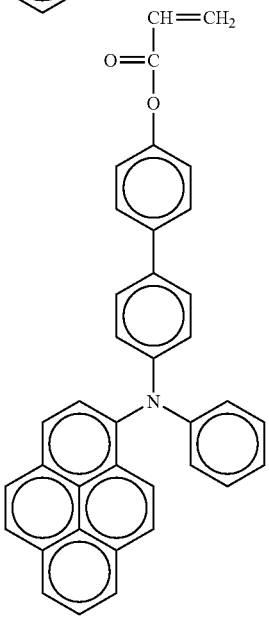
-continued
No. 60
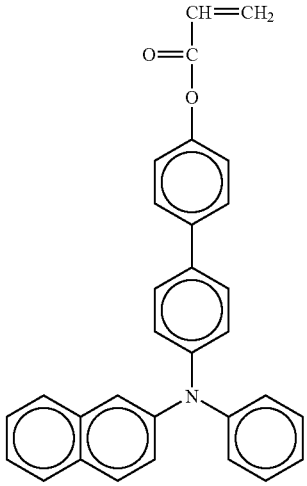
NO. 61
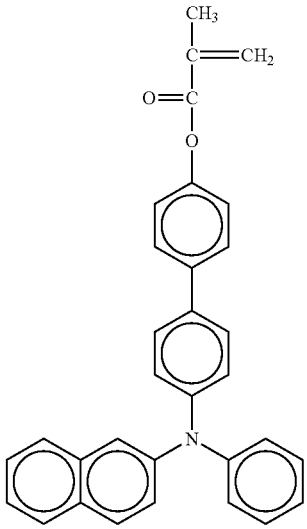
NO. 62
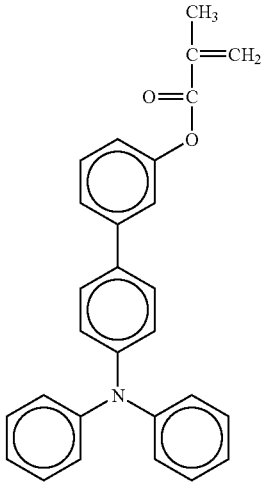

-continued
NO. 63
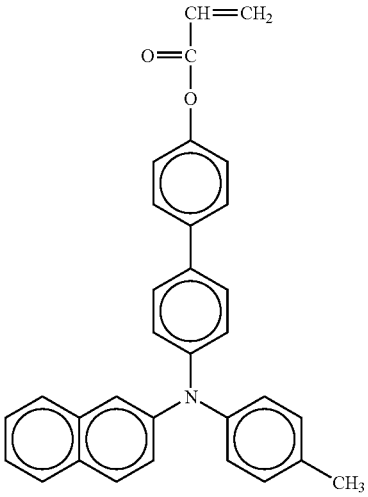
No. 64
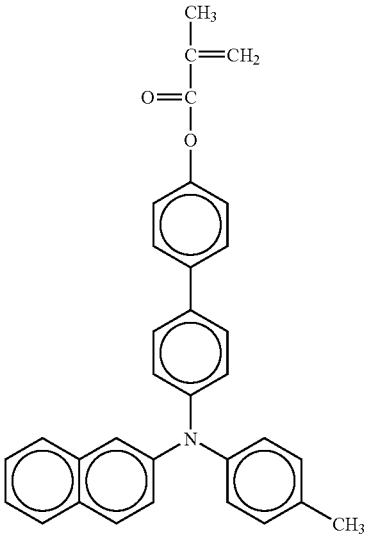
No. 65
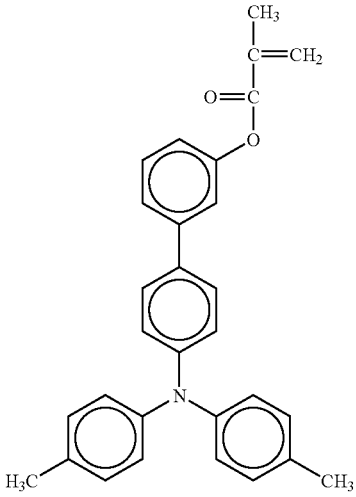
-continued
No. 66
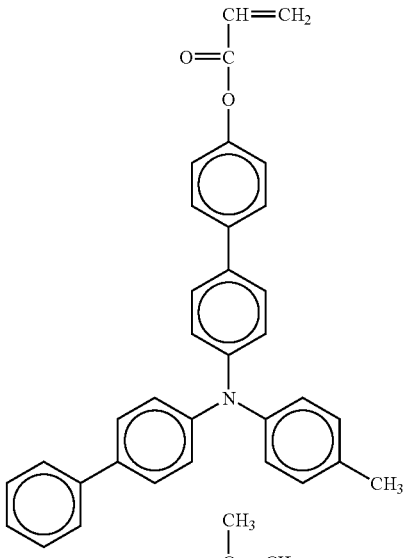
No. 67
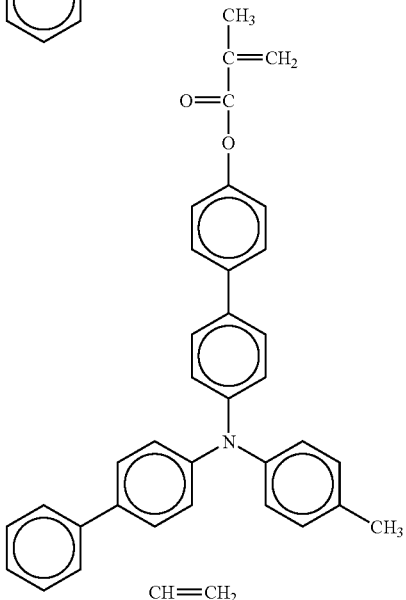
No. 68
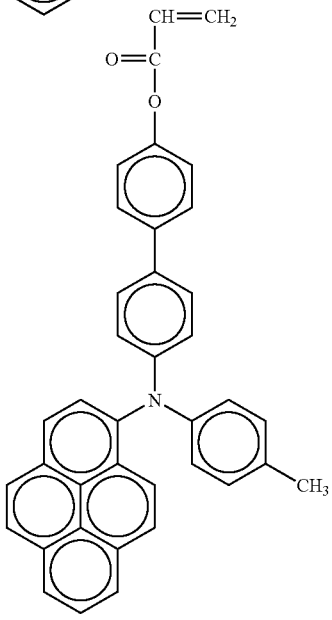

-continued
No. 69
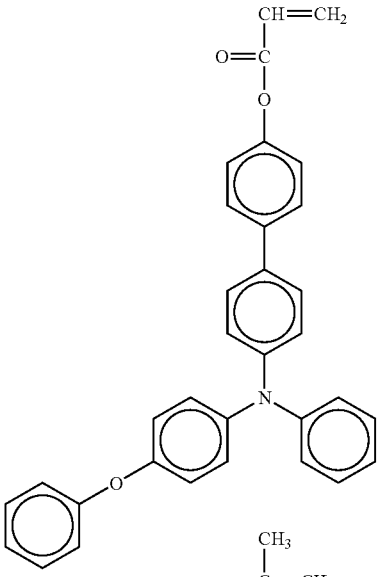
No. 70
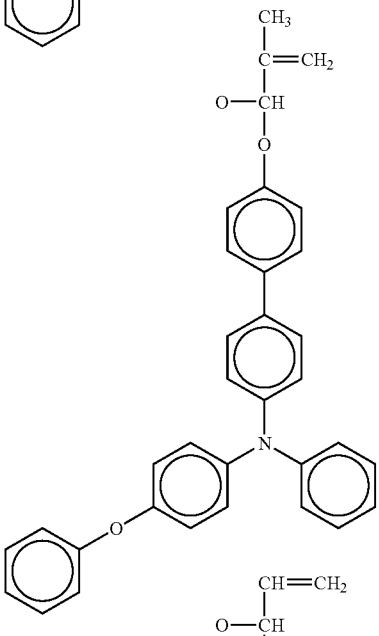
No. 71
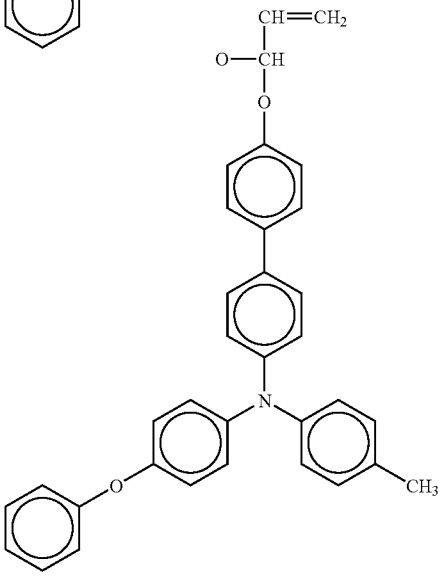
-continued
No. 72
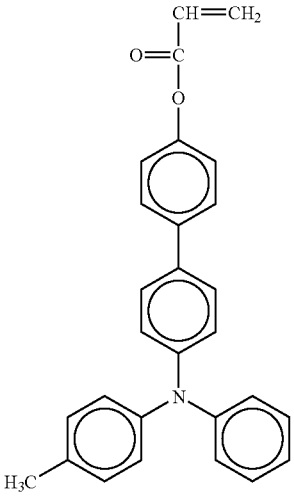
No. 73
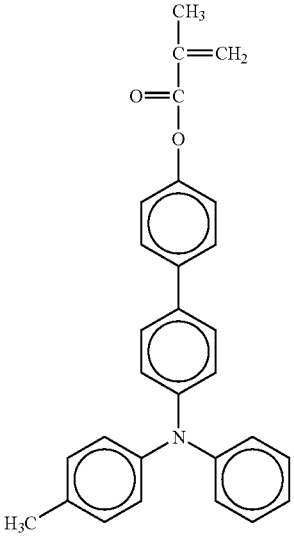
No. 74
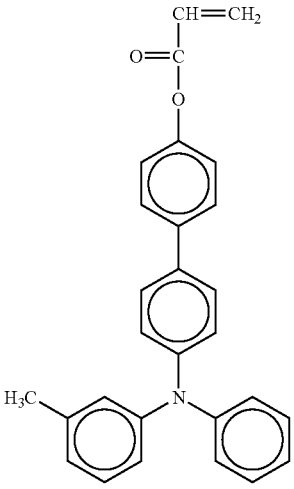

-continued
No. 75
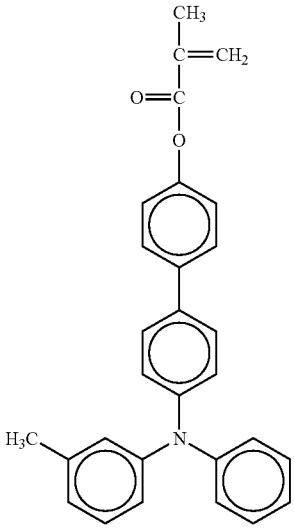
No. 76
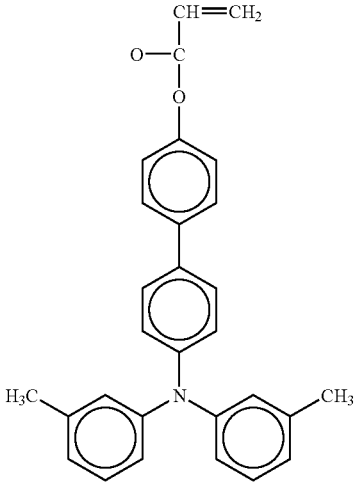
No. 77
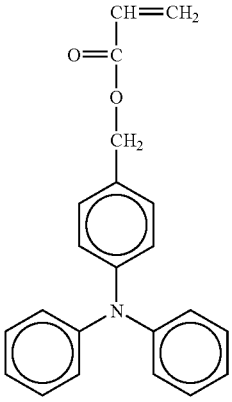
-continued
No. 78
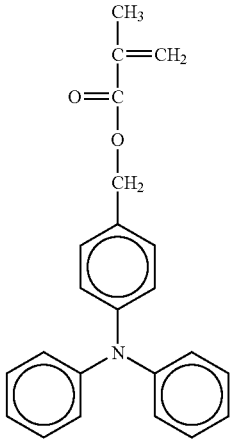
No. 79
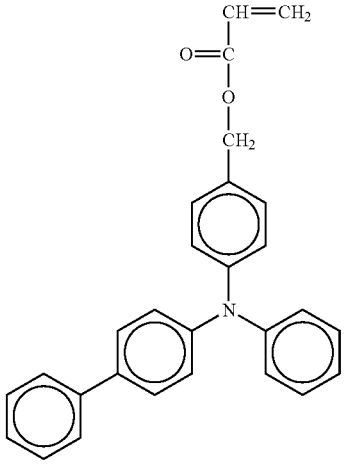
No. 80
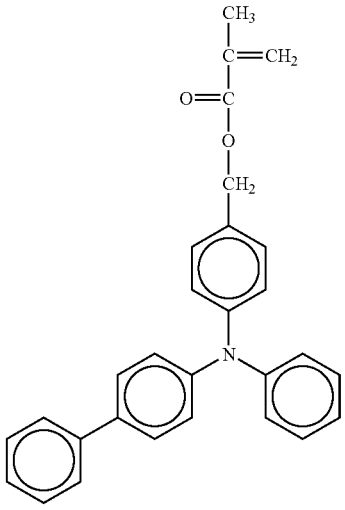

-continued
No. 81
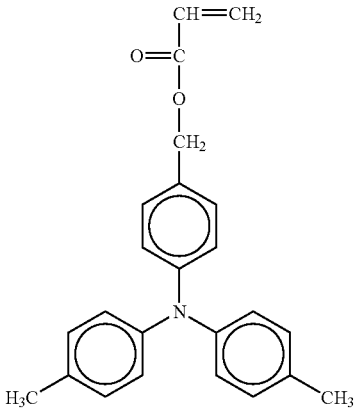
No. 82
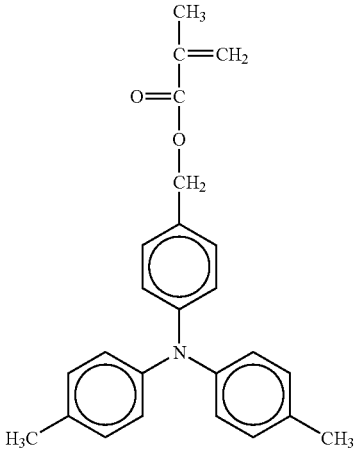
No. 83
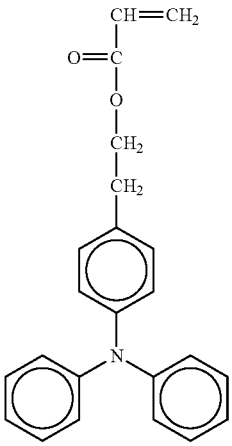
-continued
No. 84
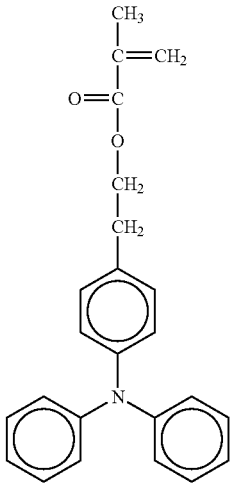
No. 85
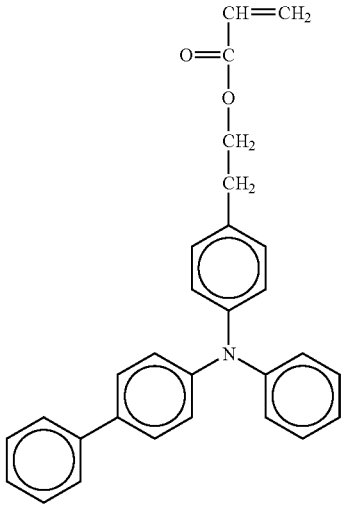
No. 86
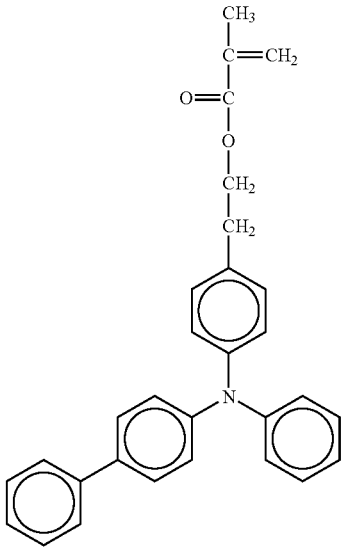

-continued
No. 87
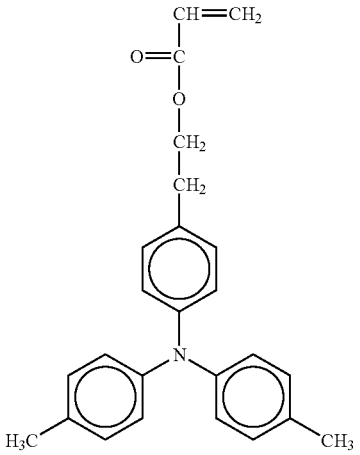
No. 88
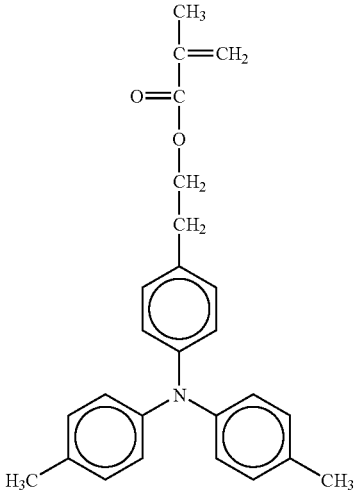
No. 89
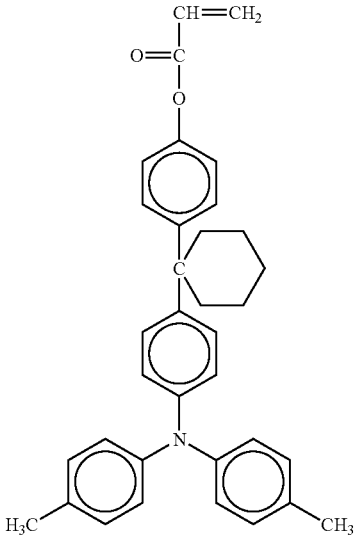
-continued
No. 90
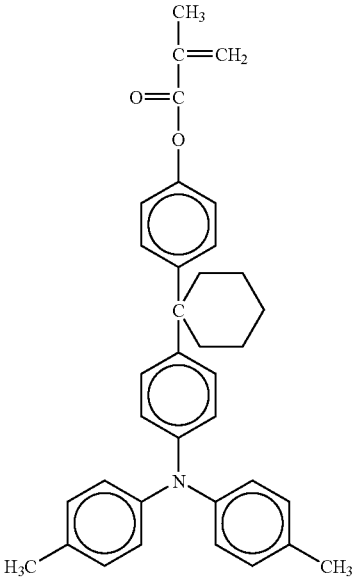
No. 91
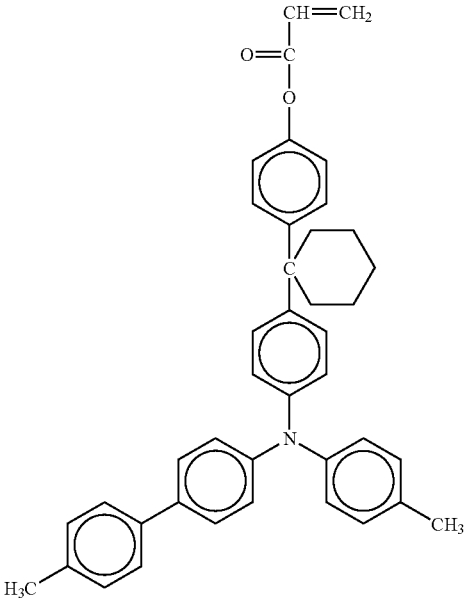

-continued
No. 92
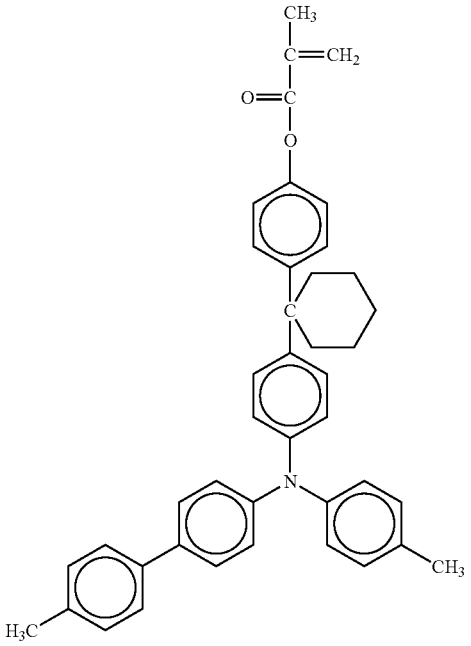
-continued
No. 94
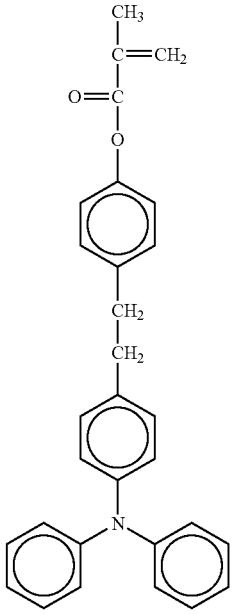
No. 93
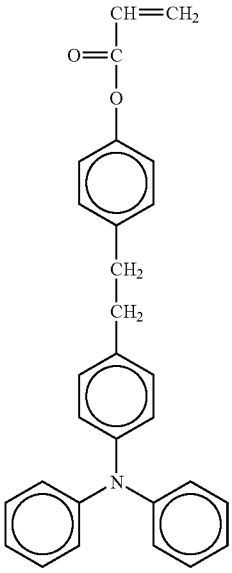
No. 95
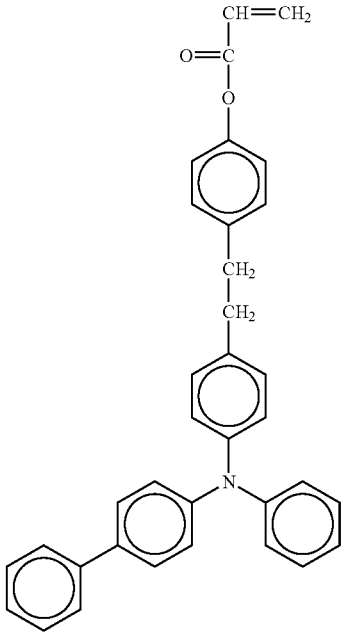

-continued
No. 96
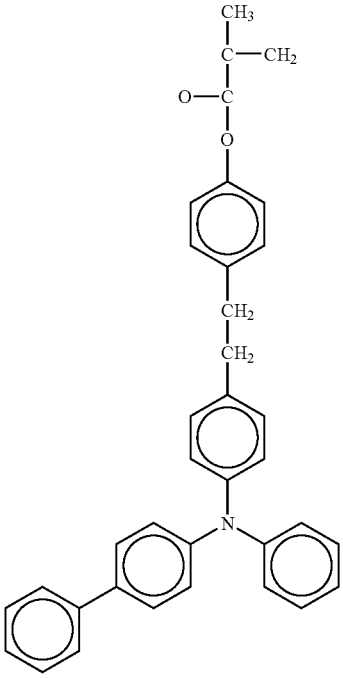
No. 97
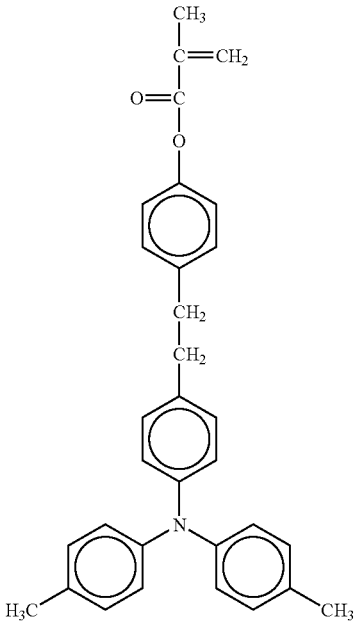
-continued
No. 98
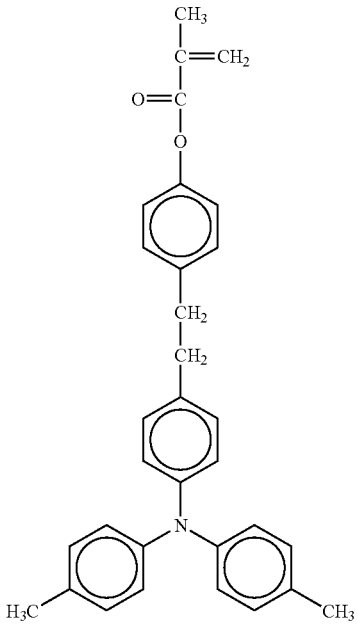
No. 99
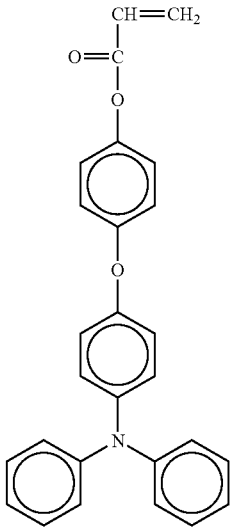

-continued
No. 100
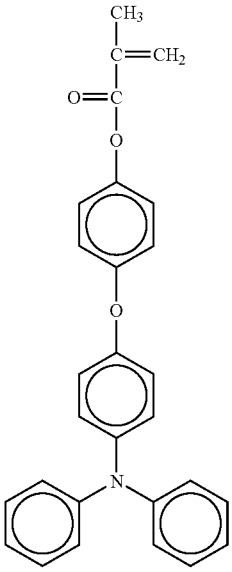
-continued
No. 102
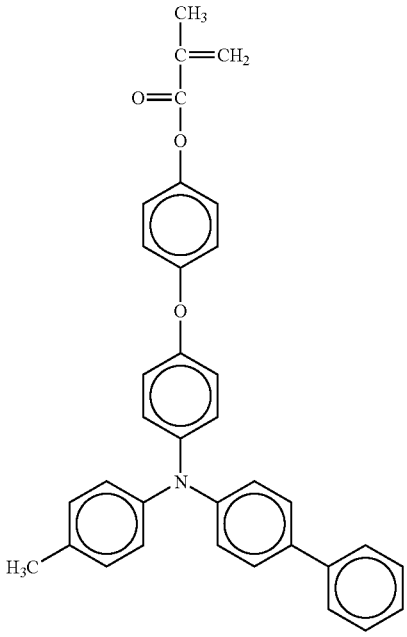
No. 101
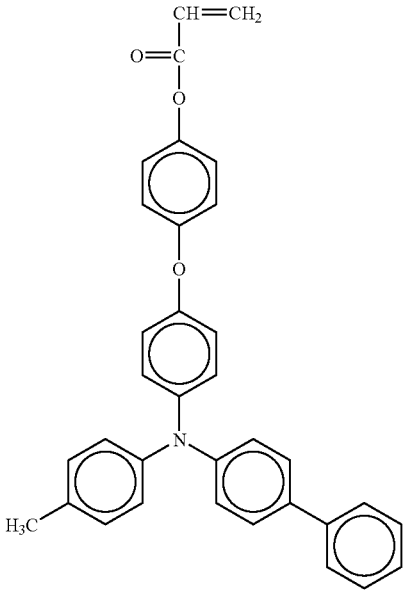
No. 103
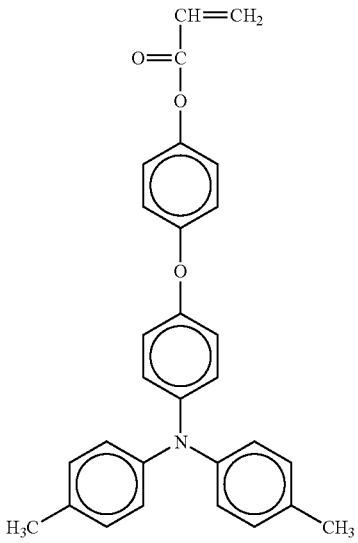

-continued
No. 104
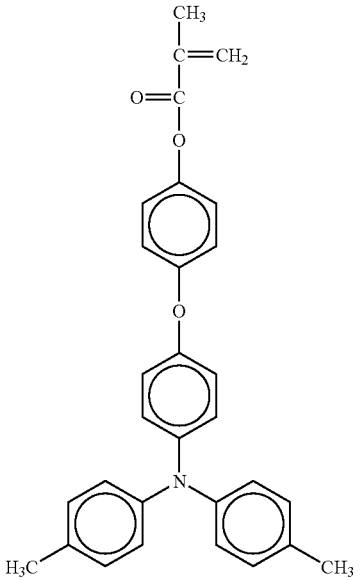
No. 105
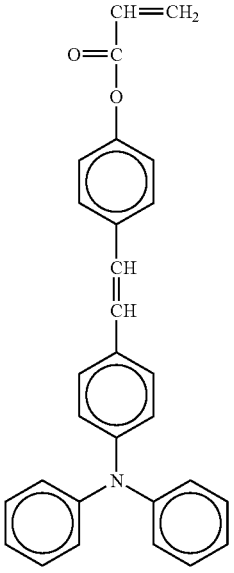
-continued
No. 106
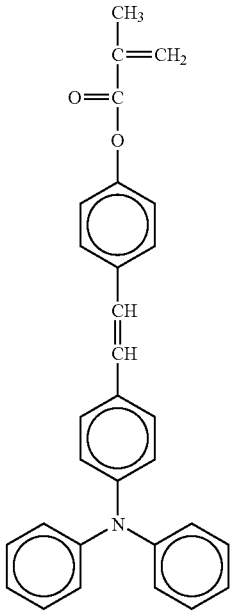
No. 107
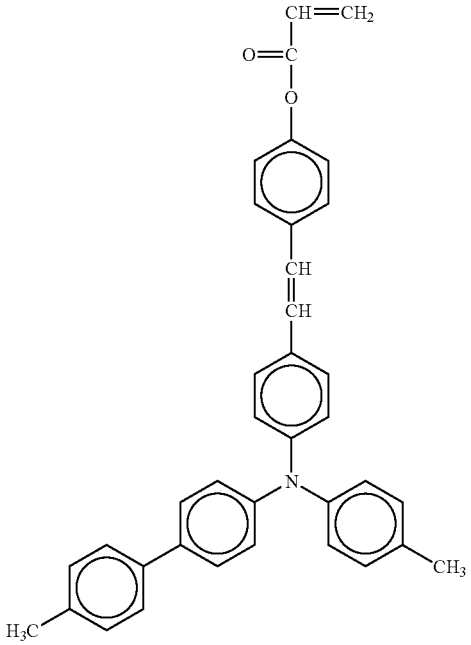

-continued
No. 108
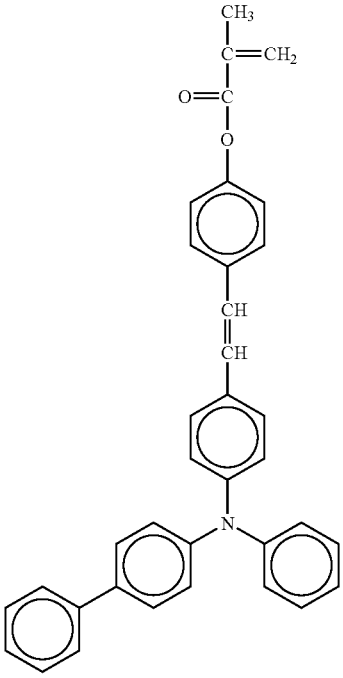
No. 109
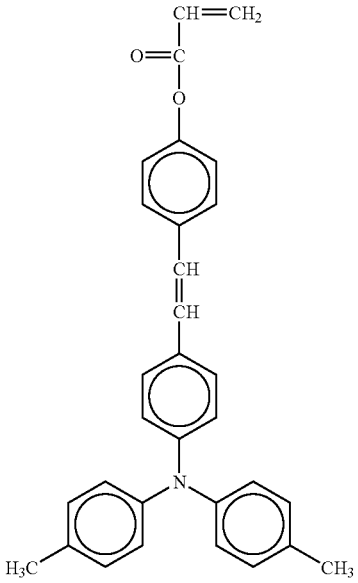
-continued
No. 110
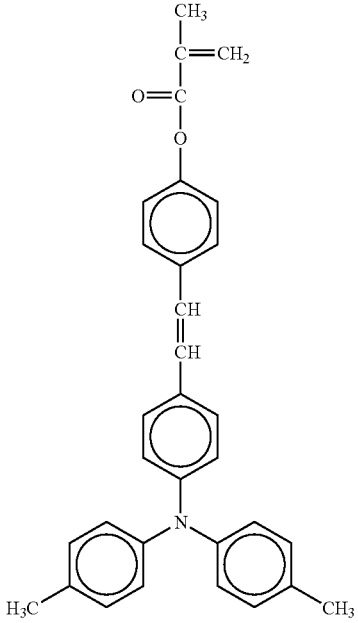
No. 111
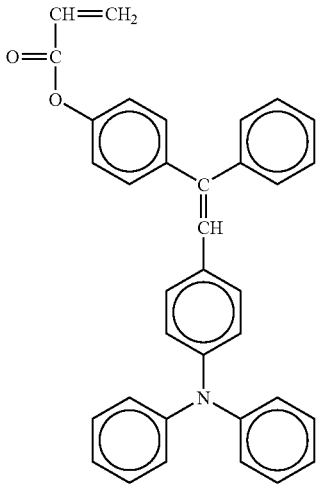

-continued
No. 112
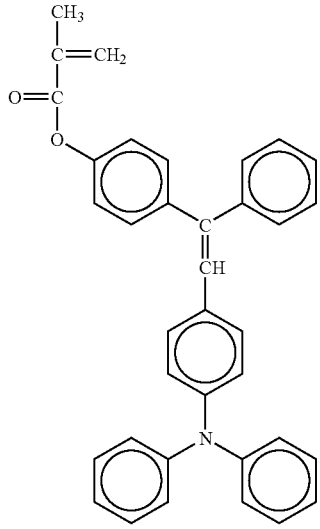
No. 113
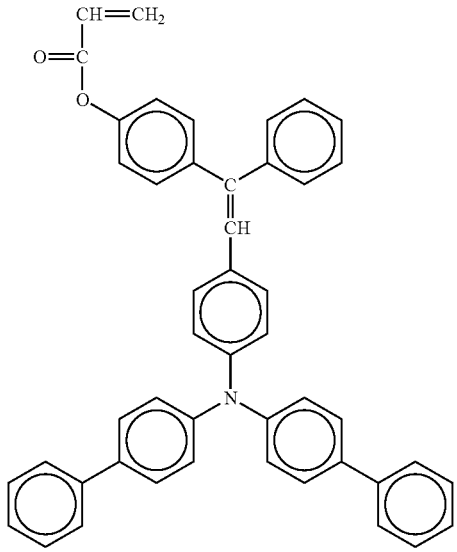
-continued
No. 114
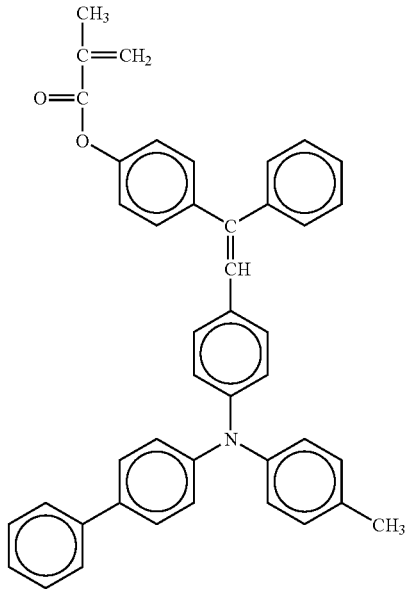
No. 115
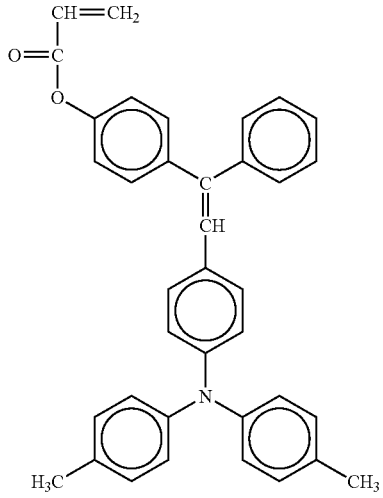

-continued
No. 116
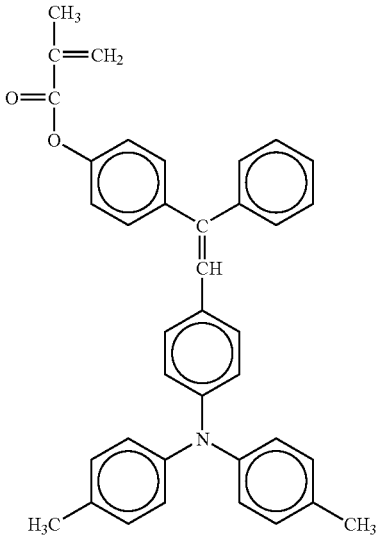
-continued
No. 118
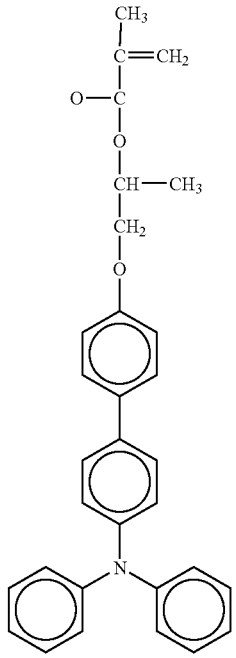
No. 117
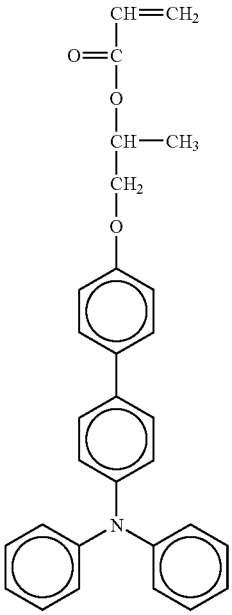
No. 119
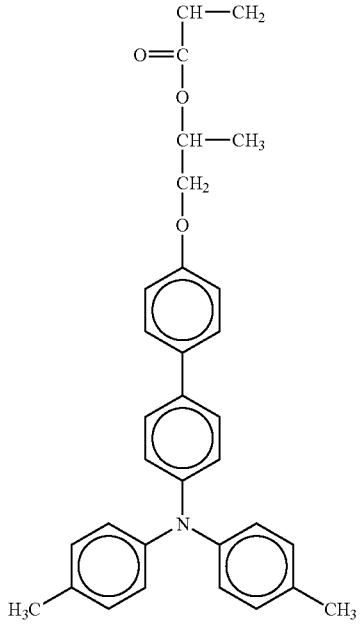

-continued
No. 120
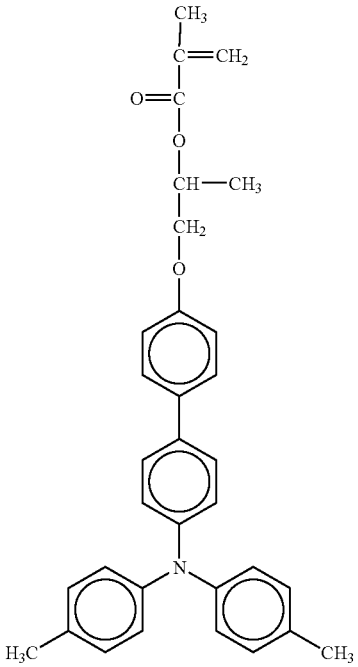
-continued
No. 122
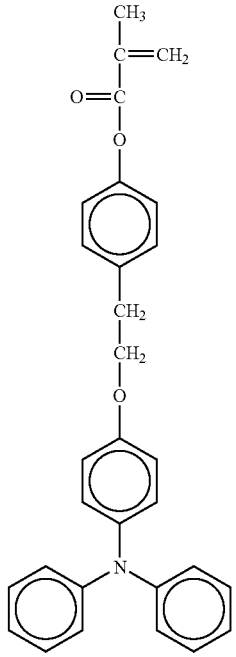
No. 121
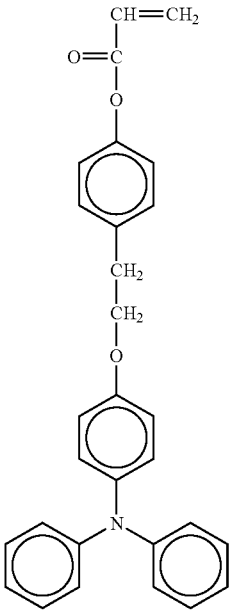
No. 123
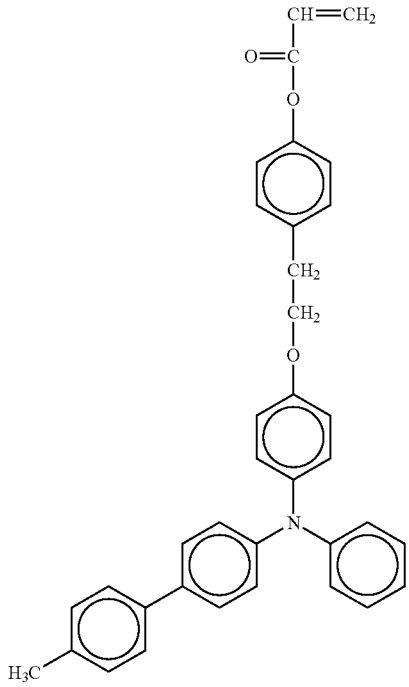

-continued
No. 124
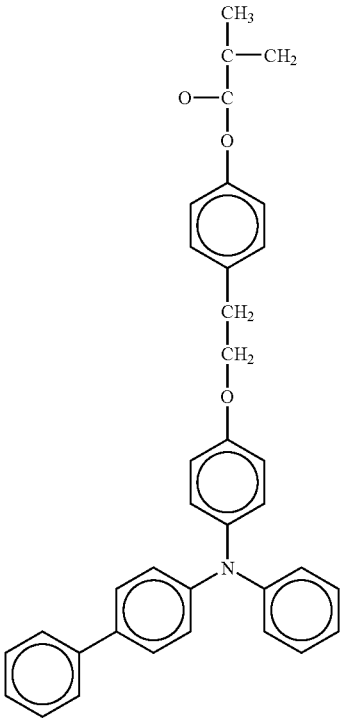
No. 125
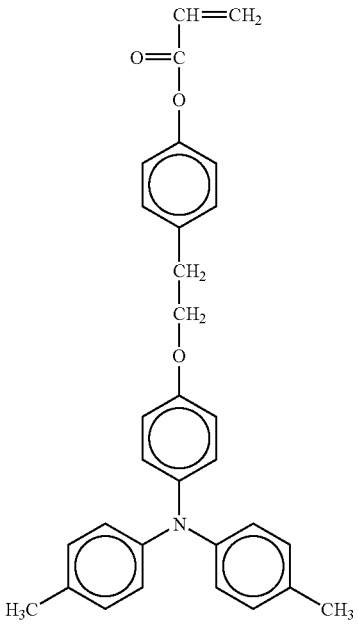
-continued
No. 126
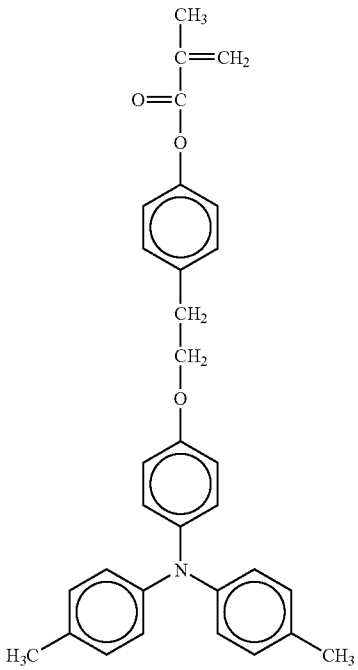
No. 127
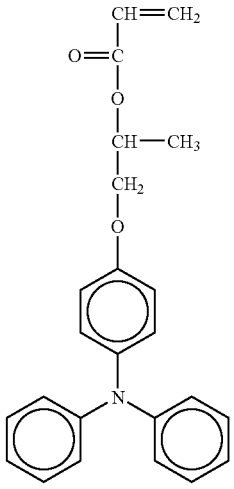

-continued
No. 128
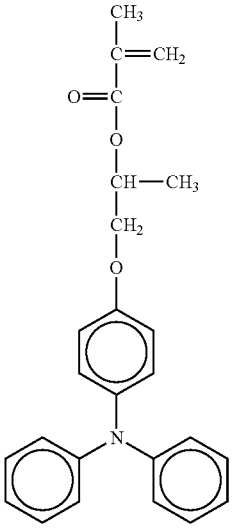
-continued
No. 130
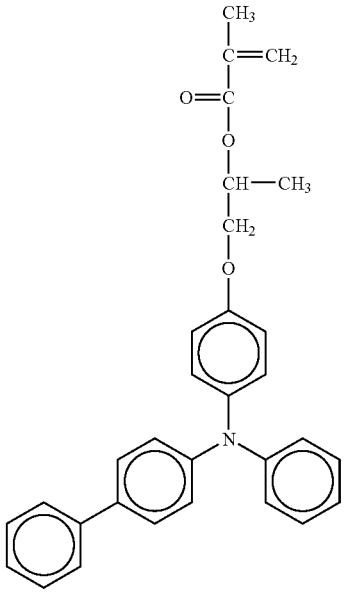
No. 129
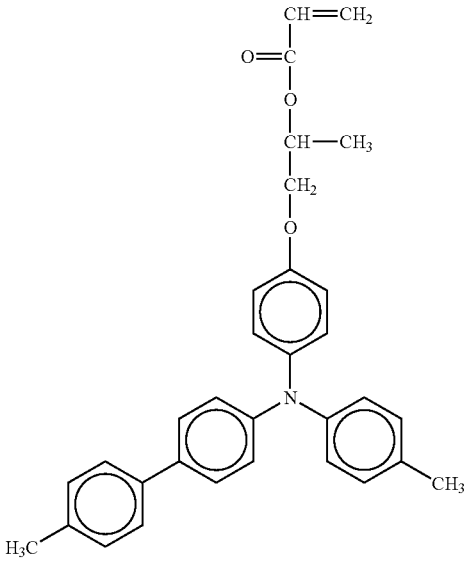
No. 131
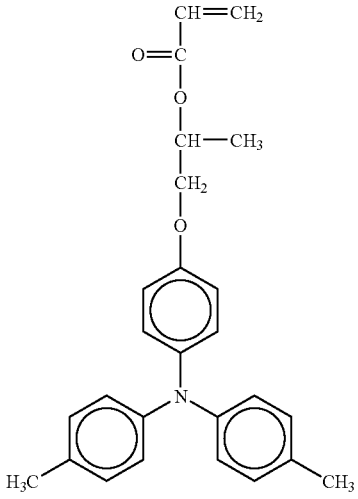

-continued
No. 132
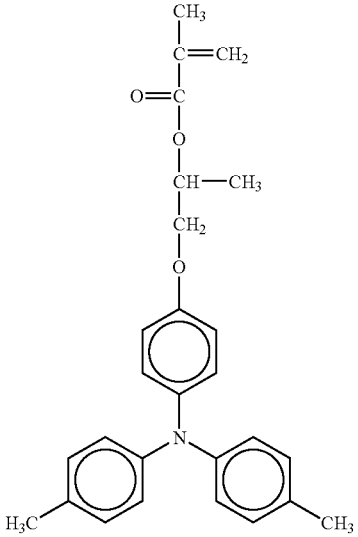
No. 133
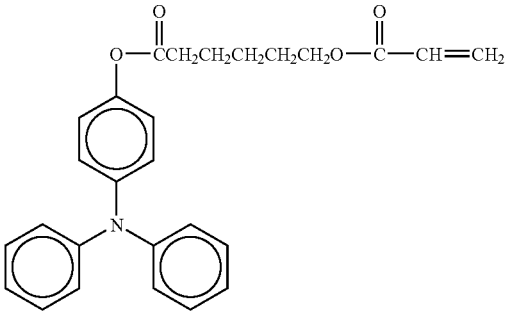
No. 134
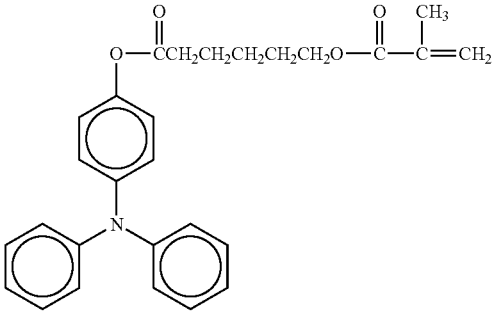
No. 135
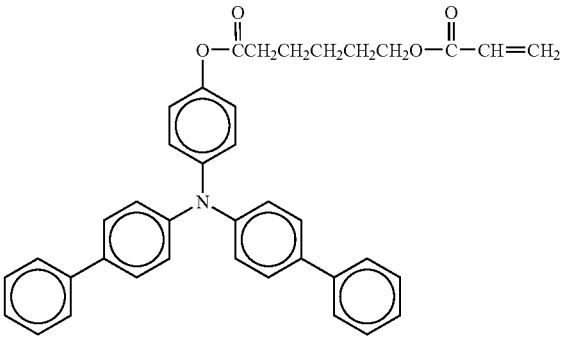
-continued
No. 136
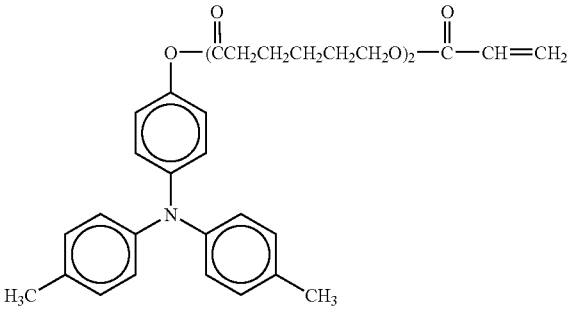
No. 137
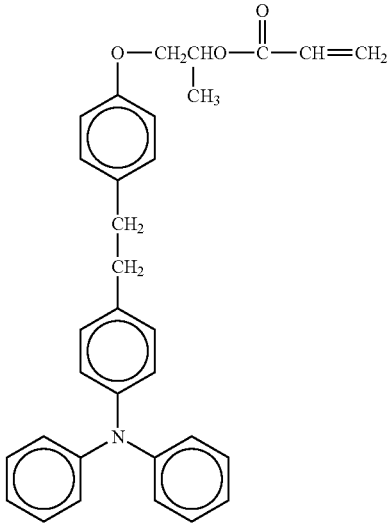
No. 138
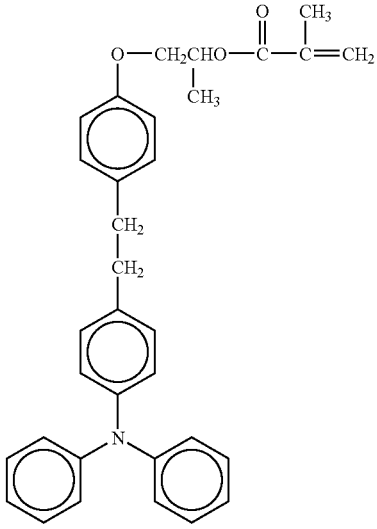

-continued
No. 139
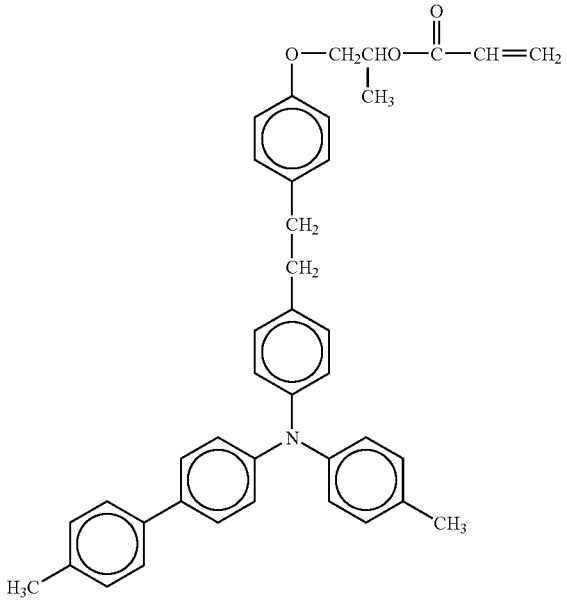
No. 140
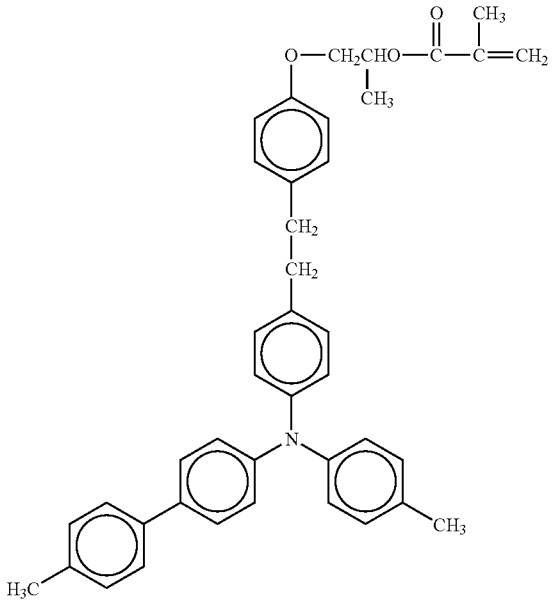
-continued
No. 141
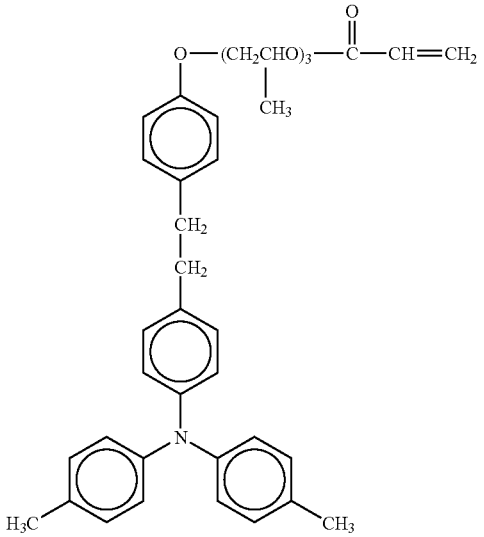
No. 142
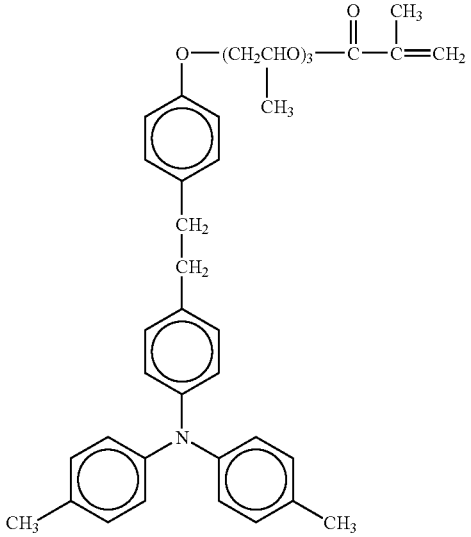
No. 143
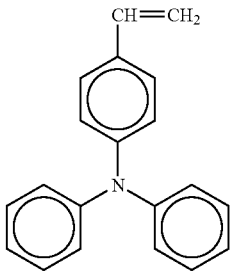

-continued
No. 144
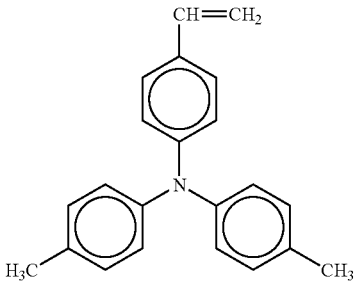
No. 145
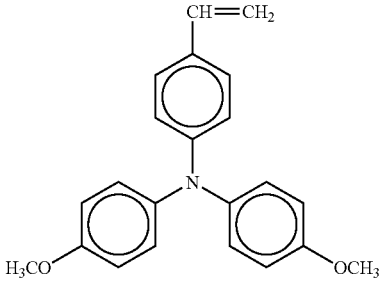
No. 146
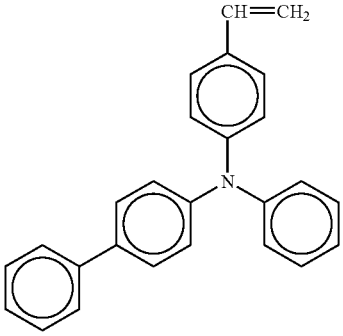
No. 147
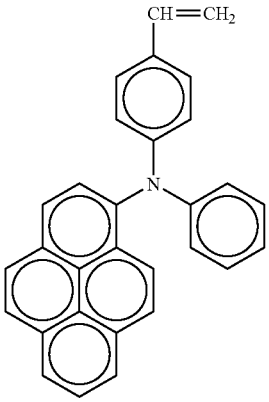
No. 148
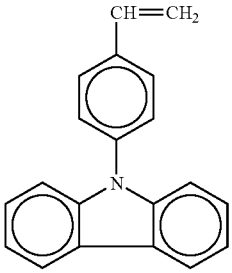
-continued
No. 149
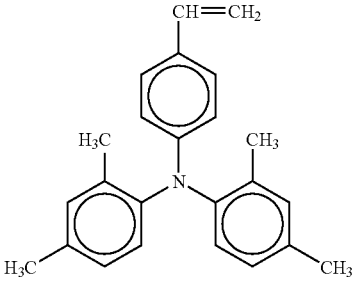
No. 150
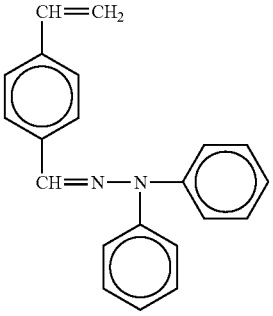
No. 151
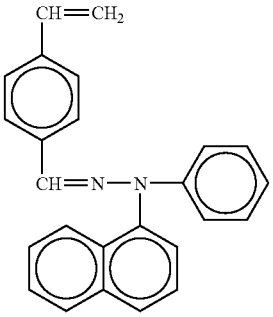
No. 152
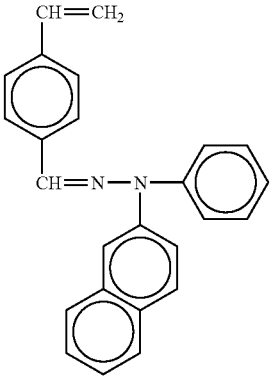
No. 153
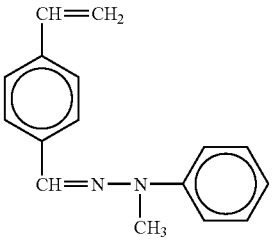

-continued

No. 154

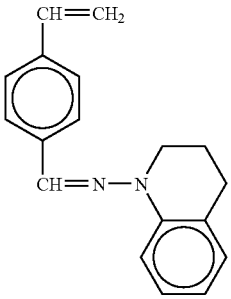

No. 155

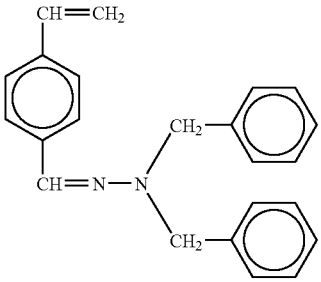

No. 156

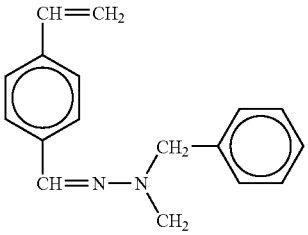

No. 157

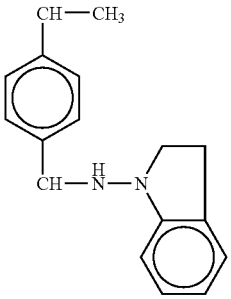

No. 158

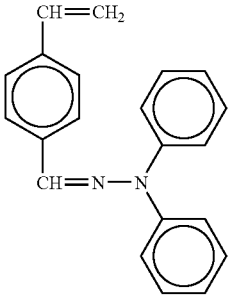

-continued

No. 159

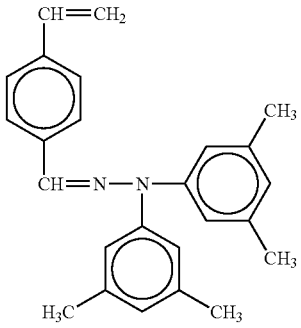

No. 160

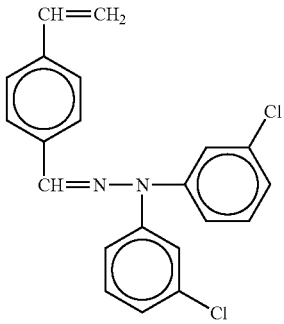

Also, the mono-functional radical polymerizable compound having a charge transporting structure used in the present invention is important, since it provides for the crosslinked surface layer with charge transporting ability. This ingredient is 20% to 80% by mass, preferably 30% to 70% by mass, based on the total amount of the crosslinked surface layer. If this ingredient is less than 20% by mass, the charge transporting ability of the crosslinked surface layer cannot be sufficiently maintained, thereby causing deterioration of electrical properties such as reduction of sensitivity, increase of residual potential and the like owing to repeated use. If it exceeds 80% by mass, the content of tri-functional monomer without having a charge transporting structure is reduced, thereby the crosslinked density is reduced and high abrasion resistance cannot be attained. Though it is impossible to uniformly mention the added amount of this ingredient since the required electrical properties and abrasion resistance vary according to processes to be used, the amount is most preferably in the range of 30 to 70% by mass considering balance between two properties.

The surface layer adapted to the present invention is formed by curing at least a tri- or more-functional radical polymerizable monomer without having a charge transporting structure and a mono-functional radical polymerizable compound having a charge transporting structure. However, in order to control viscosity during coating, to relieve stress of the crosslinked surface layer, to lower the surface energy or to reduce friction coefficient, a mono-functional and bi-functional radical polymerizable monomer or radical polymerizable oligomer may be combinedly used. As the radical polymerizable monomer and the oligomer, known substances can be used.

Examples of the mono-functional radical monomer include 2-ethylhexyl acrylate, 2-hydroxyethyl acrylate, 2-hydroxypropyl acrylate, tetrahydrofurfuryl acrylate, 2-ethylhexylcarbitol acrylate, 3-methoxybutyl acrylate, benzyl acrylate, cyclohexyl acrylate, isoamyl acrylate, isobutyl acrylate, methoxytriethyleneglycol acrylate, phenoxytetraethyleneglycol acrylate, cetyl acrylate, isotearyl acrylate, stearyl acrylate, styrenemonomer and the like.

Examples of the bi-functional radical polymerizable monomer include 1,3-butanediol diacrylate, 1,4-butanediol diacrylate, 1,4-butanediol dimethacrylate, 1,6-hexanediol diacrylate, 1,6-hexanediol dimethacrylate, diethyleneglycol diacrylate, neopentylglycol diacrylate, EO-modified bisphenol A diacrylate, EO-modified bisphenol F diacrylate, neopentylglycoldiacrylate and the like.

Examples of the functional monomer include a fluorinated monomer such as octafluoropentylacrylate, 2-perfluorooctylethyl acrylate, 2-perfluorooctylethyl methacrylate, 2-perfluoroisononylethyl acrylate and the like, a vinyl monomer, acrylate and methacrylate having a polysiloxane group such as acryloylpolydimethylsiloxaneethyl, methacryloylpolydimethylsiloxaneethyl, acryloylpolydimethylsiloxanepropyl, acryloylpolydimethylsiloxanebutyl, diacryloylpolydimethylsiloxanediethyl and the like, which have 20 to 70 siloxane repeating units, as described in JP-B No. 5-60503, JP-B No. 6-45770.

The radical polymerizable oligomer include, for example, epoxy acrylate, urethane acrylate and polyester acrylate oligomers. However, when a large amount of a mono- and bi-functional radical polymerizable monomer or radical polymerizable oligomer is added, the 3-dimensional crosslinkage density of the crosslinked surface layer is substantially reduced, causing reduction of abrasion resistance. Therefore, the content of these monomers or oligomers is limited 50 parts by mass or less, preferably 30 parts by mass or less, relative to 100 parts by mass of the tri- or more-functional radical polymerizable monomer.

Also, the surface layer according to the present invention is formed by curing at least a tri- or more-functional radical polymerizable monomer without having a charge transporting structure and a mono-functional radical polymerizable compound having a charge transporting structure but may further comprise a polymerization initiator in the surface layer, as needed, to effectively perform the cross-linking reaction.

Examples of the thermal polymerization initiator include a peroxide type initiators such as 2,5-dimethylhexane-2,5-dihydroperoxide, diqumyl peroxide, benzoylperoxide, t-butylqumyl peroxide, 2,5-dimethyl-2,5-di (peroxybenzoyl) hexene-3, di-t-butylperoxide, t-butylhydroperoxide, qumene hydroperoxide, lauroyl peroxide and the like, and an azo type initiator such as azobisisobutylnitrile, azobiscyclohexanecarbonitrile, methyl azobisisobutyrate, azobisisobutylamidine hydrochloride, 4,4'-azobis-4-cyanovaleroic acid and the like.

Examples of the photopolymerization initiator include an acetophenone type initiator such as diethoxyacetophenone, 2,2-dimethoxy-1,2-diphenylethan-1-one, 1-hydroxy-cyclohexyl-phenyl-ketone, 4-(2-hydroxyethoxy)phenyl-(2-hydroxy-2-propyl)ketone, 2-benzyl-2-dimethylamino-1-(4-morpholinophenyl)butanone-1, 2-hydroxy-2-methyl-1-phenylpropane-1-one, 2-methyl-2-morpholino(4-methylthiophenyl)propane-1-one, 1-phenyl-1,2-propanedione-2-(o-ethoxycarbonyl)oxime and the like or a ketal type photopolymerization initiator, a benzoinether type photopolymerization initiator such as benzoin, benzoinmethyl ether, benzoinethylether, benzoinisobutylether, benzoinisopropyl ether and the like, a benzophenone type photopolymerization initiator such as benzophenone, 4-hydroxybenzophenone, methyl o-benzoylbenzoate, 2-benzoylnaphthalene, 4-benzoylbiphenyl, 4-benzoylphenylether, acrylated benzophenone, 1,4-benzoylbenzene and the like, a thioxanthone type photopolymerization initiator such as 2-isopropylthioxanthone, 2-chlorothioxanthone, 2,4-dimethylthioxanthone, 2,4-diethylthioxanthone, 2,4-dichlorothioxanthone and the like, and other examples of the photopolymerization initiator include such as ethylanthraquinone, 2,4,6-trimethylbenzoyldiphenylphosphine oxide, 2,4,6-trimethylbenzoylphenylethoxyphosphine oxide, bis(2,4,6-trimethylbenzoyl)phenylphosphine oxide, bis(2,4-dimethoxybenzoyl)-2,4,4-trimethylpentylphosphine oxide, methylphenylglyoxyester, 9,10-phenanthrene compounds, acridine compounds, triazine compounds, imidazole compounds and the like. Also, it is possible to use a compound capable of promoting photopolymerization alone or in combination with the photopolymerization initiator, which, for example, includes triethanolamine, methyldiethanolamine, ethyl 4-dimethylaminobenzoate, isoamyl 4-dimethylaminobenzoate, (2-dimethylamino)ethylbenzoate, 4,4'-dimethylaminobenzophenone and the like.

The foregoing polymerization initiators may be used as a mixture of one or more thereof. The content of the polymerization initiator is 0.5 to 40 parts by mass, preferably 1 to 20 parts by mass relative to 100 parts by mass of the total amount of the radical polymerizable component.

Also, the coating solution according to the present invention may contain various additives such as a plasticizer for the purpose of relieving stress and improving adhesion, a leveling agent, a low molecular charge transporting material non-reactive with radical and the like, as needed. These additives may be any of those known to the art. The plasticizer which can be used in the present invention includes those commonly used in a resin, such as dibutylphthalate, dioctylphthalate and the like, and its added amount is limited to 20% by mass or less, preferably 10% by mass or less, relative to the total solid content of the coating solution. Also, the leveling agent which can be used in the present invention include silicone oils such as dimethyl silicone oil, methylphenyl silicone oil and the like, or polymers or oligomers having a perfluoroalkyl group in a side chain and its added amount is suitably 3% by mass or less, relative to the total solid content of the coating solution.

The crosslinked surface layer according to the present invention is formed by applying a coating solution comprising at least a tri- or more-functional radical polymerizable monomer without having a charge transporting structure and a mono-functional radical polymerizable compound having a charge transporting structure, followed by curing. When the radical polymerizable monomer is a liquid, the coating solution may be applied with another ingredient dissolved therein. Also, it may be diluted in a solvent before application, as needed. Here, examples of the usable solvent include alcohols such as methanol, ethanol, propanol, butanol and the like, ketones such as acetone, methylethylketone, methyl isobutylketone, cyclohexanone and the like, esters such as ethyl acetate, butyl acetate and the like, ethers such as tetrahydrofuran, dioxane, propylether and the like, halogenated compounds such as dichloromethane, dichloroethane, tolly chloroethane, chlorobenzene and the like, aromatics such as benzene, toluene, xylene and the like, and cellosolves such as methylcellosolve, ethylcellosolve, cellosolve acetate and the like. These solvents may be used alone or as a mixture of two or more thereof. The dilution in the solvent varies according to solubility of the composition, coating process and desired membrane thickness and is not particularly limited. The coating is performed by dipping coating, spray coating, bead coating, ring coating and the like.

According to the present invention, after the coating solution is applied, curing is carried out by applying an external energy to form a crosslinked surface layer. Here, examples of the external energy which can be used include heat, light and radiation. The process for applying heat energy is carried out by heating from the coating surface side or substrate side using air, gas of for example nitrogen, vapor, or various heating media, far infrared rays, electronic wave. The heating temperature is preferably between 100° C. and 170° C. When it is less than 100° C., reaction rate is slow and not completely finished. When it is higher than 170° C., the reaction progresses nonuniformly, causing a large distortion in the crosslinked surface layer. In order to uniformly progress the curing, it is an effective way to complete the reaction by heating at a relatively low temperature of less than 100° C. and further heating at 100° C. or higher. The light energy which can be used includes UV irradiating source such as a high pressure mercury lamp and metal halide lamp having a light emitting wavelenth mainly in the UV region. Also, it is possible to select a visible light source in accordance with the absorption wave length of the radical polymerizable components or photopolymerization initiators. The irradiation amount is preferably from 50 $mW/cm^2$ to, 1000 $mW/cm^2$. If it is less than 50 $mW/cm^2$, the curing takes much time. If it is stronger than 1000 $mW/cm^2$, the reaction nonuniformly progresses, thereby the roughness of the crosslinked surface layer becomes severe. The irradiation energy includes those using electronic rays. Among the foregoing energies, owing to easiness of controlling the reaction rate and convenience of the apparatus, heat and light energy may be effectively used.

The thickness of the crosslinked charge transporting layer is 1 μm or more and 10 μm or less, preferably is 2 μm or more and 8 μm or less. When the thickness is more than 10 μm, cracks and peelings are likely to occur; when the thickness is less than 8 μm, the crosslinking density may be more increased due to the allowable margin, and the selection of materials to enhance the wear resistance and design to harden the resins etc. may come be possible.

On the other hand, the radical polymerization reaction is susceptible to oxygen obstruction, i.e. the crosslinking does not progress or tends to become nonuniform due to radical trap at the surface exposed to atmosphere. The phenomena is significant when the layer thickness is less than 1 μm. The thinner layer thickness of the crosslinked charge transporting layer possibly leads to decrease in wear resistance and nonuniform abrasion.

Further, in the coating step of the crosslinked charge transporting layer, the components of underlying charge transporting layer tend to include into the crosslinked charge transporting layer, in particular, the inclusion extends over the entire crosslinked charge transporting layer if the layer is thinner, and resulting in the affection of curing reaction and the decrease of crosslinking density.

For these reasons, when the layer thickness is 1 μm, the crosslinked charge transporting layer exhibits proper wear resistance and flaw resistance. However, should the crosslinked charge transporting layer is shaved locally to the underlying charge transporting layer during the repeated usages, the abrasion at the shaved regions come to be enlarged, the density nonuniformity of intermediate images is often induced due to the fluctuation of charging ability and sensitivity. Accordingly, the layer thickness of the crosslinked charge transporting layer is preferably 2 μm or more for assuring the prolonged life and the higher image quality.

In the constitution of the charge generating layer, charge transporting layer, crosslinked charge transporting layer laminated in this order, the wear resistance and the flaw resistance are remarkably high when the upper most layer of the crosslinked charge transporting layer is insoluble against organic solvents.

The solubility against organic solvents may be evaluated by dropping a droplet of organic solvent such as tetrahydrofuran, dichloromethane, which have generally high solubility against polymer materials, on the surface of the electrophotographic photoconductor, and observing the surface after air drying by means of a stereoscopic microscope.

When the electrophotographic photoconductor has higher solubility, such phenomena may be observed as the central portion of the droplet turns into concave and the periphery raise, the whiting or fogging appears due to deposition or crystallization of the charge transporting material, and wrinkles appear due to swelling and then shrinking. On the contrary, such phenomena do not appear and the appearance is the same with before dropping in the insoluble electrophotographic photoconductor.

In order to make the crosslinked charge transporting layer against organic solvents, such factors are important and are to be controlled, (i) composition of coating liquid for crosslinked charge transporting layer and the content of the respective components, (ii) solvent for diluting the coating liquid for crosslinked charge transporting layer and the solid content, (iii) the way to coat the coating liquid for crosslinked charge transporting layer, (iv) curing conditions of the crosslinked charge transporting layer, (v) insolubilization of the underlying charge transporting layer. By the way, the insolubilization may not be attained by one of these factors.

As for the constituent material of coating liquid for the crosslinked charge transporting layer, when additives such as binder resin, anti-oxidant, plasticizer etc. that does not have a radical polymerizable functional group are included in a large amount other than the radical polymerizable monomer having tri- or more functionality and no charge transporting structure and the mono-functional radical polymerizable compound having a charge transporting structure, the crosslinked charge transporting layer is possibly lower in the crosslinking density, tends to cause the phase separation between the reaction-cured products and the additives, and is likely to be soluble against organic solvents.

Accordingly, it is important to suppress the solid content of the additives to 20% by mass or less based on the total solid content of the coating liquid specifically.

Further, in order to prevent the dilution of the crosslinking density, preferably, the total amount of the mono- or di-functional radical polymerizable monomer, reactive oligomer, and reactive polymer is 20% by mass or less based on the tri-functional radical polymerizable monomer.

Further, when radical polymerizable compound having two or more functionalities and charge transporting structure is incorporated in a large amount, the resulting layer tends to cause a distortion since a bulky structure is fixed into the crosslinking structure though plural bonding, tends to be a flocculent of fine cured products, and thereby the layer may be soluble against organic solvents.

The content of radical polymerizable compound having two or more functionalities and charge transporting structure is preferably 10% by mass or less based on the radical polymerizable compound having one functionality and charge transporting structure, although the content depends on the structure of compound.

As for the solvent for diluting the coating liquid for the crosslinked charge transporting layer, when a solvent is employed of which the evaporating velocity is relatively slow, the remaining solvent may hinder the curing or increase the incorporated amount of the underlying components, consequently may lead to uneven curing or decrease of the cured density, and to soluble against organic solvents.

Specifically, tetrahydrofuran, mixture of tetrahydrofuran and methanol, ethyl acetate, methyl ethyl ketone, ethyl cellosolve, and the like are available, and is selected corresponding to the coating step. As for the solid content, when it is too low, the layer tends to be soluble against organic solvents, whereas the upper limit is defined by film thickness, viscosity of the coating liquid, and the like. Specifically, the solid content is preferably 10 to 50% by mass.

As for the coating way to prepare the crosslinked charge transporting layer, such way is desirable that the content of solvent is lower and the period to contact with the solvent is shorter. Specifically, spray coating method and ring coating method with limited coating amount are preferable. In order to prevent the inclusion of underlying, such way may be effective as employment of polymer charge transporting material as the charge transporting layer, and provision of an intermediate layer insoluble against the solvent of the coating liquid for the crosslinked charge transporting layer.

As for the curing conditions of the crosslinked charge transporting layer, insufficient energy of heating or irradiation results in incomplete curing to increase the solubility against organic solvents; whereas excessively large energy leads to uneven curing reaction, increase of un-crosslinked portions and radical stoppages, and flocculent of fine cured products, resulting in solubility against organic solvents.

In order to make the layer insoluble against the organic solvents, 100 to 170° C. and 10 minutes to 3 hours are preferable in thermal heating conditions; 50 to 1000 $mW/cm^2$, 5 seconds to 5 minutes, and temperature raise of 50° C. or less to suppress the uneven curing reaction are preferable in curing by UV-ray irradiation.

The method to make the crosslinked charge transporting layer according to the present invention insoluble against organic solvent will be exemplified. When an acrylate monomer having three acryloyloxy groups and a triaryl amine compound having one acryloyloxy group are utilized, the ratio of the used amount is 7:3 to 3:7. An polymerization initiator is added 3 to 20% by mass based on the total amount of the acrylate compound, and a solvent is added to prepare a coating liquid. For example, when doner of triaryl amine is utilized as the charge transporting material and polycarbonate is utilized as the binder resin, and the surface layer is coated through spraying method, the solvent of the coating liquid is preferably tetrahydrofuran, 2-butane, or ethyl acetate, and the amount is 3 to 10 times the entire acrylate compound.

Then, an underlying layer, charge generating layer, and charge transporting layer are coated on the support of alumina cylinder, then the coating liquid of the crosslinked charge transporting layer is coated by spraying method etc. on the charge transporting layer. Then, the coating is subjected to air drying or drying at lower temperature for shorter period, e.g. 25 to 85° C. for 1 to 10 minutes, thereafter is hardened by UV curing or heating.

In ultraviolet irradiation, a metal halide lamp may be used at an illuminance of preferably 50 $mW/cm^2$ to 1000 $mW/cm^2$. For example, when ultraviolet rays at 500 $mW/cm^2$ are applied, the rays are applied from different directions uniformly for about 20 seconds. The temperature of the photoconductor should be controlled so as not to exceed 50° C.

When the composition is cured by heating, the heating temperature is preferably from 100° C. to 170° C. When a blast oven is used as a heater and the heating temperature is set at 150° C., the heating time is from about 20 minutes to about 3 hours.

After the completion of curing, the article is heated at 100° C. to 150° C. for 10 to 30 minutes to reduce residual solvent. Thus, a photoconductor of the present invention is prepared.

Then, the photoconductor according to the present invention will be explained with reference to the attached figures.

Figure 7:
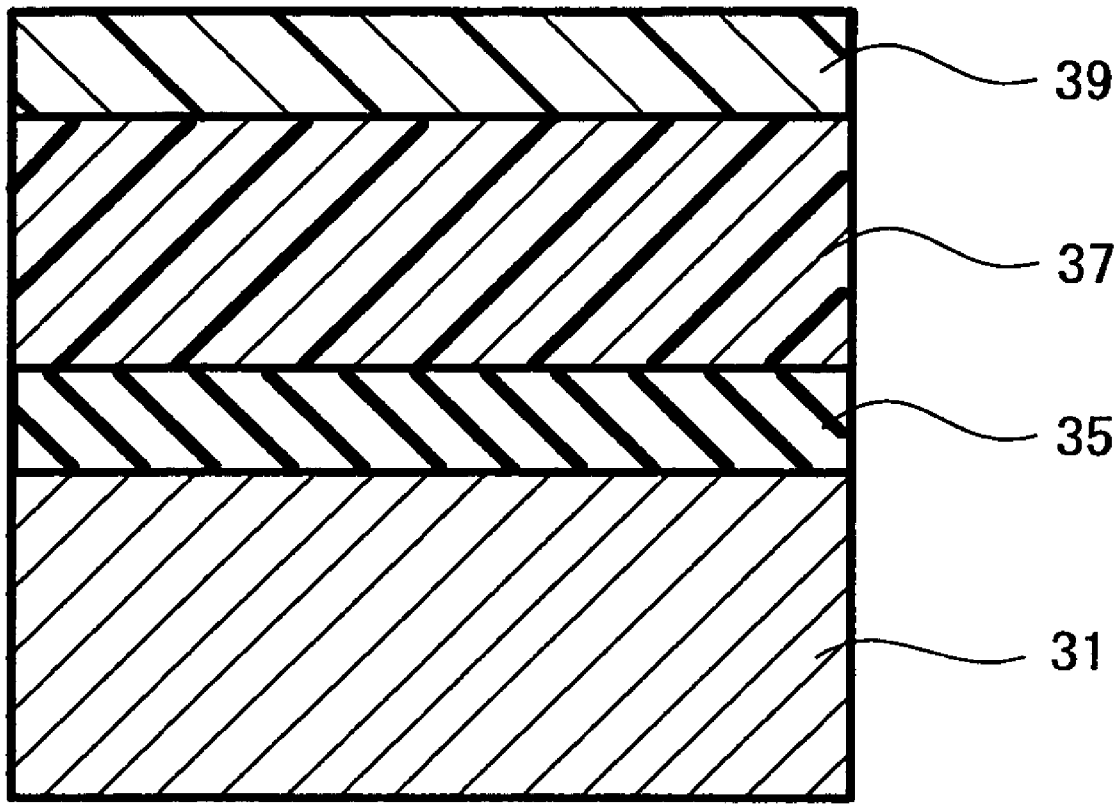
FIG. 7 schematically shows an exemplary cross section of photoconductor according to the present invention.

FIG. 7 shows a cross section of an exemplary constitution of photoconductor according to the present invention, in which charge generating layer 35 based on titanyl phthalocyanine crystal having a specific crystalline structure and a certain averaged particle size, and charge transporting layer 37 based on a charge transporting material are laminated on conductive support 31, and further crosslinked charge transporting layer 39 is laminated as the outermost layer of the photoconductor. In addition, an intermediate layer between the crosslinked charge transporting layer and the charge transporting layer, and undercoat layer between conductive support 31 and charge generating layer 35 may be disposed, which are effective to enhance the durability of the photoconductor and to improve the stability of image quality.

The conductive substrate 31 may be a film-shaped or cylindrically-shaped plastic or paper covered with a conducting material having a volume resistivity of $10^{10}$ ohm·cm, e.g., a metal such as aluminum, nickel, chromium, nichrome, copper, gold, silver or platinum, or a metal oxide such as tin oxide or indium oxide, by vapor deposition or sputtering, or it may be a plate of aluminum, aluminum alloy, nickel or stainless steel, and this may be formed into a tube by extrusion or drawing, cut, polished and surface-treated. The endless nickel belt and endless stainless steel belt can also be used as the conductive substrate 31.

Also, a cylindrical support made from aluminum may be utilized most preferably to which anodizing can be easily applied. The term "aluminum" includes both pure aluminum and an aluminum alloy. Specifically, pure aluminum and aluminum alloys selected from JIS Series 1000, 3000, 6000 of aluminum and aluminum alloys are most appropriate. An oxide film on an anode is formed by anodizing each kind of metal or each kind of metal alloy in electrolyte solution. In particular, the coating called alumite in which aluminum or an aluminum alloy is anodized in electrolyte solution is most appropriate for a photo conductor used in the present invention. The above conductive supports are preferable with respect to preventing the occurrences of point defects such as black void or background smear especially when it is applied to a reverse development i.e. a negative or positive development.

The anodic oxide coating is carried out in acid solution of chromic acid, sulfuric acid, oxalic acid, phosphoric acid, boric acid, sulfamic acid, or the like. Among these, anodic oxide coating in a sulfuric acid bath is most appropriate. For example, anodic oxide coating is carried out under the conditions in which the concentration of sulfuric acid is 10 to 20%, bath temperature is 5 to 25° C., current density is 1 to 4 $A/dm^2$, bath voltage is 5 to 30V, and time period for anodizing is about 5 to 60 minutes, but not limited to these conditions.

The resulting oxidation film on the anode is porous and exhibits a high insulating property, and the surface of the film is considerably unstable. Therefore, the anodic oxide coating tends to vary with time, and physical properties of the coating are likely to vary. In order to prevent the variation, it is preferable to further apply a sealing treatment to the anodized film. As the sealing treatment, several processing may be employed, that is, immersing the anodized film in a solution including nickel fluoride or nickel acetate, immersing the anodized film in boiling water, and treating the film by pressurized steam. Among the processing, immersing in a solution including nickel acetate is most preferable. A washing treatment is applied to anodized film following the sealing treatment. A main object of the washing treatment is to remove residual metal salt and the like, adhering due to the sealing treatment. When the excessive metal salt remains on the surface of the support (the anodic oxide coating), since low resistance components in the salt generally remain, the components cause generation of stains on image background as well as adverse effects on the quality of coating film formed on the surface. Although the washing treatment may be accomplished with purified water, multi-step washing is commonly performed. In this case, it is preferable for cleaning liquid to be used at final washing to be as clean (de-ionized) as possible. Also, it is desirable to physically rub the conductive supporter during washing by using a contact member in a process within a multi-step washing process. It is preferable that film thickness of the anodized film formed like above be about from 5 to 15 μm. If the thickness is thinner than 5 μm, the effect of barrier property of the anodized film is not enough. When the thickness is over 15 μm, the time constant of the film as an electrode become too large, and generation of residual potential and deterioration of response of a photo conductor may occur.

Furthermore, a coated support which is prepared by dispersing conductive fine particles and a suitable binder resin and coating the same onto the above-mentioned conductive support may also be utilized as the conductive support 31 in the present invention. Examples of the conductive fine particles include carbon black, acetylene black, metal power fine particles, such as aluminium, nickel, iron, nichrome, copper, zinc and silver, and metal oxide fine particles, such as conductive tin oxide, ITO, etc. As for the binder resin which is used together with the conductive fine particles, any of the following resin may utilized: polystyrene, styrene acrylonitrile copolymer, styrene butadiene copolymer, styrene maleic anhydride copolymer, polyester, polyvinyl chloride, vinyl chloride vinyl acetate copolymer, polyvinyl acetate, polyvinylidene chloride, polyacrylate resin, phenoxy resin, polycarbonate, cellulose acetate resin, ethyl-cellulose resin, polyvinyl butyral, polyvinyl formal, polyvinyl toluene, poly-N-vinylcarbazole, acrylate resin, silicone resin, epoxy resin, melamine resin, urethane resin, phenol resin, alkyd resin, etc.

The conductive layer can be prepared by dispersing and coating the conductive fine particles and the binder resin to a suitable solvent, for example, tetrahydrofuran, dichloromethane, methyl ethyl ketone, toluene, etc.

Further, the conductive support which is prepared by forming the conductive layer on a suitable cylinder base with a thermal-contraction inner tube which is made of a suitable material, such as polyvinyl chloride, polypropylene, polyester, polystyrene, polyvinylidence chloride, polyethylene, chlorinated rubber, Teflon (registered trade name), etc. and contain the conductive fine particles may also be utilized as the conductive support 31 in the present invention.

The photoconductive layer will be explained in the following. The photoconductive is preferably laminate of charge-generating layer 35 and the charge-transporting layer 37, which constitution is appropriate in sensitivity and durability, therefore is successfully utilized.

The charge generating layer 35 contains as the charge generating substance a titanyl phthalocyanine crystal that exhibits a highest peak at 27.2°, main peaks at 9.4°, 9.6° and 24.0°, a peak at 7.3° as the lowest angle, and with no peaks in a range between 7.3° and 9.4°, and with no peak at 26.3° as Bragg 2θ angles in terms of CuK-α characteristic X-ray wavelength at 1.542 Å. The averaged primary particle size is adjusted 0.25 μm or less during the synthesizing process of the crystal of dispersing and filtering process thereafter. The charge generating layer 35 is formed from titanyl phthalocyanine crystal as the main component that does not substantially contain coarse particles.

The charge generating layer 35 may be formed by dispersing the charge generating substance, and binder resin optionally used in a suitable solvent, by means of a ball mill, attriter, sand mill, ultrasonic, coating on the conductive support, and drying it.

Suitable binder resins, which are optionally used for the charge generating layer 35, include polyamide, polyurethane, epoxy resins, polyketone, polycarbonate, silicone resins, acrylic resins, polyvinyl butyral, polyvinyl formal, polyvinyl ketone, polystyrene, polysulfone, poly-N-vinylcarbazole, polyacrylamide, polyvinyl benzal, polyester, phenoxy resins, vinyl chloride-vinyl acetate copolymers, polyvinyl acetate, polyphenylene oxide, polyamides, polyvinyl pyridine, cellulose resins, casein, polyvinyl alcohol, polyvinyl pyrrolidone, and the like resins. The content of the binder resin in the charge-generating substance is preferably from 0 to 500 parts by mass, and preferably from 10 to 300 parts by mass, per 100 parts by mass of the charge-generating substance.

Examples of the suitable solvent for use include isopropanol, acetone, methyl ethyl ketone, cyclohexanone, tetrahydrofuran, dioxane, ethyl cellosolve, ethyl acetate, methyl acetate, dichloromethane, dichloroethane, monochlorobenzene, cyclohexane, toluene, xylene, ligroin, and the like solvents. In particular, ketone type solvents, ester type solvents and ether type solvents are preferably used. The way to coat the coating liquid is for example immersion coating, spray coating, beat coating, spinner coating, ring coating or the like.

The thickness of charge generating layer 35 is preferably 0.01 to 5 μm, more preferably 0.1 to 2 μm.

The charge transporting layer 37 may be formed by dissolving or dispersing the charge transporting substance and binder resin in a suitable solvent, the solution or dispersion is coated on as a charge generating layer, and drying. Optionally, plasticizer, leveling agent, and antioxidant and the like may be added.

The charge transporting substance is classified into hole transporting substance and electron transporting substance. Examples of the electron transporting substance include chloroanil, bromoanil, tetracyanoethylene, tetracyano quinodimethan, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indino[1,2-b]thiophene 4-on, 1,3,7-trinitro-dibenzothiophene-5,5-dioxide, and benzoquinone. These are electron accepting substances.

Examples of the positive-hole transporting substance include poly-N-carbazole and its derivatives, poly-y-carbazolylethylglutamate and its derivatives, pyrene-formaldehyde condensation products and their derivatives, polyvinyl pyrene, polyvinyl phenanthrene, polysilane, oxazole derivatives, oxadiazole derivatives, imidazole derivatives, monoarylamines, diarylamines, triarylamines, stilbene derivatives, α-phenyl stilbene derivatives, benzidine derivatives, diarylmethane derivatives, triarylmethane derivatives, 9-styrylanthracene derivatives, pyrazoline derivatives, divinyl benzene derivatives, hydrazone derivatives, indene derivatives, butadiene derivatives, pyrene derivatives, bis-stilbene derivatives, enamine derivatives, and the like. These charge transporting substances may be used alone or in combination.

Examples of the binder resin include polystyrene, styrene-acrylonitrile copolymer, styrene-butadiene copolymer, styrene-maleicanhydride copolymer, polyester, polyvinyl chloride, vinylchloride-vinylacetate copolymer, polyvinyl acetate, polyvinylidene chloride, polyacrylate resin, phenoxy resin, polycarbonate, celluloseacetate resin, ethyl-cellulose resin, polyvinyl butyral, polyvinyl formal, polyvinyl toluene, poly-N-vinylcarbazole, acrylate resin, silicone resin, epoxy resin, melamine resin, urethane resin, phenol resin, alkyd resin, and the like.

In addition, the polymer charge transporting substances may be properly utilized for the binder resin of the charge transporting layer. When the charge transporting layer of polymer charge transporting substance is employed, appropriate results may be often achieved at laminating the surface protective layer since the solution of the charge transporting layer into the upper layer is lower due to the polymer property.

The polymer of charge-transporting material may be a known material, particularly, a polycarbonate having a triarylamine structure in the main chain and/or side chain performs well. In particular, the polymer charge-transporting substances expressed by Formulas (I) to (X) are appropriately utilized; these substances will be specifically explained.

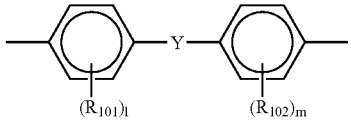

In the above formula, $R_{101}$, $R_{102}$ are respectively substituted or unsubsituted alkyl groups, an aryl group, or a halogen atom, l, m are integers in the range of 0 to 4, Y is a single bond, straight-chain, branched or cyclic alkylene group having 1 to 12 carbon atoms, —O—, —S—, —SO—, —$SO_2$—, —CO—, —CO—O-Z-O—CO— (Z is an aliphatic divalent group), or:

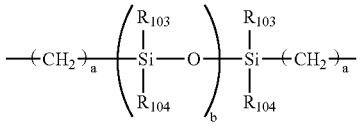

a is an integer in the range of 1 to 20, b is an integer in the range of 1 to 2,000, $R_{103}$, $R_{104}$ are substituted or unsubstituted alkyl groups or aryl groups. $R_{101}$, $R_{102}$, $R_{103}$, $R_{104}$ may be respectively identical or different.

Formula (I)

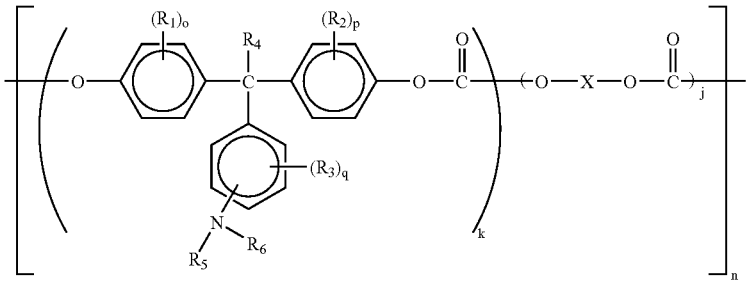

In Formula (I), $R_1$, $R_2$, $R_3$ are respectively substituted or unsubsituted alkyl groups or halogen atoms, $R_4$ is a hydrogen atom or a substituted or unsubsituted alkyl group, $R_5$, $R_6$ are substituted or unsubsituted aryl groups, o, p, q are integers in the range of 0 to 4, k, j represent compositional fractions where $0.1 \leqq k \leqq 1$, $0 \leqq j \leqq 0.9$, n represents the number of repeating units and is an integer in the range of 5 to 5000. X is an aliphatic divalent group, a cyclic aliphatic divalent group, or the divalent group expressed by the following two formulas. In addition, the two units in Formula (I) may be repeated alternatively or arranged in random in the polymer.

Formula (II)

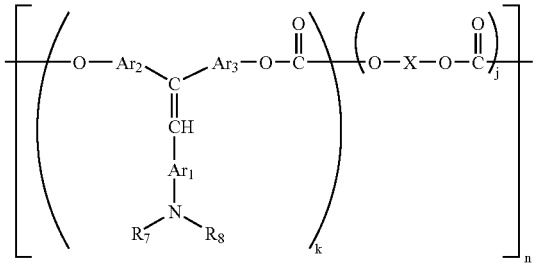

In Formula (II), $R_7$, $R_8$ are substituted or unsubstituted aryl groups, $Ar_1$, $Ar_2$, $Ar_3$ are arylene groups which may be identical or different, X, k, j and n are the same as in Formula (I). In addition, the two units in Formula (II) may be repeated alternatively or arranged in random in the polymer.

Formula (III)

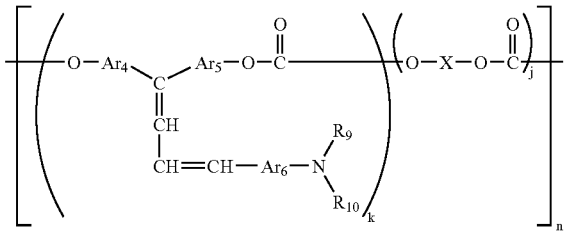

In Formula (III), $R_9$, $R_{10}$ are substituted or unsubstituted aryl groups, $Ar_4$, $Ar_5$, $Ar_6$ are arylene groups which may be identical or different, X, k, j and n are the same as in Formula (II). In addition, the two units in Formula (I) may be repeated regularly or arranged in random in the polymer.

Formula (IV)

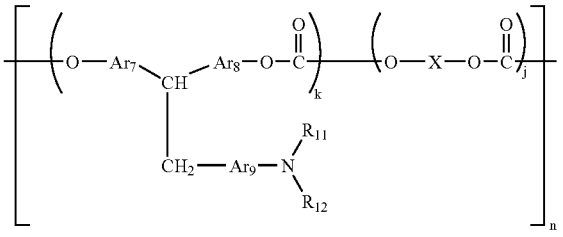

In Formula (IV), $R_{11}$, $R_{12}$ are substituted or unsubstituted aryl groups, $Ar_7$, $Ar_8$, $Ar_9$ are arylene groups which may be identical or different, p is an integer in the range of 1 to 5, X, k, j and n are the same as in Formula (I).

Formula (V)

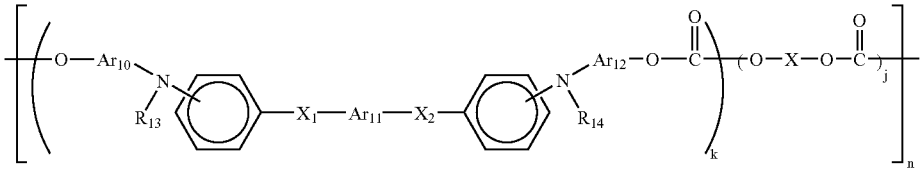

In Formula (V), $R_{13}$, $R_{14}$ are substituted or unsubstituted aryl groups, $Ar_{10}$, $Ar_{11}$, $Ar_{12}$ are arylene groups which may be identical or different, $X_1$, $X_2$ are substituted or unsubstituted ethylene groups, or substituted or unsubstituted vinylene groups. X, k, j and n are the same as in Formula (I).

Formula (VI)

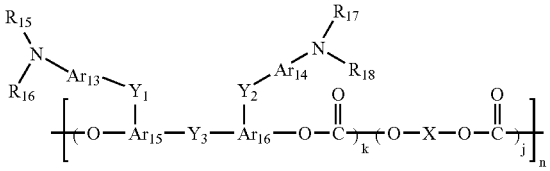

In Formula (VI), $R_{15}$, $R_{16}$, $R_{17}$, $R_{18}$ are substituted or unsubstituted aryl groups, $Ar_1$, $Ar_2$, $Ar_3$ are arylene groups which may be identical or different, $Y_1$, $Y_2$, $Y_3$ are single bond, substituted or unsubstituted alkylene groups, substituted or unsubstituted cycloalkylene groups, substituted or unsubstituted alkylene ether groups, oxygen atoms, sulfur atoms or vinylene groups. X, k, j and n are the same as in Formula (I).

Formula (VII)

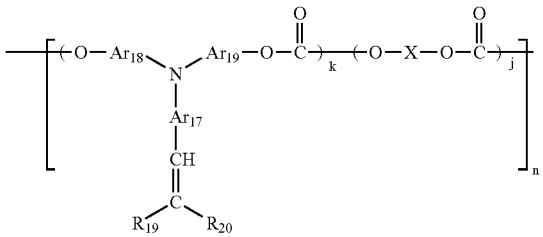

In Formula (VII), $R_{19}$, $R_{20}$ are hydrogen atoms, or substituted or unsubstituted aryl groups, and $R_{19}$, $R_{20}$ may form a ring. $Ar_{17}$, $A_{18}$, $A_{19}$ are arylene groups which may be identical or different. X, k, j and n are the same as in Formula (I).

Formula (VIII)

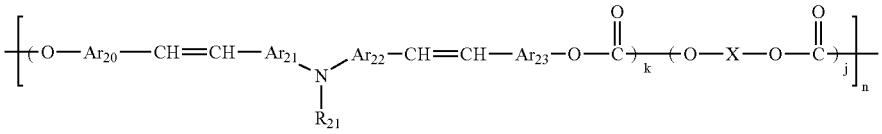

In Formula (VIII), $R_{21}$ is a substituted or unsubstituted aryl group, $Ar_{20}$, $Ar_{21}$, $Ar_{22}$, $Ar_{23}$ are arylene groups which may be identical or different, X, k, j and n are the same as in Formula (I).

Formula (IX)

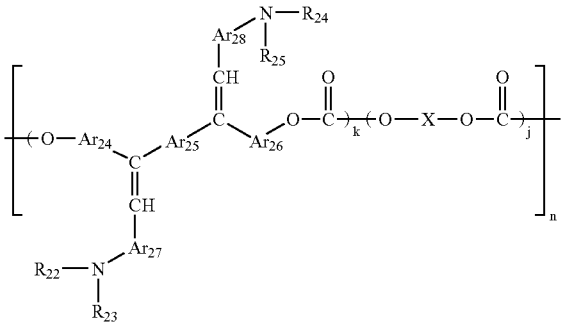

In Formula (IX), $R_{22}$, $R_{23}$, $R_{24}$, $R_{25}$ are substituted or unsubstituted aryl groups, $Ar_{24}$, $Ar_{25}$, $Ar_{26}$, $Ar_{27}$, $Ar_{28}$ are arylene groups which may be identical or different. X, k, j and n are the same as in Formula (I).

Formula (X)

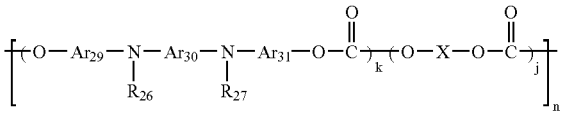

In Formula (X), $R_{26}$, $R_{27}$ are substituted or unsubstituted aryl groups, $Ar_{29}$, $Ar_{30}$, $Ar_{31}$ are arylene groups which may be identical or different. X, k, j and n are the same as in Formula (I).

The amount of the charge transporting substance is preferably 20 to 300 parts by mass, more preferably 40 to 150 parts by mass based on the 100 parts by mass of the binder resin. The layer thickness of the charge transporting layer is preferably 5 to 100 μm.

Examples of the suitable solvent for use include tetrahydrofuran, dioxane, toluene, dichloromethane, monochlorobenzene, dichloroethane, cyclohexanone, methyl ethyl ketone, acetone and the like.

In the photoconductor adapted to the present invention, the charge-transporting layer 67 may include additives such as plasticizers and leveling agents. Specific examples of the plasticizers include known plasticizers, which are used for plasticizing resins, such as dibutyl phthalate, dioctyl phthalate and the like. The added quantity of the plasticizer is 0 to 30% by mass based on the binder resin. Specific examples of the leveling agents include silicone oils such as dimethyl silicone oil, and methyl phenyl silicone oil; polymers or oligomers including a perfluoroalkyl group in their side chain, and the like. The added quantity of the leveling agents is 0 to 1% by mass of the binder resin included in the binder resin.

Preferably, the thickness of the charge transporting layer is 5 to 40 μm, more preferably 10 to 30 μm. On the resulting charge transporting layer, the crosslinked charge transporting layer is formed by coating the liquid for crosslinked charge transporting layer, and initiating the curing reaction through applying external energy such as heating and irradiating energy after optional drying step.

In the photoconductor according to the present invention, an intermediate layer may be disposed between the charge transporting layer and the crosslinked charge transporting layer in order to prevent the inclusion of the components from the charge transporting layer to the crosslinked charge transporting layer and to improve the adhesive property between the both layers. of the dewhen the surface crosslinked layer is the surface part of the photoconductive layer, a middle layer may be provided to inhibit introduction of the sublayer component to the surface crosslinked layer or improve the adhesion with the sublayer.

Therefore, a material insoluble or less soluble for the coating liquid of the crosslinked charge transporting layer is appropriate for the intermediate layer, in general, is based on a binder resin. Examples of the binder resin include polyamide, alcohol-soluble nylon, water-soluble polyvinyl butyral, polyvinyl butyral and polyvinyl alcohol. As for the method to form the intermediate layer, the conventional methods may be used. The thickness of the intermediate is preferably 0.05 to 2 μm.

In the photoconductor of the present invention, an undercoat layer may be provided between the conductive substrate 31 and the charge generating layer 35.

The undercoat layer is formed from resins in general. The resins are preferably solvent resistant against common solvent since photosensitive layer is coated on it using organic solvents.

Examples of the resin include water-soluble resins such as polyvinyl alcohol, casein, sodium polyacrylate, alcohol-soluble resins such as copolymer nylon and methoxymethylated nylon, and curing resins which form a three-dimensional network such as polyurethane, melamine resin, phenol resin, alkyd-melamine resin and epoxy resin.

Among these resins, curing resins are preferable since they are less susceptible to the effect of organic solvent elution owing to the cured condition during the coating step of photosensitive layer on the undercoat layer. When the blending ratio of the main component and the hardener is not appropriate, the volume shrinkage due to the curing may be significant, the defects of coated layer tend to generate, and the residual potential may possibly increase. In particular, the defects of the undercoat layer tend to promote the occurrence of black points and background smear, therefore, attentions should be given. For example, when alkyd-melamine resin is employed as the undercoat resin, the ratio of alkyd/melamine is preferably 5/5 to 8/2 by mass.

Also, metal oxide fine powder pigments such as titanium oxide, silica, alumina, zirconium oxide, tin oxide or indium oxide may also be added to the base layer to prevent Moire patterns, and to reduce residual potential. Among these, titanium oxide is most preferable from view points of the decrease of residual potential, prevention of Moire patterns, and suppression of background smear. In addition, metal oxides with high purity may be effective to prevent the increase of residual potential. The averaged primary particle size of the metal oxides is preferably 0.01 to 0.8 μm, more preferably 0.05 to 0.5 μm. However, when metal oxides having solely the particle size of 0.1 μm or less is employed, the background smear may be effectively reduced, whereas the effect to prevent the Moire patterns tends to be decreased; when metal oxides having solely the particle size of above 0.4 μm is employed, the effect to prevent the Moire patterns is significant, whereas the effect to reduce the background smear is likely to be reduced somewhat. In such cases, blending the metal oxides having different averaged primary particle size may satisfy both of the decrease of background smear and suppression of the Moire patterns, and also may be effective to reduce the residual potential.

The content of the metal oxides is preferably 1/1 to 3/1 as the volume ratio of metal oxides to binder resin. When the volume ratio is less than 1/1, the effect on the Moire patterns may be diminished and also the residual potential may increase remarkably. On the other hand, when the volume ratio is above 3/1, the peelings of layer may occur, and the effect on the background smear may be remarkably diminished.

These undercoat layer may be formed using a suitable solvent and coating method as for the above-mentioned charge transporting layer. A silane coupling agent, titanium coupling agent or chromium coupling agent, etc. can be used as the base layer of the present invention. $Al_2O_3$ prepared by anodic oxidation, organic materials such as polyparaxylylene (parylene) and inorganic materials such as $SiO_2$, $SnO_2$, $TiO_2$, ITO, $CeO_2$ prepared by the vacuum thin film-forming process, can be used for the base layer of the present invention. Other materials known in the art may also be used. The thickness of the undercoat layer is preferably 0.5 to 20 μm, more preferably 2 to 10 μm. When the thickness is less than 0.5 μm, the effect of background smear may possibly increase, when above 10 μm, the effect of increase of the residual potential may possibly be enlarged. The thickness of the undercoat layer may be effected by the specific resistance and the content, thicker layer may be possible when the specific resistance is lower or the content is considerably high. When the metal oxide is titanium oxide, the thickness is preferably 2 to 7 μm.

The metal oxide to be included into the undercoat layer is dispersed into an organic solvent with an optional binder resin to prepare a coating liquid. The dispersion may be carried out by a conventional device such as a ball mill, attriter, sand mill, or beads mill. Examples of the available organic solvent include tetrahydrofuran, methylethylketone, acetone, cyclohexane, toluene, and alcohols. As for the method to coat the undercoat layer, conventional method may be exemplified such as blade coating, dip coating, spray coating, ring coating, and bead coating.

In the present invention, anti-oxidants may be incorporated to the respective layers of crosslinked charge transporting layer, charge transporting layer, charge generating layer, undercoat layer, intermediate layer etc. in order to improve the environmental resistance, in particular to prevent the sensitivity decrease and the residual potential increase.

The anti-oxidant available for the respective layers may be exemplified as follows, but not limited to.

(a) Phenol compounds:

2,6-di-t-butyl-p-cresol, butyl hydroxy anisole, 2,6-di-t-butyl-4-ethyl phenol, n-octadecyl-3-4'-hydroxy-3-5-di-t-butyl phenol, 2,2-methylene-vis-(4-methyl-6-t-butyl phenol), 2,2-methylene-vis-(4-ethyl-6-t-butyl phenol), 4,4-thiovis-(3-methyl-6-t)-butyl phenol, 4,4-butylydenevis-(3-methyl-6-t-butyl phenol), 1,1,3-tri-(2-methyl-4-hydroxy 5-t-butyl phenyl) butane, 1,3,5-tri-methyl-2,4,6-tri-(3,5-di-t-butyl-4-hydroxy benzyl) benzene, tetrakis-[methylene 3-(3,5-di-t-butyl-4-hydroxy-phenyl)propionate]methane, vis-[3,3-vis-(4-hydroxy 3-t-butyl phenyl) butylic acid]glycolester, tocopherol, etc.

(b) Paraphenylene diamine compounds:

N-phenyl-N-isopropyl-p-phenylene diamine, N,N-di-sec-butyl-p-phenylene diamine, N-phenyl-N-sec-butyl-p-phenylene diamine, N,N-di-isopropyl-p-phenylene diamine, N,N-dimethyl-N,N-di-t-butyl-p-phenylene diamine, etc.

(c) Hydroquinone Compounds:

2,5-di-t-octyl hydroquinone, 2,6-di-dodecyl hydroquinone, 2-dodecyl hydroquinone, 2-dodecyl 5-chloro hydroquinone, 2-t-octyl 5-methyl hydroquinone, 2-(2-octadecenyl)-5-methyl hydroquinone, etc.

(d) Organosulfur compounds:

Dilauril-3,3-thiodipropionate, distearil-3,3-thiodipropionate, tetradecyl-3,3-thiodipropionate, etc.

(e) Organophosphorus compounds:

Triphenyl phosphine, tri(nonyl phenyl) phosphine, tri(dinonyl phenyl) phosphine, tri-cresil phosphine, tri(2,4-dibutyl phenoxy) phosphine, etc.

These compounds are known as the anti-oxidant of rubber, plastic, fatty and oil, are easily and commercially available. The content of the anti-oxidant is 0.01 to 10% by mass based on the total mass of the layer into which it is incorporated.

(Image Forming Apparatus and Image Forming Process)

The image forming apparatus adapted to utilize the intermediate transferring belt according to the present invention comprises a image bearing member, image forming unit, developing unit, transfer unit and fixing unit, and may further comprise the other units, for example, a charge-eliminating unit, cleaning unit, recycling unit and control unit, if required.

The image forming process adapted to utilize the intermediate transferring belt according to the present invention comprises a latent image forming step, developing step, transferring step and fixing step, and may further comprise the other steps, for example, a charge-eliminating step, cleaning step, recycling step and controlling step, if required.

Latent Image Forming Unit and Latent Image Forming Step

The latent image forming step is one which forms a latent image on the latent image bearing member or photoconductor.

The latent image bearing member or photoconductor is not particularly limited as to the material, shape, construction or size. For example, its shape may be drum-like, and its material may be that of an inorganic photoconductor, such as amorphous silicon or selenium, or an organic photoconductor such as polysilane or phthalopolymethane. Among these, amorphous silicon is preferred from the viewpoint of long life.

The latent image may be formed, for example, by uniformly charging the surface of the latent image bearing member, and irradiating it imagewise, which may be performed by the latent image forming unit.

The latent image forming unit, for example, comprises a charger which uniformly charges the surface of the latent image bearing member, and a light irradiator which exposes the surface of the latent image carrier imagewise.

The charging may be performed, for example, by applying a voltage to the surface of the latent image bearing member using the charger.

The charger may be suitably selected depending on the application, for example, contact chargers such as a conductive or semi-conductive roller, brush, film or rubber blade, and non-contact chargers using corona discharge such as corotron and scorotron are exemplified.

The light irradiation may be performed by irradiating the surface of the latent image bearing member imagewise, using the light irradiator for example.

The light irradiator may be suitably selected depending on the application provided that it may expose the surface of the latent image bearing member charged by the charger in the same way as the image to be formed, for example, a light irradiator such as copy optical system, rod lens array system, laser optical system and liquid crystal shutter optical system may be exemplified.

In addition, a backlight system may be employed wherein the latent image bearing member is exposed imagewise from its rear surface.

Developing Unit and Developing Step

The developing unit is not particularly limited provided that it may develop an image for example by using the developer, and may be suitably selected from among those known in the art. Examples are those which comprise an image-developer housing the developer, and which may supply the developer with contact or without contact to the latent image.

The developing step is one which develops the latent image using the developer to form a visible image.

The visible image may be formed for example by developing the latent image using the developer, which may be performed by the developing unit.

The image-developer may be the dry type or wet type, and may be a monochrome image-developer or a multi-color image-developer. Examples are units comprising a stirrer which charge the developer by friction stirring, and units comprising a rotatable magnet roller.

In the image-developer, the toner and the carrier may for example be mixed and stirred together. The toner is thereby charged by friction, and forms a magnetic brush on the surface of the rotating magnet roller. Since this magnet roller is arranged near the latent image bearing member or photoconductor, part of the toner in the magnetic brush formed on the surface of this magnet roller moves to the surface of this latent image bearing member or photoconductor due to the force of electrical attraction. As a result, the latent image is developed by this toner, and a toner image is formed on the surface of this latent image bearing member.

The developer to be housed in the image-developer is the developer containing the toner. The developer may be single-component or double-component developer.

Transferring Step and Transferring Unit

The transferring step is one which transfers the visible image to a recording medium. The primary transfer is performed such as, using the intermediate transferring belt according to the present invention as an intermediate transferring body, the visible image is primarily transferred to the intermediate transferring belt; and the second transfer is then performed wherein this visible image is secondarily transferred to a recording medium. Preferably, using toner of two or more colors and preferably full color toner, the primary transfer step transfers the visible image to the intermediate transferring belt form duplicated transfer images, and the second transfer step transfers the duplicated images to the recording medium.

The transfer can be realized, for example, by charging the latent image bearing member or photoconductor using a transferring charger, which can be performed by the transferring unit.

The transferring unit (the first transferring unit and the second transferring unit), preferably comprises an image-transferer which charges by releasing the visible image formed on the latent image bearing member or photo conductor to the recording-medium side. There may be one, two or more of the transferring unit.

The image-transferer may be a corona transfer unit which functions by corona discharge, a transfer belt, a transfer roller, a pressure transfer roller or an adhesion transfer unit.

The recording medium is typically plain paper, but is not specifically limited, may be selected depending on the application and includes, for example, a polyethylene terephthalate (PET) base for overhead projector (OHP).

The fixing step is one which fixes the visible image transferred to the recording medium using a fixing apparatus. This may be carried out for developer of each color transferred to the recording medium, or in one operation when the developers of each color have been laminated.

The fixing apparatus is not particularly limited and may be suitably selected from heat and pressure unit known in the art. Examples of heat and pressure unit are a combination of a heat roller and pressure roller, and a combination of a heat roller, pressure roller and endless belt.

The heating temperature in the heat-pressure unit is preferably 80° C. to 200° C.

Also, in the present invention, an optical fixing unit known in the art may be used in addition to or instead of the fixing step and fixing unit, depending on the application.

The charge-eliminating step is one which applies a discharge bias to the latent image bearing member to discharge it, which may be performed by a charge-eliminating unit.

The charge-eliminating may be suitably selected from charge-eliminating unit known in the art provided that it can apply a discharge bias to the latent image bearing member, for example, a discharge lamp.

The cleaning step is one which removes electrophotographic toner remaining on the latent image bearing member, and may be performed by a cleaning unit.

The cleaning unit may be suitably selected from cleaning unit known in the art provided that it can remove electrophotographic toner remaining on the latent image bearing member, for example, a magnetic brush cleaner, electrostatic brush cleaner, magnetic roller cleaner, blade cleaner, brush cleaner and web cleaner are exemplified.

The recycling step is one which recycles the electrophotographic toner removed by the cleaning step to the developing step, and may be performed by a recycling unit.

The controlling step is one which controls the respective processes, and may be properly implemented by a control unit.

The controlling unit is not particularly limited and may be suitably selected depending on the application provided that it can control the operation of each of the unit.

In the constitution of the color electrophotographic apparatus shown in FIG. 10, the image forming is achieved as follows. At first, photoconductors 51C, 51M, 51Y, 51K are charged by charging members 52C, 52M, 52Y, 52K rotating as the arrow direction, i.e. co-rotating direction with the photoconductor in the respective image forming elements 56C, 56M, 56Y, 56K, then the latent electrostatic images of the respective colors are produced through laser lights 53C, 53M, 53Y, 53K irradiated from the light-exposing part (not shown). Then, toner images are formed through developing the latent images by developing units 54C, 54M, 54Y, 54K. The developing units 54C, 54M, 54Y, 54K respectively conduct developing by the toner of C(cyan), M(magenta), Y(yellow), K(black), and the toner images of the respective colors formed on the four photoconductors 51C, 51M, 51Y, 51K are overlapped on the transferring paper. The transferring paper 57 is sent from the tray by means of feeding paper roller 58, is stopped at a moment by means of a pair of resist roller 59, then is sent to transfer conveying belt 60 while adjusting a timing with the image forming on the photoconductor. The transferring paper 57 sustained on transfer conveying belt 60 is conveyed, and the transfer with the respective color images is carried out at the contacting site or position with the respective photoconductor 51C, 51M, 51Y, 51K.

The toner images on the photoconductors are transferred on transferring paper 57 by the electric field formed by the potential difference between the transferring bias applied on transferring brush 61C, 61M, 61Y, 61K and photoconductor 51C, 51M, 51Y, 51K. Then, recording paper 57 having toner images of four colors overlapped at the four transferring portions is conveyed to fixing apparatus 62, where the toner is fixed, then the recording paper 57 is conveyed out to the discharged paper portion (not shown). The residual toner on the respective photoconductors 51C, 51M, 51Y, 51K, having not been transferred at the transferring portions, is recovered by the cleaning devices 55C, 55M, 55Y, 55K.

Figure 10:
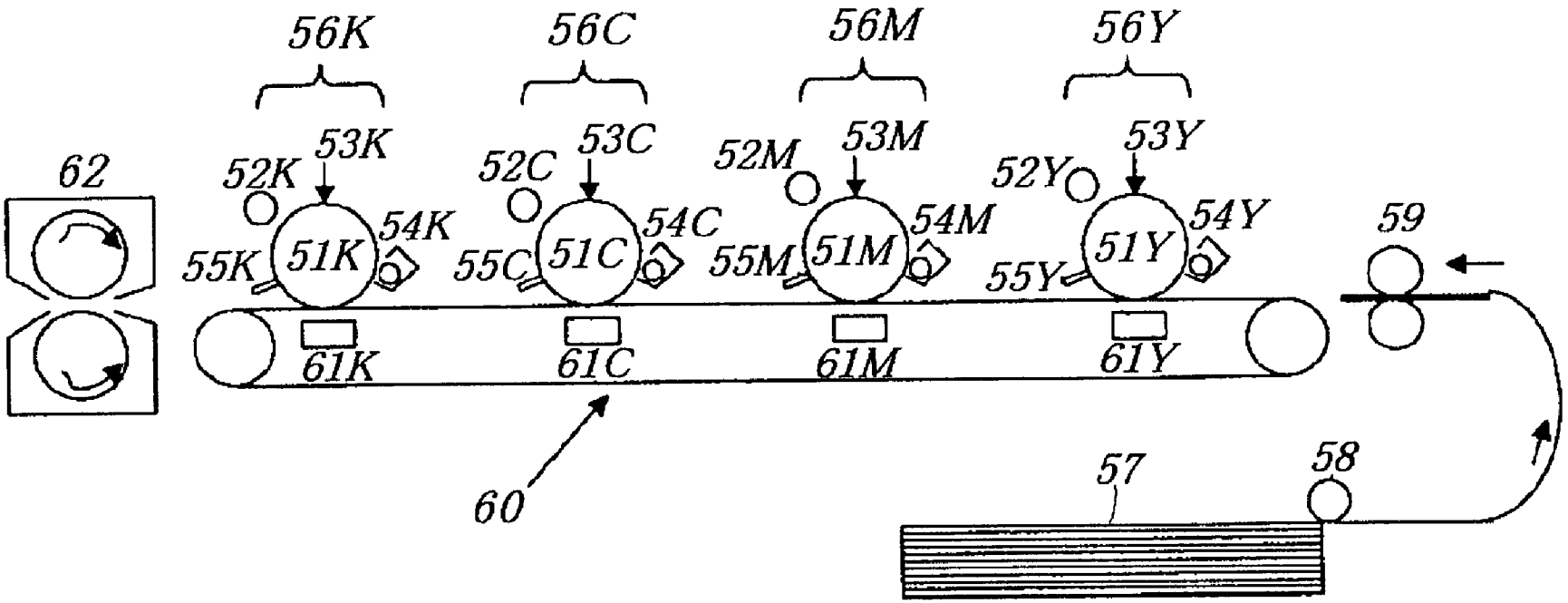
FIG. 10 schematically shows a tandem type of full-color image forming apparatus adapted to the present invention.

As for the image forming elements shown in FIG. 10, the color is arranged Y(yellow), M(magenta), C(cyan), K(black) in order from upstream to downstream of the conveying direction of the recording paper. The order is not necessarily defined as such and may be arranged optionally. In addition, when the prints with only black color are required, the mechanism that the colors other than black (56C, 56M, 56Y) being stopped may be effectively arranged in the present invention.

The inventive apparatus for forming electrophotographic image will be explained.

The image forming process and image forming apparatus according to the present invention are characterized in employing the photoconductor according to the present invention; the photoconductor contains in the charge generating layer titanyl phthalocyanine crystal particles that exhibit a highest peak at 27.2°, main peaks at 9.4°, 9.6° and 24.0°, a peak at 7.3° as the lowest angle, and with no peaks in a range between 7.3° and 9.4°, and with no peak at 26.3° as Bragg 2θ angles in terms of CuK-α characteristic X-ray wavelength at 1.542 Å, and the averaged primary particle size is 0.25 μm or less; the crosslinked charge transporting layer is formed by curing a radical polymerizable monomer having three or more functionalities and no charge transporting structure and a radical polymerizable compound having one functionality and a charge transporting structure, wherein the layer thickness of the crosslinked charge transporting layer is 1 to 10 μm. The image forming process and image forming apparatus comprises charging, exposing irradiation on images, developing, transferring a toner image onto an image support or transferring paper, fixing, and cleaning of the photoconductor surface. In some cases, an electrophotographic photoconductor is not necessary when electrostatic latent images are directly transferred to a transferring body and images are developed.

Figure 8:
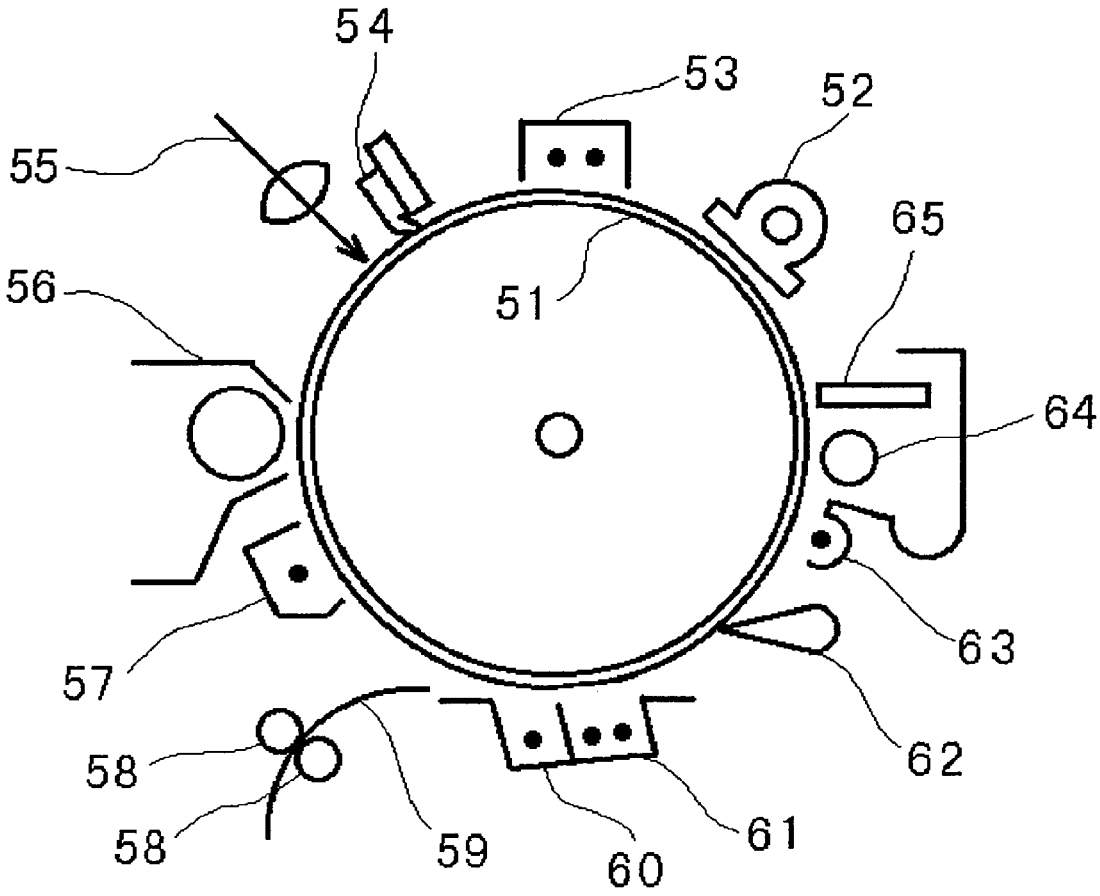
FIG. 8 schematically shows an exemplary image forming apparatus according to the present invention.

FIG. 8 is a schematic view illustrating an example of the image forming apparatus. A charging charger 53 is used as a charging unit for evenly charging a photoconductor. Examples of the charging unit include a corotron device, a scorotron device, a solid discharging device, a pin electrode device, a roller charging device, a conductive brush device and the like and employed according to a known process.

Particularly, the construction of the image forming apparatus is effective when a charging unit is employed by which the photoconductor composition is composed due to the close discharge from the charging unit of a contact charging type or non-contact close charging type. Here, the contact charging type refers to a charging process carried out by directly contacting a charging roller, charging brush, or charging blade to the photoconductor. The close charging type refers to a charging process, for example, a charging roller is located in non-contact state at distance of 200 μm or less from the surface of the photoconductor. When the distance is excessively great, the charging may be unstable while when it is excessively small, the surface of the charging member may be stained by toner remaining on the photoconductor. Therefore, the distance is suitably in the range of 10 to 200 μm, preferably 10 to 100 μm.

The image exposing portion 55 for forming an electrostatic latent image on electrophotographic photoconductor 51 charged evenly will be explained in the following.

As for the light source, light emitters such as a fluorescent lamp, tungsten lamp, halogen lamp, mercury lamp, sodium lamp, light emitting diode (LED), semiconductor laser (LD), and electro luminescence may be employed. For providing light only at the desired spectral region, filters such as a sharply cutting filter, bandpass filter, near-infrared cutting filter, dichroicfilter, interference filter, and conversion filter for color temperature may be employed.

Among these light sources, LED and LD are appropriately utilized since the irradiating energy is higher, and these irradiate longer wavelength of 600 to 800 nm to which the titanyl phthalocyanine is highly sensitive.

The developing unit 56 for visualize latent electrostatic images formed on the photoconductor 51 will be explained in the following.

The developing process may be a one-component developing process or a two-component developing process using a dry toner, or a wet developing process using a wet toner. When a positive (negative) charge is given to the photoconductor and image exposure is performed, a positive (negative) electrostatic latent image will be formed on the photoconductor surface. If this is developed with a toner (charge detecting particles) of negative (positive) polarity, a positive image will be obtained, and a negative image will be obtained if the image is developed with a toner of positive (negative) polarity.

Further, transferring charger 60 is employed to transfer the visualized toner image from the photoconductor to transferring body 59. Also, in order to more effectively carry out the transferring, pre-transfer charger 57 may be used. For the transferring, the electrostatic transferring using a transfer charger and a bias roller, the mechanical transferring process such as adhesion transfer, pressure transfer and the like, or the magnetic transferring process can be used. By the electrostatic transferring process, the foregoing charging means can be used.

Also, separation charger 61 or separation claw 62 is utilized as a means to separate transferring body 59 from the photoconductor 51. Other separations which can be used include stripping by electrostatic adsorption-induction, stripping using a side belt, stripping by tip grip transportation, self stripping and the like. As the separation charger 61, the charging unit can be employed.

Fur brush 64 and cleaning blade 65 are employed to remove the toner remaining on the photoconductor after the transferring. Also, in order to more effectively carry out the cleaning, a pre-cleaning charger 63 may be used. Other cleaning means include the wave process, magnet brush process and the like, which may be used alone or in combination.

If necessary, a discharging unit may be employed to remove the latent image on the photoconductor. The discharging means that can be used includes a discharging lamp 52 and a discharging charger, which use the light source for light exposure and the charging unit, respectively.

In addition, processes for script reading, paper supplying, fixing, paper releasing and the like are those known to the art.

The present invention is directed to an image forming process using an electrophotographic photoconductor in an image forming unit and an image forming apparatus.

Figure 9:
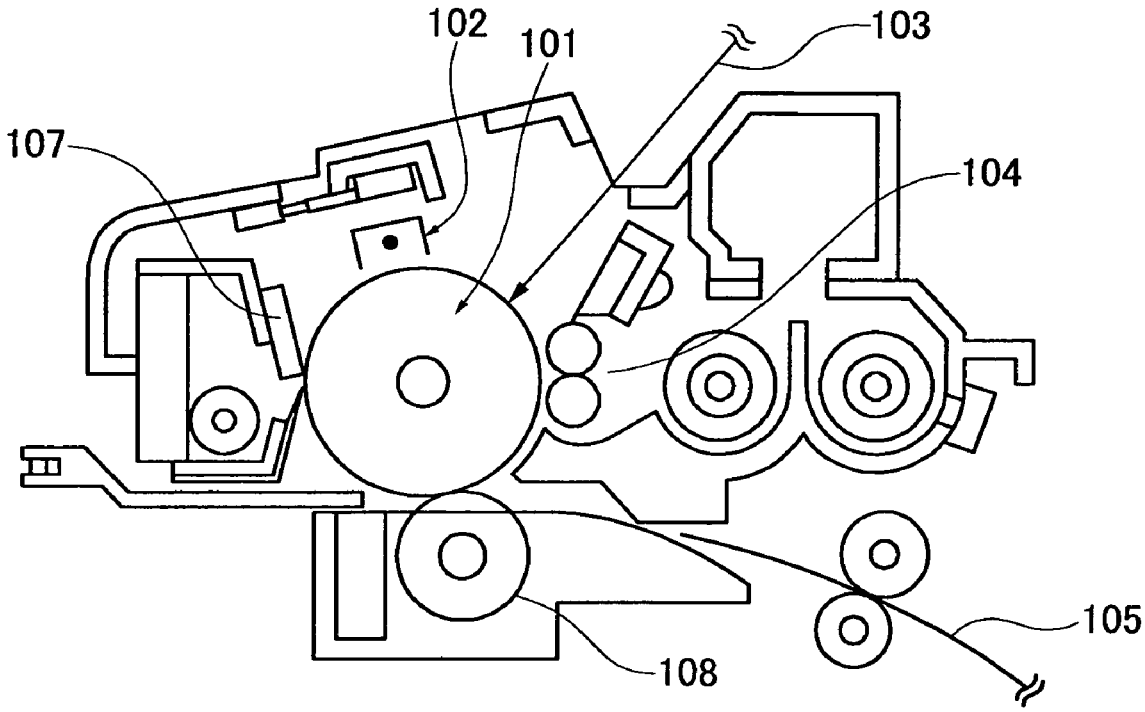
FIG. 9 schematically shows a process cartridge according to the present invention.

The image forming unit may be incorporated into copying devices, fax machines and printers, or they may be built into these devices in the form of a process cartridge which can be freely attached or removed. FIG. 9 shows an example of a process cartridge.

The process cartridge for an image forming apparatus comprises a photoconductor 101, and at least one of a charging unit 102, a development unit 104, a transferring unit 106, a cleaning unit 107 and discharging unit (not shown) and is a device (part) adapted to be attached to or detached from a main body of the image forming apparatus.

Referring to the image forming process by the apparatus shown in FIG. 9, the photoconductor 101, while rotating in the arrow direction, is charged by the charging unit 102, light-exposed by a light exposing unit 103 to form an electrostatic latent image corresponding to the exposed image on its surface. The electrostatic latent image is developed with a toner by the development unit 104. The toner image is transferred to a transfer material by the transferring unit 106 to be printed out. Subsequently, after the image transferring, the surface of the photoconductor is cleaned by the cleaning unit 107 and discharged by a discharging unit (not shown). Again, the foregoing procedures are repeated.

As clearly seen from the above description, the electrophotographic photoconductor according to the present invention can be widely used in an electrophotographic copier and also, in applied electrophotography fields such as laser beam printer, CRT printer, LED printer, liquid crystal printer and laser engraving.

The present invention will be illustrated in more detailed with reference to examples given below, but these are not to be construed as limiting the present invention. All percentages and parts are by mass unless indicated otherwise.

COMPARATIVE SYNTHETIC EXAMPLE 1

Charge Generating Substance

A pigment was synthesized referring to JP-A No. 2001-19871.

Initially, 29.2 parts of 1,3-diiminoiso indoline and 200 parts of sulfolane were mixed, and 20.4 parts of titanium tetrabutoxide was dripped in nitrogen gas atmosphere. After the drip-feed was completed, the raw material was raised to 180° C. gradually, and allowed to react for five hours with stirring while keeping the temperature 170 to 180° C. After the reaction was completed and allowed to cool, the resulting precipitation was filtered, the filter cake was washed with chloroform till the cake turned to blue. Then the filter cake was washed a few times with methanol, and was washed a few times with 80° C. hot water then dried, thereby crude titanyl phthalocyanine was prepared.

Then the crude titanyl phthalocyanine was dissolved into concentrated sulfuric acid having twenty times the mass of the crude titanyl phthalocyanine, the solution was dripped into ice-water having one hundred times the mass of the solution while the solution being stirred, the precipitated crystal was filtered, then water washings were repeated till pH of the filtrate came to neutral, i.e. the pH of the washed de-ionized water was 6.8. As a result, titanyl phthalocyanine pigment was prepared as the wet cake or water paste.

The resulting wet cake or water paste of 20 parts was put into 200 parts of tetrahydrofuran, was stirred for four hours, then filtered and dried, resulting in titanyl phthalocyanine powder. The titanyl phthalocyanine powder was referred to as "pigment 1". The solid content in the wet cake was 15% by mass. The solvent for crystal transformation was 33 times the mass of the wet cake. By the way, the raw materials of Comparative Synthetic Example 1 contained no halide.

Figure 11:
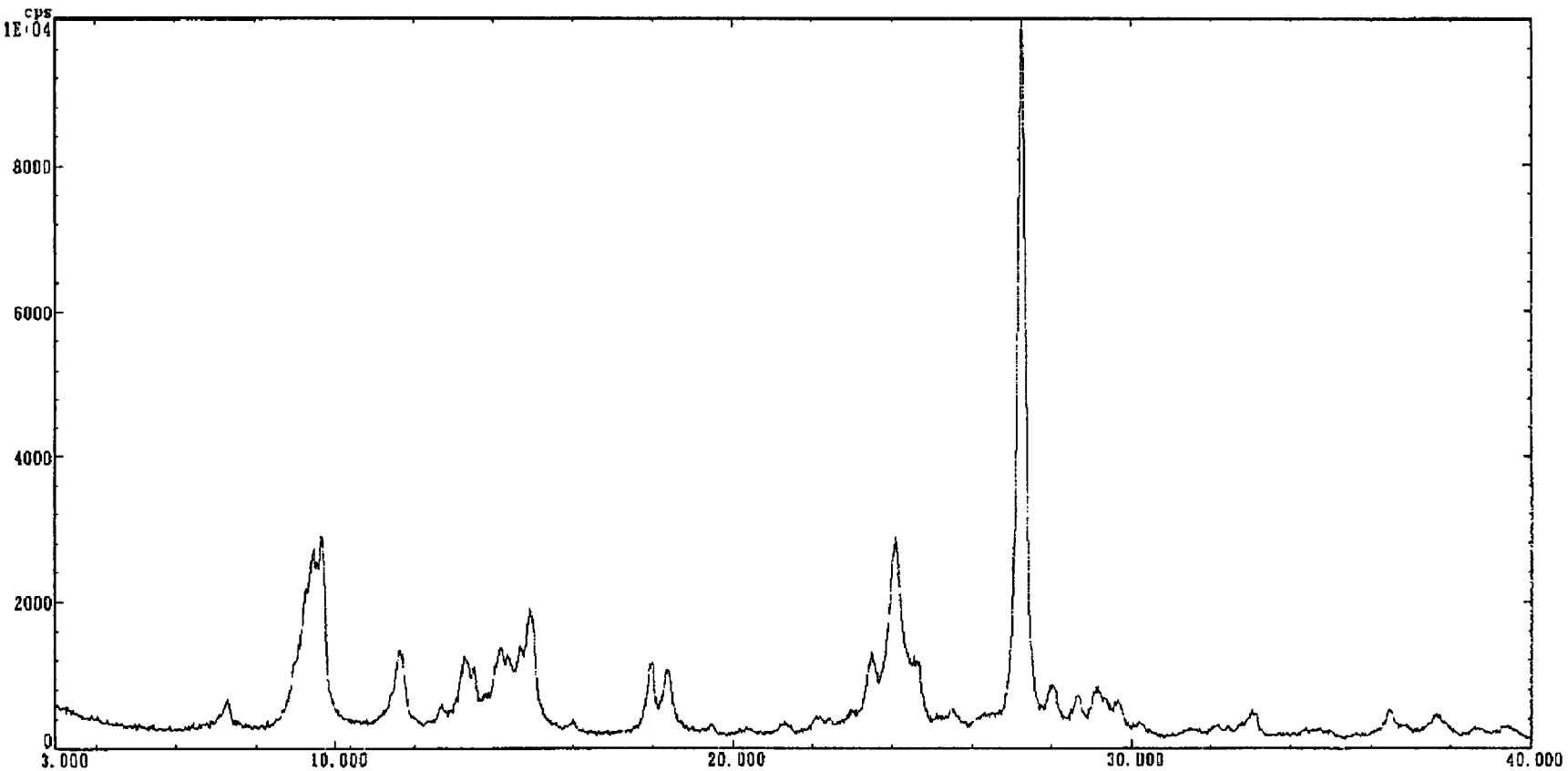
FIG. 11 shows an X-ray diffraction spectrum of titanyl phthalocyanine particles obtained in Comparative Synthetic Example 1.

The resulting titanyl phthalocyanine powder was measured as to X-ray diffraction spectrum in the following conditions, and the titanyl phthalocyanine powder exhibit the highest peak at 27.2°, the main peaks at 9.4°, 9.6° and 24.0°, the peak at 7.3° as the lowest angle, and with no peaks in a range between 7.3° and 9.4°, and with no peak at 26.3° as Bragg 2θ angles in terms of CuK-α characteristic X-ray wavelength at 1.542 Å. The result is shown in FIG. 11.

Figure 12:
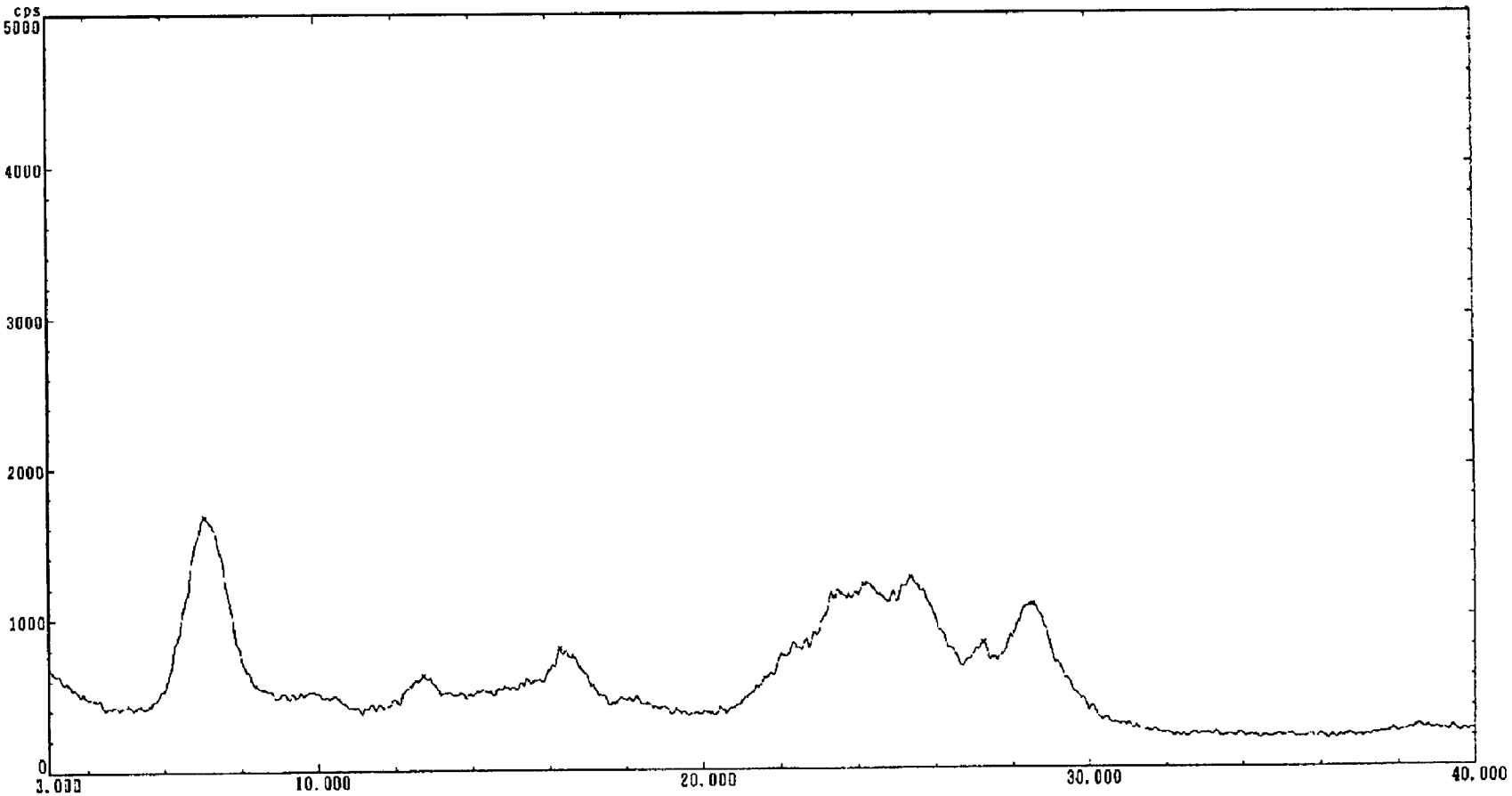
FIG. 12 shows an X-ray diffraction spectrum of titanyl phthalocyanine powder with lower crystallinity obtained by drying the water paste in Comparative Synthetic Example 1.

Further, a part of the water paste obtained in Comparative Synthetic Example 1 was dried at 80° C. under evacuated pressure of 5 mm Hg for two days, thereby titanyl phthalocyanine powder with lower crystallinity was obtained. X-ray diffraction spectrum of the titanyl phthalocyanine powder with lower crystallinity is shown in FIG. 12.

| (Measuring Conditions for X-ray Diffraction Spectrum) | |
|---|---|
| X-ray tube: | Cu |
| Voltage: | 50 kV |
| Current: | 30 mA |
| Scanning speed: | 2°/min |
| Scanning range: | 3° to 40° |
| Time constant: | 2 seconds |

COMPARATIVE SYNTHETIC EXAMPLE 2

Charge Generating Substance

A pigment was synthesized referring to Synthetic Example 1 of JP-A No. 1-299874 (Japanese Patent (JP-B) No. 2512081). That is, the wet cake obtained in Comparative Synthetic Example 1 described above was dried, one part of the dried product was added to 50 parts of polyethylene glycol, then the mixture was subjected to milling by a sand mill with 100 parts of glass beads.

After subjecting to crystal transformation, the cake was rinsed with dilute sulfuric acid, and ammonium hydroxide in turn, then was dried to prepare a pigment, which is referred to as pigment 2. The raw materials of Comparative Synthetic Example 2 contained no halide.

COMPARATIVE SYNTHETIC EXAMPLE 3

Charge Generating Substance

A pigment was synthesized referring to Synthetic Example 1 of JP-A No. 3-269064 (Japanese Patent (JP-B) No. 2584682). That is, the wet cake obtained in Comparative Synthetic Example 1 described above was dried, one part of the dried product was added to a mixed solvent of 10 parts of de-ionized water and 1 part of monochlorobenzene and was stirred for one hour at 50° C., then was rinsed with methanol and de-ionized water to obtain a pigment after drying, which is referred to as pigment 3. The raw materials of Comparative Synthetic Example 3 contained no halide.

COMPARATIVE SYNTHETIC EXAMPLE 4

Charge Generating Substance

A pigment was synthesized referring to Synthetic Example 1 of JP-A No. 2-8256 (JP-B No. 7-91486). That is, 9.8 parts of phthalodinitrile and 75 parts of chloronaphthalene were mixed and stirred, and 2.2 parts of titanium tetrachloride was dripped in nitrogen gas atmosphere.

After the drip-feed was completed, the raw material was raised to 200° C. gradually, and was allowed to react for 3 hours with stirring while keeping the temperature 200 to 220° C. After the reaction was completed and allowed to cool, the resulting precipitation was filtered at 130° C., the filter cake was washed with 1-chloronaphthalene till the cake turned to blue. Then the filter cake was washed a few times with methanol, and was washed a few times with 80° C. hot water then dried to prepare a pigment, which is referred to as pigment 4. The raw materials of Comparative Synthetic Example 4 contained no halide.

COMPARATIVE SYNTHETIC EXAMPLE 5

Charge Generating Substance

A pigment was synthesized referring to Synthetic Example 1 of JP-A No. 64-17066 (JP-B No. 7-97221). That is, 5 parts of alpha form TiOPc along with 10 parts of common salt and 5 parts of acetophenone were subjected to crystal transformation at 100° C. for 10 hours using a sand grinder.

The product was washed with de-ionized water and methanol, purified with dilute aqueous sulfuric acid, and washed with de-ionized water till the acid component disappeared, then dried to prepare a pigment, which is referred to as pigment 5. The raw materials of Comparative Synthetic Example 5 contained halide.

COMPARATIVE SYNTHETIC EXAMPLE 6

Charge Generating Substance

A pigment was synthesized referring to Synthetic Example 1 of JP-A No. 11-5919 (JP-B No. 3003664). That is, 20.4 parts of o-phthalodinitrile and 7.6 parts of titanium tetrachloride were allowed to react in 50 parts of quinoline for 2 hours, the solvent was removed by steam distillation, then the product was purified with 2% aqueous solution of hydrochloric acid and subsequently with 2% aqueous solution of sodium hydroxide, thereafter rinsed with methanol and N,N-dimethylformamide, and dried to obtain phthalocyanine. Two parts of the phthalocyanine was dissolved little by little into 40 parts of 98% sulfuric acid at 5° C., and the solution was stirred for about one hour while maintaining the temperature at 5° C. or less.

Then, the sulfuric acid solution was slowly poured into 400 parts of ice water under rapid stirring, the deposited crystal was filtered. The crystal was rinsed with distilled water till the remaining acid disappeared to obtain a wet cake.

The wet cake was stirred in 100 parts of THF for about 5 hours, thereafter filtered and rinsed with THF, then dried to prepare a pigment, which is referred to as pigment 6. The raw materials of Comparative Synthetic Example 6 contained halide.

COMPARATIVE SYNTHETIC EXAMPLE 7

Charge Generating Substance

A pigment was synthesized referring to Synthetic Example 1 of JP-A No. 3-255456 (JP-B No. 3005052). That is, 10 parts of the wet cake synthesized in Comparative Synthetic Example 1 was added to 15 parts of sodium chloride and 7 parts of diethylene glycol, and was subjected to milling for 60 hours while heating at 80° C. by means of an auto-mortar. Then the cake was subjected to sufficient rinsing with water to remove the sodium chloride and diethylene glycol.

After drying the product under a reduced pressure, 200 parts of cyclohexane and glass beads of 1 mm in diameter were added, and was subjected to milling for 30 minutes by means of a sand mill to obtain a pigment, which is referred to as pigment 7. The raw materials of Comparative Synthetic Example 7 contained no halide.

COMPARATIVE SYNTHETIC EXAMPLE 8

Charge Generating Substance

A pigment was synthesized referring to the process for producing titanyl phthalocyanine crystal described in JP-A No. 52-36016. That is, 58 parts of 1,3-diiminoisoindoline and 51 parts of tetrabutoxy titanium were allowed to react in 300 parts of alpha-chloronaphthalene at 210° C. for 5 hours, thereafter the product was rinsed with alpha-chloronaphthalene and dimethylformamide (DMF) in order. Then the product was rinsed with hot DMF, hot water, and methanol then dried to obtain 50 parts of titanyl phthalocyanine.

The resulting titanyl phthalocyanine of 4 parts was poured into 400 parts of sulfuric acid cooled at 0° C. and was stirred one hour successively. After the titanyl phthalocyanine dissolved completely, the solution was poured into a mixed liquid of 800 parts of water and 800 parts of toluene cooled at 0° C. After stirring for 2 hours at room temperature, the deposited titanyl phthalocyanine was filtered away from the solution, and was rinsed with methanol and water in order. Confirming that the rinsed water was neutral in pH, the titanyl phthalocyanine crystal was removed and dried to obtain 2.9 parts of titanyl phthalocyanine crystal, which is referred to as pigment 8. The raw materials of Comparative Synthetic Example 8 contained no halide.

SYNTHETIC EXAMPLE 1

Charge Generating Substance

A titanyl phthalocyanine pigment was synthesized in a form of water paste in the similar Comparative Synthetic Example 1, the product was subjected to crystal transformation in accordance with the following way, to prepare a titanyl phthalocyanine crystal having smaller primary particle size than Comparative Synthetic Example 1.

To the 60 parts of water paste, obtained in Comparative Synthetic Example 1, prior to the crystal transformation, 400 parts of tetrahydrofuran was added and was stirred vigorously at 2000 rpm by means of Homomixer (Model Mark IIf, by Kenis). The stirring was stopped when the color of the paste turned from dark blue to light blue after 20 minutes from starting the stirring, immediately then the filtering was conducted under a reduced pressure. The crystal obtained on the filter was rinsed with tetrahydrofuran to obtain a wet cake of pigment.

The wet cake was dried at 70° C. under a reduced pressure of 5 mm Hg for 2 days, thereby 8.5 parts of titanyl phthalocyanine crystal was recovered, which is referred to as pigment 9. The raw materials of Synthetic Example 1 contained no halide. The solid content of the wet cake was 15% by mass, the solvent for crystal transformation was 44 times the mass of the wet cake.

A part of the titanyl phthalocyanine of water paste before crystal transformation, obtained in Comparative Synthetic Example 1, was diluted into about 1% by mass using de-ionized water. Scooping up the upper portion of the dispersion by a cupper mesh, of which surface was treated into conductive, the titanyl phthalocyanine was observed with respect to the particle size at a magnification of 75000 times by means of a transmission electron microscope (TEM, Model H-9000NAR, by Hitachi Co.). The averaged primary particle size was determined as follows.

The observed TEM images were taken as TEM photographs, then 30 particles were randomly selected from the visually observed titanyl phthalocyanine particles having needle-like shape, the longer diameters of the respective particles were measured, and the average of the longer diameter of the 30 particles was defined as the averaged primary particle size.

The averaged primary particle size of the titanyl phthalocyanine of Comparative Synthetic Example 1 was 0.06 μm at the state of water paste according to the method for determining the averaged primary particle size descried above.

Also, the titanyl phthalocyanine crystal after the crystal transformation and before the filtering of Comparative Synthetic Example 1 and Synthetic Example 1 were diluted to about 1% by mass using tetrahydrofuran, and the TEM images were observed and the averaged primary particle sizes were measured. The results were shown in Table 1.

The titanyl phthalocyanine particles obtained in Comparative Synthetic Example 1 and Synthetic Example 1 had not necessarily the same shape, i.e. particles of approximately triangle or quadrangle shape were also observed. Accordingly, the longest diagonals of the respective particles were regarded as the longer diameter then the averaged particle size was calculated. As shown in Table 1, the pigment 1 obtained in Comparative Synthetic Example 1 had a relatively large averaged particle size and also contained coarse particles. On the contrary, the pigment 9 obtained in Synthetic Example 1 had a relatively small averaged particle size and also the individual primary particles were approximately of the similar size.

TABLE 1

| | Averaged Primary Particle Size (μm) | Remarks |
|---|---|---|
| Comp. Synthetic Example 1 (Pigment 1) | 0.31 | containing coarse particles of about 0.3 to 0.4 μm |
| Synthetic Example 1 (Pigment 9) | 0.12 | particles are approximately of the similar size |

The pigments of Comparative Synthetic Examples 2 to 8 were measured with respect to X-ray diffraction spectrum and the respective identities were confirmed with the spectra described in the references.

The X-ray diffraction spectrum of the pigment obtained in Synthetic Example 1 was substantially the same with that of Comparative Synthetic Example 1. Table 2 shows the peak sites and characteristics of the spectra in Comparative Synthetic Examples 1 to 8 and Synthetic Example 1.

TABLE 2

| | Pigment | Highest Peak | Lowest Angle | Peak at 9.4° | Peak at 9.6° | Peak 7.4° to 9.4° | Peak at 24.0° | Peak at 26.3° |
|---|---|---|---|---|---|---|---|---|
| Comp. Synthetic Ex. 1 | 1 | 27.2° | 7.3° | Exist | Exist | No | Exist | No |
| Comp. Synthetic Ex. 2 | 2 | 27.2° | 7.3° | No | No | No | Exist | No |
| Comp. Synthetic Ex. 3 | 3 | 27.2° | 9.6° | Exist | Exist | No | Exist | No |
| Comp. Synthetic Ex. 4 | 4 | 27.2° | 7.4° | No | Exist | No | No | No |
| Comp. Synthetic Ex. 5 | 5 | 27.3° | 7.3° | Exist | Exist | Exist (7.5°) | Exist | No |
| Comp. Synthetic Ex. 6 | 6 | 27.2° | 7.5° | No | Exist | Exist (7.5°) | Exist | No |
| Comp. Synthetic Ex. 7 | 7 | 27.2° | 7.4° | No | No | Exist (9.2°) | Exist | Exist |
| Comp. Synthetic Ex. 8 | 8 | 27.2° | 7.3° | Exist | Exist | No | Exist | No |
| Synthetic Ex. 1 | 9 | 27.2° | 7.3° | Exist | Exist | No | Exist | No |

Examples of compounds having one functionality and a charge transporting structure adapted to the crosslinked charge transporting layer will be explained.

<Example of Synthesizing Compounds Having One Functionality and Charge Transporting Structure>

The compounds having one functionality and a charge transporting structure adapted to the present invention may be synthesized, for example, by the process described in Japanese Patent No. 3164426. An Example is described below.

(1) Synthesis of Hydroxy Group-Substituted Triarylamine Compound of Formula B 113.85 parts or 0.3 mol of methoxy group-substituted triarylamine compound of Formula A and 138 parts or 0.92 mol of sodium iodide are added to 240 parts of sulfolane and heated to 60° C. within nitrogen gas flow. In the solution, 99 parts or 0.91 mol of trimethylchlorosilane is dropwisely added for 1 hour and stirred at about 60° C. for 4.5 hours, and the reaction was stopped. About 1500 parts of toluene was added to the reactant, cooled to room temperature, and repeatedly rinsed with water and an aqueous sodium carbonate solution.

Then, the solvent was removed from the solution and the residue was purified by means of a column chromatography (adsorption medium: silica gel, developing solvent: toluene/ethyl acetate=20/1). The resulting light yellow oil was crystallized with adding cyclohexane. Consequently, 88.1 parts of white crystal having Formula B was obtained in the yield of 80.4%.

melting point: 64.0 to 66.0° C.

TABLE 3

| Element analysis (%) | C | H | N |
|---|---|---|---|
| Measured | 85.06 | 6.41 | 3.73 |
| Calculated | 85.44 | 6.34 | 3.83 |

Formula A

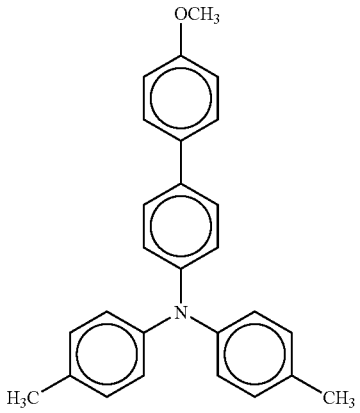

TABLE 3-continued

| Element analysis (%) | C | H | N |
|---|---|---|---|

Formula B

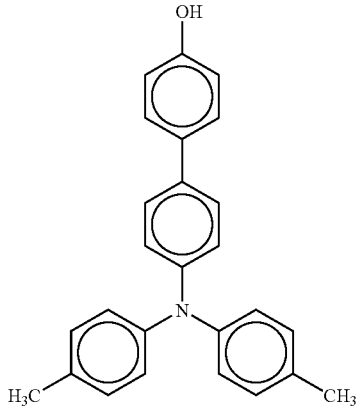

(2) Triarylamino Group-Substituted Acrylate Compound (Compound No. 54)

The hydroxy group-substituted triarylamine compound having Formula B of 82.9 parts or 0.227 mol obtained in above (1) was dissolved in 400 parts of tetrahydrofuran, and an aqueous sodium hydroxide solution, containing 12.4 parts of NaOH and 100 parts of water, was dropwisely added thereto. The resulting solution was cooled to 5° C. and 25.2 parts or 0.272 mol of acrylic acidchloride was added thereto over 40 minutes. Then, the reactant was stirred at 5° C. for 3 hours and the reaction was made finished. The reaction product was poured into water and was extracted with toluene. The extract was repeatedly rinsed with an aqueous sodium bicarbonate solution and is water. The solvent was removed from the solution and the residue was purified by means of a column chromatography (adsorption medium: silica gel, developing solvent: toluene). The resulting colorless oil was crystallized with n-hexane. Consequently, 80.73 parts of white crystal of the comound No. 54 was obtained with the yield of 84.8%.

melting point: 117.5 to 119.0° C.

TABLE 4

| | Element analysis (%) | | |
|---|---|---|---|
| | C | H | N |
| Measured | 83.13 | 6.01 | 3.16 |
| Calculated | 83.02 | 6.00 | 3.33 |

PREPARATION EXAMPLE 1

Dispersion

The pigment 1, prepared in Comparative Synthetic Example 1, was dispersed in the following conditions to prepare a dispersion of coating liquid for charge generating layer.

| | |
|---|---|
| Pigment of titanyl phthalocyanine (Pigment 1) | 15 parts |
| Polyvinyl butyral (BX-1, Sekisui Chemical Co.) | 10 parts |
| 2-butanone | 280 parts |

Using a commercially available dispersing apparatus of beads mill type and PSZ balls of 0.5 mm in diameter, the pigment, polyvinyl butyral, and 2-butanone was poured into the dispersing apparatus, and subjected to dispersing for 30 minutes at 1200 rpm of rotor rotating number to prepare a dispersion, which is referred to as dispersion 1.

PREPARATION EXAMPLES 2 TO 9

Dispersion

Dispersions were prepared in the same manner as Preparation Example 1, except for changing the pigment 1 into the pigments 2 to 9 obtained in Comparative Synthetic Example 2 to 8 and Synthetic Example 1, which are referred to as dispersions 2 to 9 corresponding to the number of pigments.

PREPARATION EXAMPLE 10

Dispersion

The dispersion 1 of Preparation Example 1 was filtered by means of a cotton-wind cartridge filter (effective pore size: 1 μm, TCW-1-CS, by Advantec Co.), which is referred to as dispersion 10. The filtering was carried out under a pressurized condition using a pump.

PREPARATION EXAMPLE 11

Dispersion

A dispersion was prepared in the same manner as Preparation Example 10, except for changing the filter into a cotton-wind cartridge filter (effective pore size: 3 μm, TCW-3-CS, by Advantec Co.) under a pressurized condition using a pump, which is referred to as dispersion 11.

PREPARATION EXAMPLE 12

Dispersion

A dispersion was prepared in the same manner as Preparation Example 10, except for changing the filter into a cotton-wind cartridge filter (effective pore size: 5 μm, TCW-5-CS, by Advantec Co.) under a pressurized condition using a pump, which is referred to as dispersion 12.

PREPARATION EXAMPLE 13

Dispersion

Dispersion was prepared in the same manner as Preparation Example 1, except for changing the dispersing condition into 1000 rpm of rotor rotating number for 20 minutes, which is referred to as dispersion 13.

PREPARATION EXAMPLE 14

Dispersion

The dispersion of Preparation Example 13 was filtered by means of a cotton-wind cartridge filter (effective pore size: 1 μm, TCW-1-CS, by Advantec Co.). The filtering was carried out under a pressurized condition using a pump. The filter was plugged during the filtering, consequently, all of the dispersion could not be filtered, therefore, the subsequent evaluation could not be conducted also.

The particle distribution of the prepared dispersions was determined by means of CAPA-700 (by Horiba Co.). The results are shown in Table 5.

TABLE 5

| | Averaged Particle Size μm | Standard Deviation μm |
|---|---|---|
| Dispersion 1 | 0.29 | 0.18 |
| Dispersion 2 | 0.28 | 0.19 |
| Dispersion 3 | 0.31 | 0.20 |
| Dispersion 4 | 0.30 | 0.20 |
| Dispersion 5 | 0.27 | 0.19 |
| Dispersion 6 | 0.29 | 0.20 |
| Dispersion 7 | 0.27 | 0.18 |
| Dispersion 8 | 0.26 | 0.19 |
| Dispersion 9 | 0.19 | 0.13 |
| Dispersion 10 | 0.22 | 0.16 |
| Dispersion 11 | 0.24 | 0.17 |
| Dispersion 12 | 0.28 | 0.18 |
| Dispersion 13 | 0.33 | 0.23 |

COMPARATIVE EXAMPLE 1

On an aluminum cylinder (JIS 1050 series) of 30 mm in diameter, a coating liquid for undercoat layer, coating liquid for charge generating layer, and coating liquid for charge transporting layer, each having a composition described below, were sequentially applied and dried to form a undercoat layer of 3.5 μm, charge generating layer, and charge transporting layer of 18 μm. The thickness of the charge generating layer was adjusted such that the transmittance of the charge generating layer at 780 nm is 20%.

The transmittance at 780 nm of the charge generating layer was evaluated such that the coating liquid for charge generating layer was coated on an aluminum cylinder wrapped with a polyethylene terephthalate film, and the transmittance was measured by means of a commercially available spectrophotometer (UV-3100, by Shimadzu Co.).

Then, a coating liquid for crosslinked charge transporting layer having the following composition was applied on the charge transporting layer by spray coating, the applied film was air-dried for 20 minutes and was irradiated with light using a metal halide lamp at 160 W/cm, an irradiation intensity of 500 mW/cm$^2$ for 60 seconds thereby to cure the applied film. The cured film was dried at 130° C. for 20 minutes and thereby yielded a surface crosslinked layer 6.0 μm thick. Thus, an electrophotographic photoconductor according to the present invention was prepared.

| [Coating Solution for Undercoat Layer] | |
|---|---|
| Titanium oxide (CR-EL, Ishihara Sangyo Ltd.) | 70 parts |
| Alkyde resin*1) | 15 parts |

-continued

| [Coating Solution for Undercoat Layer] | |
|---|---|
| Melamine resin*2) | 10 parts |
| 2-butanone | 100 parts |

*1)Bekolite M6401-50-S, Solid Content: 50% Dainippon Ink and Chemicals, Inc.
*2)Super Bekamine L-121-60, Solid Content: 60% Dainippon Ink and Chemicals, Inc.

[Coating Liquid for Charge Generating Layer]

The dispersion 1 described above was employed.

| [Coating Liquid for Charge Transporting Layer] | |
|---|---|
| Charge transporting substance of following formula | 7 parts |

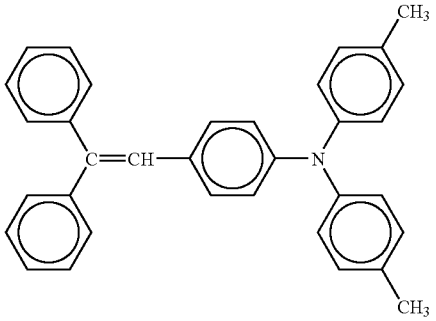

| | |
|---|---|
| Polycarbonate (TS2050, by Teijin Chemicals Ltd.) | 10 parts |
| Methylene chloride | 80 parts |
| 1% silicone oil solution in methylene chloride *1) | 0.2 part |

*1) KF50-100cs, by Shin-Etsu Chemical Co., Ltd.

| [Coating Liquid for Crosslinked Charge Transporting Layer] | |
|---|---|
| Radical polymerizable monomer having three or more functionalities and no charge transporting structure<br>Trimethylolpropane triacrylate (KAYARAD TMPTA, Nippon Kayaku Co., Ltd.)<br>Molecular weight: 296<br>Number of functional group: three functionalities<br>Molecular weight/number of functional group = 99 | 10 parts |
| Radical polymerizable monomer having one functionality and having charge transporting structure<br>Exemplified Compound No. 54 | 10 parts |
| Photopolymerization initiator<br>1-hydroxy-cyclohexyl-phenyl-ketone (IRGACURE 184, by Ciba Specialty Chemicals) | 1 part |
| Tetrahydrofuran | 100 Parts |

COMPARATIVE EXAMPLES 2 TO 8 AND EXAMPLES 1 TO 3

Photoconductors were respectively prepared in the same manner as Comparative Example 1, except that the coating liquid of charge generating layer of dispersion 1 was respectively changed into dispersions 2 to 13. The thickness of the each charge generating layer was adjusted such that the transmittance of the charge generating layer at 780 nm is 20%.

EXAMPLE 4

Electrophotographic photoconductor 14 was prepared in the same manner as Example 1, except that the thickness of the crosslinked charge transporting layer was changed into 2.0 μm.

EXAMPLE 5

Electrophotographic photoconductor 15 was prepared in the same manner as Example 1, except that the thickness of the crosslinked charge transporting layer was changed into 7.9 μm.

EXAMPLE 6

Electrophotographic photoconductor 16 was prepared in the same manner as Example 1, except that the radical polymerizable monomer having three or more functionalities and no charge transporting structure contained in the coating liquid for the crosslinked charge transporting layer was changed into the following monomer; the radical polymerizable compound having one functionality and having a charge transporting structure was changed into 10 parts of exemplified compound No. 138; and the thickness of the crosslinked charge transporting layer was changed into 5.0 μm.

| | |
|---|---|
| Radical polymerizable monomer having three or more functionalities and no charge transporting structure<br>Pentaerythritol tetraacrylate (SR-295, Sartomer Company Inc.)<br>Molecular weight: 352<br>Number of functional group: 4 functionality<br>Molecular weight/number of functional group = 88 | 10 parts |

EXAMPLE 7

Electrophotographic photoconductor 17 was prepared in the same manner as Example 1, except that the radical polymerizable monomer having three or more functionalities and no charge transporting structure contained in the coating liquid for the crosslinked charge transporting layer was changed into the following monomer; the photopolymerization initiator was changed into the following compound; and the thickness of the crosslinked charge transporting layer was changed into 4.8 μm.

| | |
|---|---|
| Radical polymerizable monomer having three or more functionalities and no charge transporting structure<br>Caprolactone-modified dipentaerythritol hexacrylate (KAYARAD DPCA-60, Nippon Kayaku Co., Ltd.)<br>Molecular weight: 1263<br>Number of functional group: 6 functionalities<br>Molecular weight/number of functional group = 211 | 10 parts |
| Photopolymerization initiator<br>2,2-dimethoxy-1,2-diphenylethan-1-one (IRGACURE 651, Ciba Specialty Chemicals) | 1 part |

EXAMPLE 8

Electrophotographic photoconductor 18 was prepared in the same manner as Example 1, except that the radical polymerizable monomer having three or more functionalities and no charge transporting structure contained in the coating liquid for the crosslinked charge transporting layer was changed into the following monomer; and the thickness of the crosslinked charge transporting layer was changed into 9.4 μm.

| | |
|---|---|
| Radical polymerizable monomer having three or more functionalities and no charge transporting structure | 10 parts |
| Caprolactone-modified dipentaerythritol hexacrylate (KAYARAD DPCA-120, Nippon Kayaku Co., Ltd.) | |
| Molecular weight: 1947 | |
| Number of functional group: 6 functionality | |
| Molecular weight/number of functional group = 325 | |

EXAMPLE 9

Electrophotographic photoconductor 19 was prepared in the same manner as Example 3, except that the composition of the coating liquid for the crosslinked charge transporting layer was changed into the following composition; and the thickness of the crosslinked charge transporting layer was changed into 6.5 μm.

| | |
|---|---|
| Radical polymerizable monomer having three or more functionalities and no charge transporting structure | 9 parts |
| Trimethylolpropane triacrylate (KAYARAD TMPTA, Nippon Kayaku Co., Ltd.) | |
| Molecular weight: 296 | |
| Number of functional group: three functionalities | |
| Molecular weight/number of functional group = 99 | |
| Radical polymerizable monomer having one functionality and having charge transporting structure | 10 parts |
| Exemplified Compound No. 54 | |
| Photopolymerization initiator | 1 part |
| 1-hydroxy-cyclohexyl-phenyl-ketone (IRGACURE 184, by Ciba Specialty Chemicals) | |
| Bisphenol Z Polycarbonate | 1 part |
| (Panlite TS-2050, by Teijin Chemicals Ltd.) | |
| Tetrahydrofuran | 100 Parts |

EXAMPLE 10

Electrophotographic photoconductor 20 was prepared in the same manner as Example 3, except that the radical polymerizable compound contained in the coating liquid for crosslinked charge transporting layer was changed into 9 parts of exemplified compound No. 54 having one functionality and 1 part of the following compound having two functionalities; and the thickness of the crosslinked charge transporting layer was changed into 5.1 μm.

| | |
|---|---|
| Radical polymerizable compound (exemplified compound No. 54) | 9 parts |
| Radical polymerizable compound of following formula (having 2 functionalities and charge transporting structure) | 1 part |

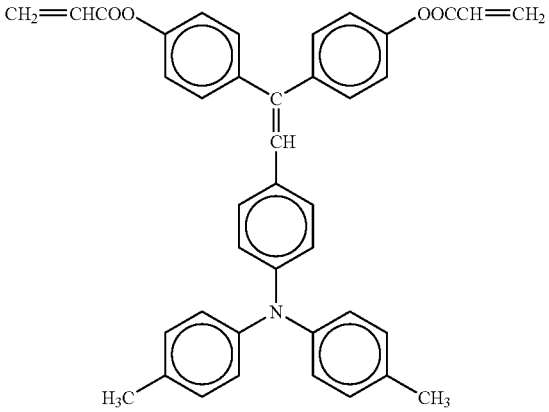

EXAMPLE 11

Electrophotographic photoconductor 21 was prepared in the same manner as Example 3, except that the amount of the radical polymerizable monomer having three or more functionalities and no charge transporting structure was changed into 6 parts; the amount of the radical polymerizable compound having one functionality and having a charge transporting structure was changed into 14 parts; and the thickness of the crosslinked charge transporting layer was changed into 6.5 μm.

EXAMPLE 12

Electrophotographic photoconductor 22 was prepared in the same manner as Example 3, except that the amount of the radical polymerizable monomer having three or more functionalities and no charge transporting structure was changed into 14 parts; the amount of the radical polymerizable compound having one functionality and having a charge transporting structure was changed into 6 parts; and the thickness of the crosslinked charge transporting layer was changed into 6.5 μm.

EXAMPLE 13

Electrophotographic photoconductor 23 was prepared in the same manner as Example 2, except that the coating liquid for charge transporting layer of Example 2 was changed into the following composition; the radical polymerizable compound having one functionality and having a charge transporting structure was changed into 10 parts of the exemplified compound No. 144; and the thickness of the crosslinked charge transporting layer was changed into 4.5 μm.

| | |
|---|---|
| [Coating Liquid for Charge Transporting Layer] | |
| Charge transporting substance of following formula | 7 parts |

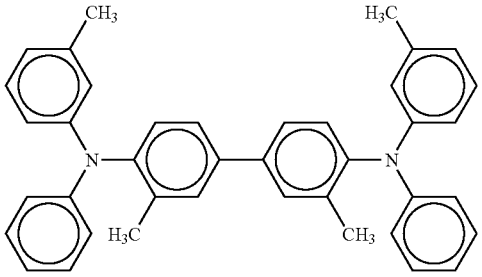

| | |
|---|---|
| Polycarbonate (TS2050, by Teijin Chemicals Ltd.) | 10 parts |
| Methylene chloride | 80 parts |
| 1% silicone oil solution in methylene chloride *1) | 0.2 part |

*1) KF50-100cs, by Shin-Etsu Chemical Co., Ltd.

EXAMPLE 14

Electrophotographic photoconductor 24 was prepared in the same manner as Example 2, except that the photopolymerization initiator was changed into the following thermal polymerization initiator; the coating liquid for the crosslinked charge transporting layer was coated on the charge transporting and air dried, then heated in a forced air draft oven at 70° C. for 30 minutes and further heated at 150° C. for 1 hour to prepare a crosslinked charge transporting layer of 4.1 μm in thickness.

| | |
|---|---|
| Thermal polymerization initiator<br>2,2-bis(4,4-di-t-butylperoxycyclohexyl)propane<br>(Perakdox 12-EB20, Kayaku Akzo Corporation) | 1 part |

EXAMPLE 15

Electrophotographic photoconductor 25 was prepared in the same manner as Example 2, except that a coating liquid containing a polymer charge transporting substance (PD-1) described below was coated on a charge generating layer, similar to that of Example 2, and dried to form a charge transporting layer of 18 μm thick. On the charge transporting layer, a crosslinked layer charge transporting layer of 3.5 μm thick was prepared to form the electrophotographic photoconductor 25.

| | |
|---|---|
| [Coating Liquid for Charge Transporting Layer] | |
| Polymer charge transporting substance (PD-1) of the following structural formula | 15 parts |

(PD-1)

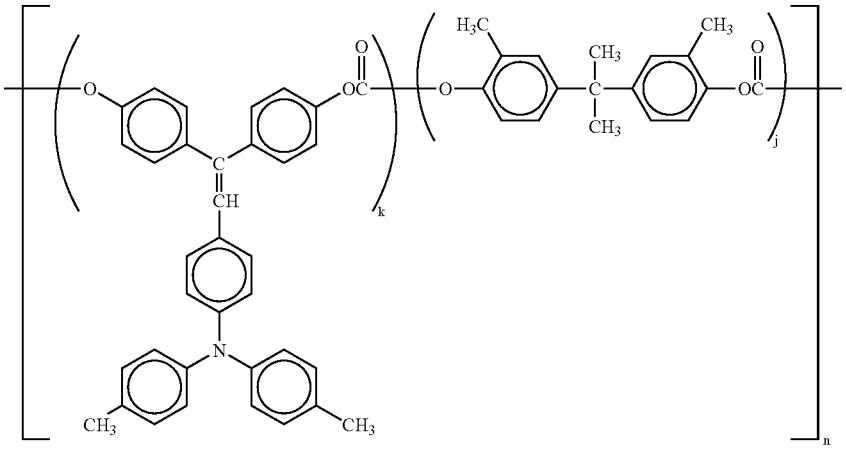

k = 042, j = 0.58 Mw = 160000 (polystyrene conversion)

| | |
|---|---|
| Tetrahydrofuran | 100 parts |
| 1% silicone oil 1*) solution in tetrahydrofuran | 0.3 part |

1*) KF50-100 CS, Shin-Etsu Chemical Co, Ltd.

COMPARATIVE EXAMPLE 11

Electrophotographic photoconductor 26 was prepared in the same manner as Example 1, except that the radical polymerizable monomer having three or more functionalities and no charge transporting structure was changed into 10 parts of the following radical polymerizable monomer having two functionalities and no charge transporting structure; and the thickness of the crosslinked charge transporting layer was changed into 6.0 μm.

| | |
|---|---|
| Radical polymerizable monomer having two functionalities and no charge transporting structure<br>1,6-hexanediol diacrylate (by Wako Pure Chemical, Ltd.)<br>Molecular weight: 226<br>Number of functional group: 2 functionalities<br>Molecular weight/number of functional group = 113 | 10 parts |

COMPARATIVE EXAMPLE 12

Electrophotographic photoconductor 27 was prepared in the same manner as Example 1, except that the radical polymerizable compound having one functionality and having a charge transporting structure was changed into 10 parts of the radical polymerizable compound having two functionalities and having a charge transporting structure which was employed in Example 10; and the thickness of the crosslinked charge transporting layer was changed into 7.5 μm.

COMPARATIVE EXAMPLE 13

Electrophotographic photoconductor 28 was prepared in the same manner as Example 1, except that the radical polymerizable monomer, having three or more functionalities and no charge transporting structure, was not included into the coating liquid for the crosslinked charge transporting layer; the amount of the radical polymerizable compound having one functionality and having a charge transporting structure was changed into 20 parts; and the thickness of the crosslinked charge transporting layer was changed into 5.3 μm.

COMPARATIVE EXAMPLE 14

Electrophotographic photoconductor 29 was prepared in the same manner as Example 1, except that the radical polymerizable compound, having one functionality and having a charge transporting structure, was not included into the coating liquid for the crosslinked charge transporting layer; the amount of the radical polymerizable monomer having three or more functionalities and no charge transporting structure was changed into 20 parts; and the thickness of the crosslinked charge transporting layer was changed into 5.5 μm.

COMPARATIVE EXAMPLE 15

Electrophotographic photoconductor 30 was prepared in the same manner as Example 1, except that the radical polymerizable compound, having one functionality and having a charge transporting structure, was not included into the coating liquid for the crosslinked charge transporting layer; instead of the radical polymerizable compound, 10 parts of charge transporting substance having lower molecular weight employed in the coating liquid for charge transporting layer was incorporated; and the thickness of the crosslinked charge transporting layer was changed into 6.0 μm.

COMPARATIVE EXAMPLE 16

Electrophotographic photoconductor 31 was prepared in the same manner as Example 3, except that and the thickness of the crosslinked charge transporting layer of Example 31 was changed into 0.9 μm.

COMPARATIVE EXAMPLE 17

Electrophotographic photoconductor 32 was prepared in the same manner as Example 3, except that and the thickness of the crosslinked charge transporting layer of Example 32 was changed into 10.3 μm.

COMPARATIVE EXAMPLE 18

Electrophotographic photoconductor 33 was prepared in the same manner as Example 2, except that the charge transporting layer in Example 2 was not provided, instead of it, the coating liquid for crosslinked charge transporting layer described below was coated on the charge generating layer, then was cured to form a crosslinked charge transporting layer of 19.0 μm thick.

| [Coating Liquid For crosslinked Charge Transporting Layer] | |
|---|---|
| Radical polymerizable monomer having three or more functionalities and no charge transporting structure<br>Pentaerythritol tetraacrylate (SR-295, Sartomer Company Inc.)<br>Molecular weight: 352<br>Number of functional group: 4 functionalities<br>Molecular weight/number of functional group = 88 | 8 parts |
| Radical polymerizable monomer having three or more functionalities and no charge transporting structure<br>Caprolactone-modified dipentaerythritol hexacrylate (KAYARAD DPCA-60, Nippon Kayaku Co., Ltd.)<br>Molecular weight: 1263<br>Number of functional group: 6 functionalities<br>Molecular weight/number of functional group = 211 | 2 parts |
| Radical polymerizable monomer having one functionality and having charge transporting structure<br>Exemplified Compound No. 54 | 10 parts |
| Photopolymerization initiator<br>1-hydroxy-cyclohexyl-phenyl-ketone (IRGACURE 184, by Ciba Specialty Chemicals) | 1 part |
| Tetrahydrofuran | 100 Parts |

COMPARATIVE EXAMPLE 19

Electrophotographic photoconductor 34 was prepared in the same manner as Example 2, except that the charge transporting layer in Example 2 was not provided, instead of it, the coating liquid for crosslinked charge transporting layer described below was coated on the charge generating layer, then was cured to form a crosslinked charge transporting layer of 15.0 μm thick.

| [Coating Liquid For crosslinked Charge Transporting Layer] | |
|---|---|
| Radical polymerizable monomer having three or more functionalities and no charge transporting structure Trimethylolpropane triacrylate (KAYARAD TMPTA, Nippon Kayaku Co., Ltd.) Molecular weight: 296 Number of functional group: three functionalities Molecular weight/number of functional group = 99 | 8 parts |
| Radical polymerizable monomer having three or more functionalities and no charge transporting structure Caprolactone-modified dipentaerythritol hexacrylate (KAYARAD DPCA-60, Nippon Kayaku Co., Ltd.) Molecular weight: 1263 Number of functional group: 6 functionalities Molecular weight/number of functional group = 211 | 2 parts |
| Radical polymerizable monomer having one functionality and having charge transporting structure Exemplified Compound No. 54 | 10 parts |
| Photopolymerization initiator 1-hydroxy-cyclohexyl-phenyl-ketone (IRGACURE 184, by Ciba Specialty Chemicals) | 1 part |
| Tetrahydrofuran | 100 Parts |

COMPARATIVE EXAMPLE 20

Electrophotographic photoconductor 35 was prepared in the same manner as Example 2, except that the charge transporting layer in Example 2 was not provided, and the thickness of the charge transporting layer was changed into 24 μm.

COMPARATIVE EXAMPLE 21

Electrophotographic photoconductor 36 was prepared in the same manner as Example 2, except that the charge transporting layer in Example 2 was not provided, the protective layer of the composition described below was provided in 5.2 μm thick in stead of it.

| [Coating Liquid for Protective Layer] | |
|---|---|
| Alpha-alumina filler *1) | 5 parts |
| Unsaturated polycarboxylic acid polymer solution *2) | 0.1 part |
| Polycarbonate resin having the following structural unit | 10 parts |

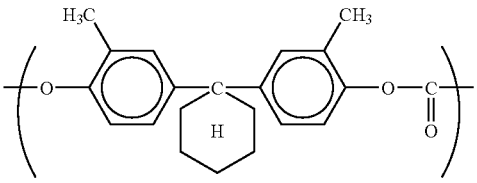

-continued

| | |
|---|---|
| Charge transporting substance of following formula | 7 parts |

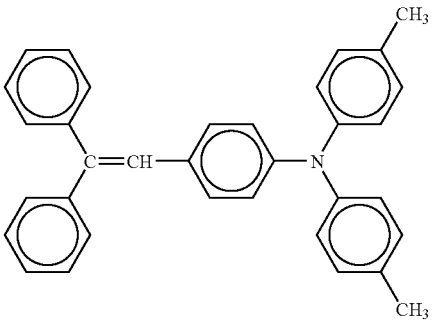

| | |
|---|---|
| Tetrahydrofuran | 500 parts |
| Cyclohexanone | 150 parts |

*1) Sumicorundum AA-03, averaged primary particle size: 0.3 μm by Sumitomo chemical Co. Ltd.
*2) BYK P104, acid value: 180 mg KOH/g, nonvolatile content: 50% by BYK-Chemie Co. Ltd.

COMPARATIVE EXAMPLE 22

Electrophotographic photoconductor 37 was prepared in the same manner as Comparative Example 21, except that the coating liquid for the protective layer was changed into the following composition.

| [Coating Liquid for Protective Layer] | |
|---|---|
| Silica *1) | 6 parts |
| Polycarbonate resin having the following structural unit | 10 parts |

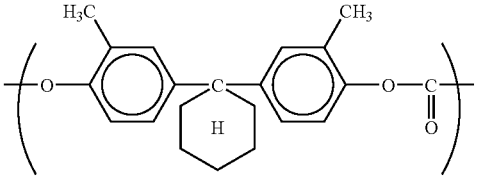

| | |
|---|---|
| Charge transporting substance of following formula | 8 parts |

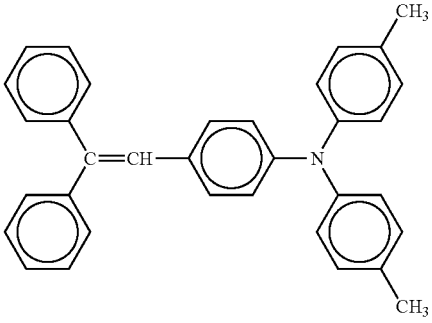

| | |
|---|---|
| Tetrahydrofuran | 500 parts |
| Cyclohexanone | 150 parts |

*1) KMP-X100, averaged primary particle size: 0.1 μm by Shin-Etsu Chemical Co., Ltd.

With respect to the resulting electrophotographic photoconductors, the appearances were visually observed, and the occurrences of cracks and peels of layers were evaluated.-

Then each one droplet of tetrahydrofuran (THF) and dichloromethane was dropped on the surface of the respective electrophotographic photoconductors, and the alternation of the surface after air drying was observed. The results are shown in Table 6.

TABLE 6

| Photoconductor Surface | | | Solubility Test | |
|---|---|---|---|---|
| Example | No. | Observation | THF | Dichloromethane |
| Comp. Ex. 1 | 1 | Good | Insoluble | Insoluble |
| Comp. Ex. 2 | 2 | Good | Insoluble | Insoluble |
| Comp. Ex. 3 | 3 | Good | Insoluble | Insoluble |
| Comp. Ex. 4 | 4 | Good | Insoluble | Insoluble |
| Comp. Ex. 5 | 5 | Good | Insoluble | Insoluble |
| Comp. Ex. 6 | 6 | Good | Insoluble | Insoluble |
| Comp. Ex. 7 | 7 | Good | Insoluble | Insoluble |
| Comp. Ex. 8 | 8 | Good | Insoluble | Insoluble |
| Ex. 1 | 9 | Good | Insoluble | Insoluble |
| Ex. 2 | 10 | Good | Insoluble | Insoluble |
| Ex. 3 | 11 | Good | Insoluble | Insoluble |
| Comp. Ex. 9 | 12 | Good | Insoluble | Insoluble |
| Comp. Ex. 10 | 13 | Good | Insoluble | Insoluble |
| Ex. 4 | 14 | Good | Insoluble | Insoluble |
| Ex. 5 | 15 | Good | Insoluble | Insoluble |
| Ex. 6 | 16 | Good | Insoluble | Insoluble |
| Ex. 7 | 17 | Good | Insoluble | Insoluble |
| Ex. 8 | 18 | Good | Insoluble | Insoluble |
| Ex. 9 | 19 | Good | Slightly Soluble | Slightly Soluble |
| Ex. 10 | 20 | Good | Insoluble | Insoluble |
| Ex. 11 | 21 | Good | Insoluble | Insoluble |
| Ex. 12 | 22 | Good | Insoluble | Insoluble |
| Ex. 13 | 23 | Good | Slightly Soluble | Slightly Soluble |
| Ex. 14 | 24 | Good | Insoluble | Insoluble |
| Ex. 15 | 25 | Good | Insoluble | Insoluble |
| Comp. Ex. 11 | 26 | Good | Slightly Soluble | Slightly Soluble |
| Comp. Ex. 12 | 27 | Occurrence of Cracks | Insoluble | Insoluble |
| Comp. Ex. 13 | 28 | Insufficient Cure & Tacky | Soluble | Soluble |
| Comp. Ex. 14 | 29 | Good | Insoluble | Insoluble |
| Comp. Ex. 15 | 30 | Occurrence of Fog[1*]) | Soluble | Soluble |
| Comp. Ex. 16 | 31 | Good | Soluble | Soluble |
| Comp. Ex. 17 | 32 | Occurrence of Cracks | Insoluble | Insoluble |
| Comp. Ex. 18 | 33 | Occurrence of Peels | Insoluble | Insoluble |
| Comp. Ex. 19 | 34 | Occurrence of peels at 7000 th copies | Insoluble | Insoluble |
| Comp. Ex. 20 | 35 | Good | Soluble | Soluble |
| Comp. Ex. 21 | 36 | Good | Soluble | Soluble |
| Comp. Ex. 22 | 37 | Good | Soluble | Soluble |

[1*])Fog occurred due to deposition of charge transporting substance

The results shown in Table 6 demonstrate that the electrophotographic photoconductors according to the present invention having the crosslinked charge transporting layer of 1 to 10 μm thick, represented by Examples 1 to 15, do not occur cracks and layer peels at producing the crosslinked charge transporting layer, and display proper appearances.

On the other hand, the electrophotographic photoconductor of Comparative Example 12 which contains the radical polymerizable compound having two functionalities and having a charge transporting structure as the component of the crosslinked charge transporting layer and the electrophotographic photoconductor of Comparative Example 17 of which the layer thickness is above 10 μm experienced occurrence of cracks at producing the crosslinked charge transporting layer. Further, the electrophotographic photoconductors of Comparative Examples 18 and 19, each having a crosslinked charge transporting layer of 10 μm or more in thickness and not having a charge transporting layer, experienced occurrence of layer peels at producing the crosslinked charge transporting layer or during the evaluation of permeability as described later.

Further, the electrophotographic photoconductors of Examples 1 to 15 display slightly soluble or insoluble against the organic solvent, demonstrating the presence of crosslinked charge transporting layer having high crosslinking density. The insoluble level against organic solvents increased when the thickness of the crosslinked charge transporting layer exceeds 2 μm.

On the contrary, the components of the charge transporting layer spread throughout the crosslinked charge transporting layer due to the effect of the components of crosslinked charge transporting layer in the electrophotographic photoconductor in Comparative Examples 13 and 15, due to the layer thickness of crosslinked charge transporting layer thinner than 1 μm, resulting in soluble against organic solvents.

Then, the electrophotographic photoconductors, which showed proper results on initial surface appearance and insolubility on the solvent resistance test, were subjected to printing test on 100,000 A4-sized sheets in the following manner.

Initially, the respective electrophotographic photoconductors were mounted to a process cartridge for electrophotographic apparatus, and the process cartridge was attached to a modified machine of imagio Neo 270 (by, Ricoh Company, Ltd) which utilized semiconductor laser at 780 nm as the imaging light source, and the potential (VL) on irradiating site at primary period of the respective electrophotographic photoconductors and the output images were evaluated. The applied voltage was selected such that the potential (VD) at dark or unexposed sites was −650 V, and the developing bias was set to −400 V.

Then, the print test was initiated. The applied voltage was adjusted such that the VD corresponded to −650 V again after 100000 sheets of copy, and VL was determined. In addition, the applied voltage was adjusted such that the VD corresponded to −650 V and −950 V, and images were output so that the developing bias corresponded to −400 V and −700 V, and the images were evaluated.

Further, the abrasion wear was calculated through measuring the layer thickness of the entire layers at initial and after 100000 sheets of copy and calculating the differences.

The result of image evaluation was classified into four levels with reference to the image defects as follows.

(A): Excellently good (B): Image quality was somewhat deteriorated from initial stage, but significant matter did not appear.

(C): Image quality deteriorated significantly.

(D): Image quality deteriorated remarkably.

The results were shown in Table 7.

TABLE 7

| | | Initial | | After 100000 sheets of copy | | | |
|---|---|---|---|---|---|---|---|
| | | VD: −650 V | | VD: −650 V | | VD: −950 V | Abrasion |
| Example | Photoconductor No. | VL (−V) | Image Quality | VL (−V) | Image Quality | Image Quality | Wear (μm) |
| Comp. Ex. 1 | 1 | 60 | (A) | 85 | Backg. S (B) | Backg. S (D) | 1.7 |
| Comp. Ex. 2 | 2 | 55 | (A) | 65 | Backg. S (B) | Backg. S (D) | 1.7 |
| Comp. Ex. 3 | 3 | 70 | (A) | 105 | Backg. S (B) | Backg. S (D) | 1.7 |
| Comp. Ex. 4 | 4 | 65 | (A) | 95 | Backg. S (B) | Backg. S (D) | 1.7 |
| Comp. Ex. 5 | 5 | 75 | (A) | 110 | Backg. S (C) | Backg. S (D) | 1.7 |
| Comp. Ex. 6 | 6 | 80 | (A) | 115 | Backg. S (C) | Backg. S (D) | 1.7 |
| Comp. Ex. 7 | 7 | 70 | (A) | 105 | Backg. S (C) | Backg. S (D) | 1.7 |
| Comp. Ex. 8 | 8 | 60 | (A) | 95 | Backg. S (C) | Backg. S (D) | 1.7 |
| Ex. 1 | 9 | 60 | (A) | 85 | (A) | (A) | 1.7 |
| Ex. 2 | 10 | 60 | (A) | 85 | (A) | (A) | 1.7 |
| Ex. 3 | 11 | 60 | (A) | 85 | (A) | (A) | 1.7 |
| Comp. Ex. 9 | 12 | 60 | (A) | 90 | Backg. S (B) | Backg. S (D) | 1.7 |
| Comp. Ex. 10 | 13 | 70 | (A) | 100 | Backg. S (C) | Backg. S (D) | 1.7 |
| Ex. 4 | 14 | 50 | (A) | 70 | (A) | (A) | 1.6 |
| Ex. 5 | 15 | 65 | (A) | 90 | (A) | (A) | 1.8 |
| Ex. 6 | 16 | 65 | (A) | 90 | (A) | (A) | 1.5 |
| Ex. 7 | 17 | 50 | (A) | 75 | (A) | (A) | 2.4 |
| Ex. 8 | 18 | 70 | (A) | 95 | (A) | (A) | 3.7 |
| Ex. 9 | 19 | 50 | (A) | 90 | (A) | (A) | 4.5 |
| Ex. 10 | 20 | 50 | (A) | 85 | (A) | (A) | 3.0 |
| Ex. 11 | 21 | 40 | (A) | 60 | (A) | (A) | 4.9 |
| Ex. 12 | 22 | 80 | (A) | 155 | (A) | Image D. (B) | 0.9 |
| Ex. 13 | 23 | 70 | (A) | 100 | (A) | (A) | 3.8 |
| Ex. 14 | 24 | 70 | (A) | 105 | (A) | (A) | 2.7 |
| Ex. 15 | 25 | 65 | (A) | 90 | (A) | (A) | 2.9 |
| Comp. Ex. 11 | 26 | 60 | (A) | 70 | Backg. S (D) | Backg. S (D) | 9.2 |
| Comp. Ex. 12 | 27 | 85 | B. Streak(D) | Evaluation was stopped | | | |
| Comp. Ex. 14 | 29 | 210 | Image D. (C) | 390 | Image D. (D) | Image D. (D) | 1.1 |
| Comp. Ex. 15 | 30 | 65 | Backg. S (C) | 180 | Image D. (C) Backg. S (D) | Image D. (C) Backg. S (D) | No measurable by offset abrasion |
| Comp. Ex. 16 | 31 | 50 | (A) | Evaluation stop due to concentration non-uniformity and background smear at 10000 th | | | |
| Comp. Ex. 17 | 32 | 100 | B. Streak(D) | Evaluation was stopped | | | |
| Comp. Ex. 19 | 34 | 70 | (A) | Evaluation stop due to layer peel at 7000 th print | | | |
| Comp. Ex. 20 | 35 | 35 | (A) | Evaluation stop due to entire background smear at 50000 th print | | | |
| Comp. Ex. 21 | 36 | 75 | (A) | 120 | Black points due to inferior cleaning (C) | Black points due to inferior cleaning (D) | 2.8 |
| Comp. Ex. 22 | 37 | 45 | Resolution (B) | 65 | Image Blur (D) | Image Blur (D) | 4.2 |

In the column of image quality in the Table above, abbreviated terms mean:
Backg. S: Background Smear
Image D.: Image Density
B. Streak: Black Streak.

The above noted results demonstrate that the inventive electrophotographic photoconductors represented by Examples 1 to 15 may provide improved abrasion resistance as well as stable electric properties with prolonged time, and further may control the effect of background smear that defines the life of photoconductor thereby to afford high image quality stably for long period.

In particular, by employing the titanyl phthalocyanine crystal defined in the present invention, controlling the background smear due to the charge generating layer through finely dividing the pigment particles or excluding flocculated particles, and constituting the crosslinked charge transporting layer of 1 to 10 μm thick, the increased abrasion resistance may be achieved without adverse effect of potential raise at irradiated portions and various image defects, consequently, the prolonged life of the electrophotographic photoconductor may be attained.

On the other hand, the titanyl phthalocyanine crystal that exhibits no peaks at 9.4° or 9.6°, no peak at 7.3° as the lowest angle, or exhibits peaks in a range between 7.3° and 9.4° as Bragg 2θ angles in terms of CuK-α characteristic X-ray wavelength at 1.542 Å, usually comes to more susceptible with time to the background smear or potential increase at irradiated portions which mainly contributes to the decrease of charging.

Further, the effect of the background smear tends to increase clearly due to the flocculates when the averaged particle size of the titanyl phthalocyanine crystal primary particles turns into more than 0.25 μm. Further, it is confirmed that the electrophotographic photoconductor comprising charge transporting substance of di-functional monomer or lower molecular weight without functional group displays lower abrasion resistance and significant image deterioration due to lower crosslinking density and uneven curing reaction.

Moreover, in the electrophotographic photoconductor comprising a crosslinked charge transporting layer of which the thickness is less than 1 μm, the charge transporting substance in the charge transporting layer tends to diffuse into the crosslinked charge transporting layer, then offset or extraordinary abrasion is derived due to hindered crosslinking, resulting in background smear caused by uneven concentration or inferior cleaning.

The electrophotographic photoconductor, the entire charge transporting layer being formed of a crosslinked charge transporting layer, caused layer peels at 7000 th printing due to larger internal stress. The electrophotographic photoconductor, not having a crosslinked charge transporting layer and employing a conventional thermoplastic binder resin in the charge transporting layer, exhibited lower abrasion resistance and poor durability compared to the inventive photoconductors.

The electrophotographic photoconductor, which comprises a filler-containing protective layer in place of the crosslinked charge transporting layer according to the present invention, was susceptible to the potential increase of the irradiated portions due to the repeated prolonged usage, and also frequently led to image defects due to inferior cleaning. Further, the influence of image blur was remarkable depending on filler species.

Accordingly, in the electrophotographic photoconductor comprising a charge generating layer, a charge transporting layer, and a crosslinked charge transporting layer on a substrate in order, the incorporation of titanyl phthalocyanine crystal particles, which exhibit a highest peak at 27.2°, main peaks at 9.4°, 9.6° and 24.0°, a peak at 7.3° as the lowest angle, and with no peaks in a range between 7.3° and 9.4°, and with no peak at 26.3° as Bragg 2θ angles in terms of CuK-α characteristic X-ray wavelength at 1.542 Å and the averaged primary particle is 0.25 μm or less, into the charge generating layer leads to the achievement of higher allowance against background smear and electrostatic stability; the formation of crosslinked charge transporting layer by curing at least a radical polymerizable monomer having three or more functionalities and no charge transporting structure and a mono-functional radical polymerizable compound having a charge transporting structure, and adjusting the layer thickness of the crosslinked charge transporting layer to 1 to 10 μm may result in prevention of cracks or layer peels and provision of higher resistance against abrasion and flaws. Further, it is confirmed for the first time that the combination of these factors may afford the control of background smear not only at initial period but also under repeated and prolonged usages without adverse effect such as image defects thereby may provide stable images with higher quality for long period.

Further, it is realized that the image forming process, image forming apparatus, and process cartridge that employ the inventive electrophotographic photoconductor respectively may exhibit higher performance and reliability, and prolonged life.

Finally, the peak at 7.3° of the lowest angle as Bragg 2θ angles in terms of the CuK-α characteristic X-ray wave, which is a feature of the titanyl phthalocyanine crystal employed in the present invention, will be examined as to the identity with the peak at 7.5° of the lowest angle in the conventional material.

COMPARATIVE SYNTHETIC EXAMPLE 9

A titanyl phthalocyanine was prepared in the same manner as Comparative Synthetic Example 1, except for changing the solvent for crystal transformation from methylene chloride to 2-butane. X-ray diffraction pattern of the resulting titanyl phthalocyanine crystal was measured in the same manner as Comparative Synthetic Example 1, which is shown in FIG. 13.

Figure 13:
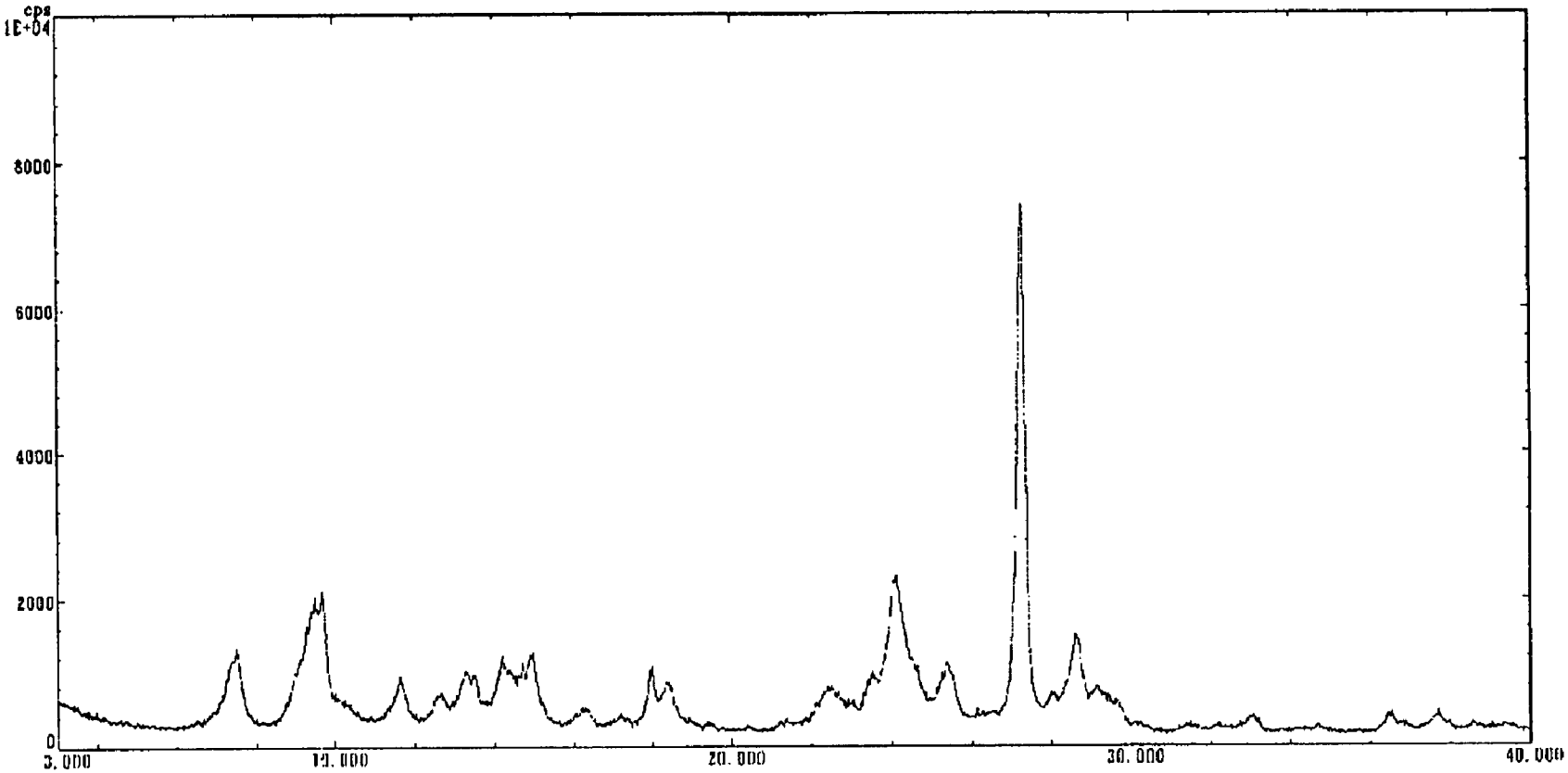
FIG. 13 shows an X-ray diffraction spectrum of titanyl phthalocyanine particles obtained in Comparative Synthetic Example 9.

As being understood from FIG. 13, the lowest angle of the X-ray diffraction spectrum of Comparative Synthetic Example 9 is 7.5°, which is different from the lowest angle of 7.3° in Comparative Synthetic Example 1.

MEASURING EXAMPLE 1

To the pigment having the lowest angle of 7.3° obtained in Comparative Synthetic Example 1, the pigment having the lowest angle of 7.5° prepared in accordance with JP-A No. 61-239248 was added in an amount of 3% by mass, and mixed in a pestle, then X-ray diffraction pattern was measure. The X-ray spectrum of Measuring Example 1 is shown in FIG. 14.

MEASURING EXAMPLE 2

Figure 15:
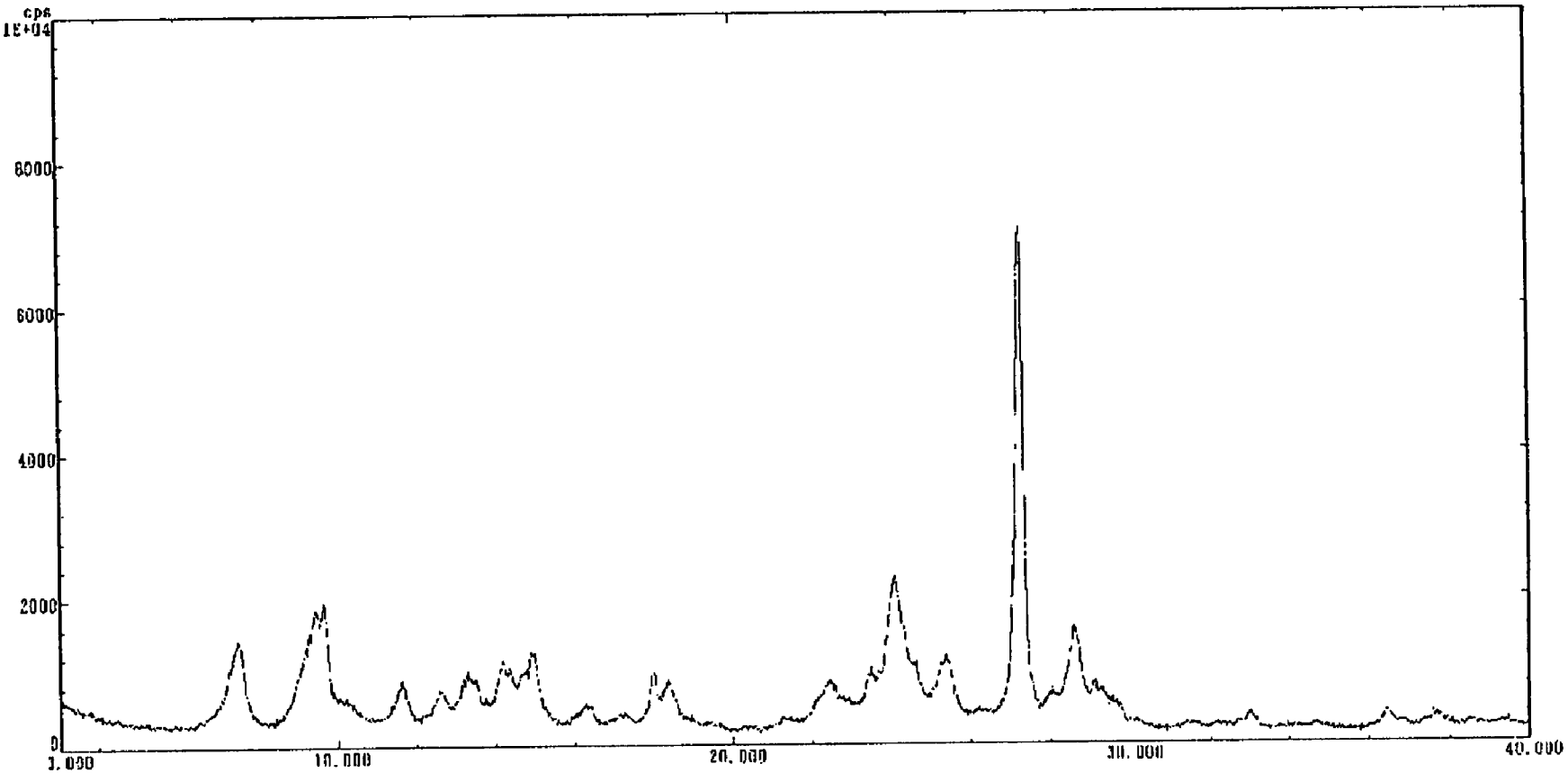
FIG. 15 shows an X-ray diffraction spectrum of titanyl phthalocyanine particles obtained in Measuring Example 2.

To the pigment having the lowest angle of 7.5° obtained in Comparative Synthetic Example 9, the pigment having the lowest angle of 7.5° prepared in accordance with JP-A No. 61-239248 was added in an amount of 3% by mass, and mixed in a pestle, then X-ray diffraction pattern was measure. The X-ray spectrum of Measuring Example 2 is shown in FIG. 15.

Figure 14:
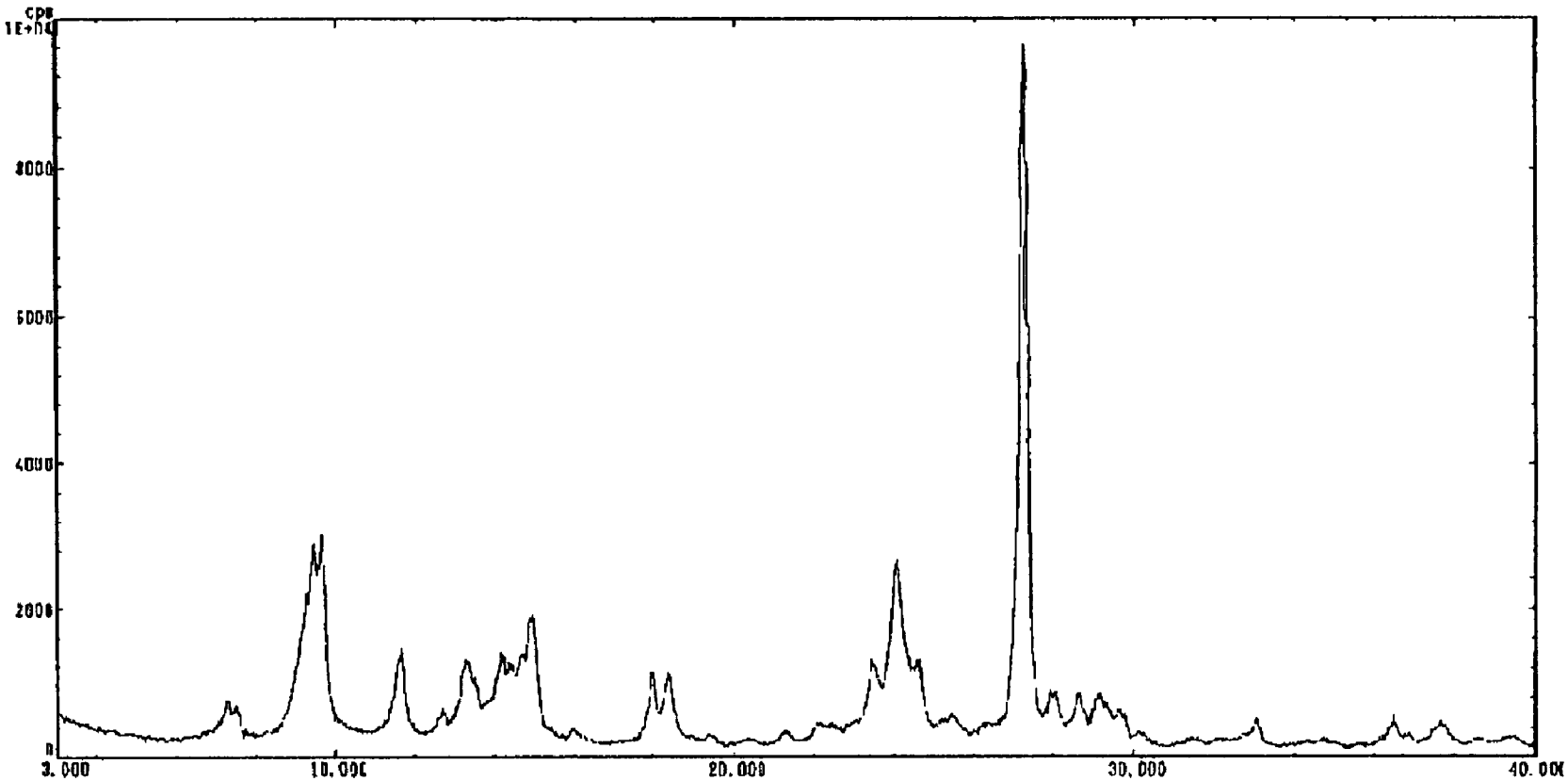
FIG. 14 shows an X-ray diffraction spectrum of titanyl phthalocyanine particles obtained in Measuring Example 1.

In the spectrum shown in FIG. 14, two peaks exist independently at lower angle side of 7.3° and 7.5°, therefore, the peaks of 7.3° and 7.5° are confirmed to be at least different each other. On the other hand, in the spectrum shown in FIG. 15, only the peak of 7.5° exist at lower angle side, which is clearly different from FIG. 14.

From the results, it is understood that the peak at 7.3° of the lowest angle of the titanyl phthalocyanine crystal employed in the present invention is different from the peak at 7.5° of the lowest angle in the conventional material.

As explained above, in accordance with the present invention, an electrophotographic photoconductor may be provided that shows high abrasion resistance under prolonged and repeated usages adapted to respond to the need for stable images and long life of high-speed or color apparatuses, and provides stably high quality images for a long term without causing abnormal images due to cracks, flaws, layer peels and the like derived from inferior cleaning and with controlling background smear as well as enhancing the potential stability. Consequently, the prolonged life and high stability may be achieved not only for the electrographic photoconductor but also the process cartridge and image forming apparatus that utilize it respectively.

What is claimed is:

1. A photoconductor comprising:

a substrate, a charge generating layer, a charge transporting layer, and a crosslinked charge transporting layer, wherein the charge generating layer contains titanyl phthalocyanine crystal particles that exhibit a highest peak at 27.2°, main peaks at 9.4°, 9.6° and 24.0°, a peak at 7.3° as the lowest angle, and with no peaks in a range between 7.3° and 9.4°, and with no peak at 26.3° as Bragg 2θ angles (±0.2°) in terms of CuK-α characteristic X-ray wavelength at 1.542 Å, and the averaged primary particle size of the titanyl phthalocyanine crystal particles is 0.25 μm or less, the crosslinked charge transporting layer contains a reaction product of a radical polymerizable monomer having three or more functionalities and no charge transporting structure and a radical polymerizable compound having one functionality and a charge transporting structure, and the thickness of the crosslinked charge transporting layer is 1 to 10 μm.

2. The photoconductor according to claim 1, wherein the charge generating layer is formed by:

using the titanyl phthalocyanine crystal particles having a volume-averaged particle size of 0.3 μm or less, dispersing the titanyl phthalocyanine crystal particles to prepare a dispersion until the standard deviation of the volume-averaged particle size reduces to 0.2 μm or less, filtering the dispersion by means of a filter having an effective pore size of 3.0 μm or less, and coating the dispersion to form the charge generating layer.

3. The photoconductor according to claim 1, wherein the titanyl phthalocyanine crystal particles are formed through:

transforming amorphous or lower crystallinity titanyl phthalocyanine, which exhibits a highest peak in a range between 7.0° and 7.5° as Bragg 2θ angles (±0.2°) in terms of the CuK-α characteristic X-ray wavelength at 1.542 Å, a peak width at half height of the highest peak of 1.0° or more, and an averaged primary particle size of 0.1 μm or less, by using an organic solvent in the presence of water, and separating the transformed titanyl phthalocyanine from the organic solvent before the averaged primary particle size of the transformed titanyl phthalocyanine grows above 0.25 μm or more.

4. The photoconductor according to claim 1, wherein the titanyl phthalocyanine crystal particles are formed by using raw materials free from halides.

5. The photoconductor according to claim 3, wherein the amorphous or lower crystallinity titanyl phthalocyanine prior to the transforming is produced by an acid paste process that involves such sufficient rinsing with de-ionized water that the rinsed de-ionized water exhibits at least one of a pH of 6.0 to 8.0 and a specific conductivity of 8.0 or less.

6. The photoconductor according to claim 3, wherein the transforming of the titanyl phthalocyanine is conducted using the organic solvent 30 times or more than the amount of the amorphous or lower crystallinity titanyl phthalocyanine.

7. The photoconductor according to claim 1, wherein the crosslinked charge transporting layer is substantially insoluble against organic solvents.

8. The photoconductor according to claim 1, wherein the functional group of the radical polymerizable monomer having three or more functionalities and no charge transporting structure, employed in forming the crosslinked charge transporting layer, is one of acryloyloxy group and methacryloyloxy group.

9. The photoconductor according to claim 1, wherein the radical polymerizable monomer having three or more functionalities and no charge transporting structure, employed in forming the crosslinked charge transporting layer, has a ratio of molecular weight to functionalities (molecular weight/functionalities) of 250 or less.

10. The photoconductor according to claim 1, wherein the functional group of the radical polymerizable compound having one functionality and a charge transporting structure, employed in forming the crosslinked charge transporting layer, is one of acryloyloxy group and methacryloyloxy group.

11. The photoconductor according to claim 1, wherein the charge transporting portion of the radical polymerizable compound having one functionality and a charge transporting structure, employed in forming the crosslinked charge transporting layer, has a triarylamine structure.

12. The photoconductor according to claim 1, wherein the radical polymerizable compound having one functionality and a charge transporting structure, employed in forming the crosslinked charge transporting layer, is at least one of the compounds expressed by the following General Formulas (1) and (2):

General Formula (1)

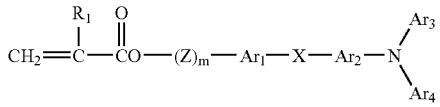

General Formula (2)

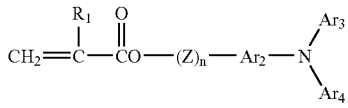

wherein $R_1$ represents a hydrogen atom, a halogen atom, an alkyl group which may be substituted, an aralkyl group which may be substituted, an aryl group which may be substituted, a cyano group, a nitro group, an alkoxy group, —$COOR_7$ ($R_7$ represents a hydrogen atom, an alkyl group which may be substituted, an aralkyl group which may be substituted or an aryl group which may be substituted), a halogenated carbonyl group or $CONR_8R_9$ ($R_8$ and $R_9$ represent a hydrogen atom, a halogen atom, an alkyl group which may be substituted, an aralkyl group which may be substituted or an aryl group which may be substituted, which may be identical or different); $Ar_1$ and $Ar_2$ represent a substituted or unsubstituted arylene group, which may be identical or different, $Ar_3$ and $Ar_4$ represent a substituted or unsubstituted aryl group, which may be identical or different, X represents a single bond, a substituted or unsubstituted alkylene group, a substituted or unsubstituted cycloalkylene group, a substituted or unsubstituted alkylene ether group, a oxygen atom, a sulfur atom or a vinylene group; Z represents a substituted or unsubstituted alkylene group, a substituted or unsubstituted alkylene ether group or an alkyleneoxycarbonyl group, and m and n represent an integer of 0 to 3.

13. The photoconductor according to claim 1, wherein the radical polymerizable compound having one functionality and a charge transporting structure, employed in forming the crosslinked charge transporting layer, is at least one of the compounds expressed by the following General Formula (3):

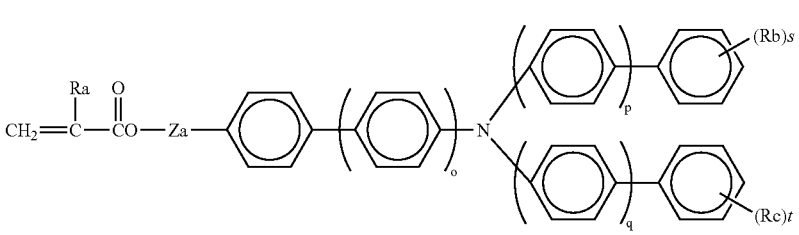

General Formula (3)

General Formula (3)

wherein "o," "p" and "q" each represents an integer of 0 or 1, Ra represents a hydrogen atom, or a methyl group, Rb and Rc represent a substituent other than a hydrogen atom which is a $C_{1-6}$ alkyl group and may be different when they are two or more, "s" and "t" represent an integer of 0 to 3, and Za represents a single bond, a methylene group, an ethylene group, or a group expressed by the following formulas:

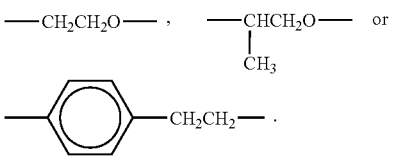

14. The photoconductor according to claim 1, wherein the radical polymerizable monomer having three or more functionalities and no charge transporting structure, employed in forming the crosslinked charge transporting layer, is incorporated into an amount of 30 to 70% by mass based on the total amount of the crosslinked charge transporting layer.

15. The photoconductor according to claim 1, wherein the radical polymerizable compound having one functionality and a charge transporting structure, employed in forming the crosslinked charge transporting layer, is incorporated into an amount of 30 to 70% by mass based on the total amount of the crosslinked charge transporting layer.

16. The photoconductor according to claim 1, wherein the crosslinked charge transporting layer is cured using a member selected from the group consisting of thermal energy and optical energy.

17. The photoconductor according to claim 1, wherein the charge transporting layer comprises a polymer of charge transporting substance.

18. The photoconductor according to claim 17, wherein the polymer of charge transporting substance has a triarylamine structure at one of the backbone chains and the pendent chains.

19. A process cartridge comprising a photoconductor, and at least one of an electrostatic latent image forming unit configured to form an electrostatic latent image on the photoconductor, a developing unit configured to develop the electrostatic latent image by means of a toner to form a visible image, a transferring unit configured to transfer the visible image on a recording medium, and a cleaning unit configured to clean the toner remaining on the photoconductor, wherein the process cartridge is mounted in an attachable and detachable fashion to a main body of an image forming apparatus, wherein the photoconductor comprises a substrate, a charge generating layer, a charge transporting layer, and a crosslinked charge transporting layer in order, the charge generating layer contains titanyl phthalocyanine crystal particles that exhibit a highest peak at 27.2°, main peaks at 9.4°, 9.6° and 24.0°, a peak at 7.3° as the lowest angle, and with no peaks in a range between 7.3° and 9.4°, and with no peak at 26.3° as Bragg 2θ angles (±0.2°) in terms of CuK-α characteristic X-ray wavelength at 1.542 Å, and the averaged primary particle size of the titanyl phthalocyanine crystal particles is 0.25 μm or less, and the crosslinked charge transporting layer contains a reaction product of a radical polymerizable monomer having three or more functionalities and no charge transporting structure and a radical polymerizable compound having one functionality and a charge transporting structure, and the thickness of the crosslinked charge transporting layer is 1 to 10 μm.

20. An image forming process comprising:

forming an electrostatic latent image on a photoconductor, developing the electrostatic latent image by means of a toner to form a visible image, transferring the visible image on a recording medium, and fixing the transferred image on the recording medium, wherein the photoconductor comprises a substrate, a charge generating layer, a charge transporting layer, and a crosslinked charge transporting layer in order, the charge generating layer contains titanyl phthalocyanine crystal particles that exhibit a highest peak at 27.2°, main peaks at 9.4°, 9.6° and 24.0°, a peak at 7.3° as the lowest angle, and with no peaks in a range between 7.3° and 9.4°, and with no peak at 26.3° as Bragg 2θ angles (±0.2°) in terms of CuK-α characteristic X-ray wavelength at 1.542 Å, and the averaged primary particle size of the titanyl phthalocyanine crystal particles is 0.25 μm or less, and the crosslinked charge transporting layer contains a reaction product of a radical polymerizable monomer having three or more functionalities and no charge transporting structure and a radical polymerizable compound having one functionality and a charge transporting structure, and the thickness of the crosslinked charge transporting layer is 1 to 10 μm.

21. An image forming apparatus comprising a photoconductor, an electrostatic latent image forming unit configured to form an electrostatic latent image on the photoconductor, a developing unit configured to develop the electrostatic latent image by means of a toner to form a visible image, a transferring unit configured to transfer the visible image on a recording medium, and a fixing unit configured to fix the transferred image on the recording medium, wherein the photoconductor comprises a substrate, a charge generating layer, a charge transporting layer, and a crosslinked charge transporting layer in order, the charge generating layer contains titanyl phthalocyanine crystal particles that exhibit a highest peak at 27.2°, main peaks at 9.4°, 9.6° and 24.0°, a peak at 7.3° as the lowest angle, and with no peaks in a range between 7.3° and 9.4°, and with no peak at 26.3° as Bragg 2θ angles (±0.2°) in terms of CuK-α characteristic X-ray wavelength at 1.542 Å, and the averaged primary particle size of the titanyl phthalocyanine crystal particles is 0.25 μm or less, and the crosslinked charge transporting layer contains a reaction product of a radical polymerizable monomer having three or more functionalities and no charge transporting structure and a radical polymerizable compound having one functionality and a charge transporting structure, and the thickness of the crosslinked charge transporting layer is 1 to 10 μm.

* * * * *